US008091540B2

(12) United States Patent
Matasic et al.

(10) Patent No.: US 8,091,540 B2
(45) Date of Patent: Jan. 10, 2012

(54) CROSSBOW

(75) Inventors: Charles S. Matasic, West Chester, PA (US); Baron E. Abel, Wrightsville, PA (US); Sujan V. Patel, Elizabethtown, PA (US); Curvin L. Wolfgang, Jr., East Prospect, PA (US)

(73) Assignee: Kodabow, Inc., West Chester, PA (US)

( * ) Notice: Subject to any disclaimer, the term of this patent is extended or adjusted under 35 U.S.C. 154(b) by 632 days.

(21) Appl. No.: 12/206,386

(22) Filed: Sep. 8, 2008

(65) Prior Publication Data

US 2009/0064978 A1 Mar. 12, 2009

Related U.S. Application Data

(60) Provisional application No. 60/970,694, filed on Sep. 7, 2007.

(51) Int. Cl.
*F41B 5/12* (2006.01)

(52) U.S. Cl. ..... 124/31; 124/25; 124/35.1; 124/40; 124/86

(58) Field of Classification Search ..... 124/25, 124/31, 35.1, 40, 86
See application file for complete search history.

(56) References Cited

U.S. PATENT DOCUMENTS 4,258,689 A 3/1981 Barnett
4,479,480 A 10/1984 Holt
4,505,182 A * 3/1985 Sullivan ..... 89/132
4,545,358 A 10/1985 Collins
4,693,228 A 9/1987 Simonds et al.
4,719,897 A 1/1988 Gaudreau
4,827,894 A 5/1989 Schallberger
4,877,008 A * 10/1989 Troubridge ..... 124/25
4,908,970 A * 3/1990 Bell ..... 42/69.02
4,942,861 A 7/1990 Bozek
5,025,771 A 6/1991 Hanson
5,085,200 A * 2/1992 Horton-Corcoran et al. ... 124/25
5,193,725 A 3/1993 Radocy
5,224,463 A * 7/1993 Townsend ..... 124/35.2
5,233,172 A 8/1993 Chadima, Jr. et al.
5,546,924 A * 8/1996 Todd ..... 124/35.2
5,553,596 A 9/1996 Bednar
5,596,976 A 1/1997 Waiser
5,598,829 A * 2/1997 Bednar ..... 124/25
5,649,520 A * 7/1997 Bednar ..... 124/25
5,680,853 A 10/1997 Clayton
5,823,172 A 10/1998 Suggitt
5,884,614 A * 3/1999 Darlington et al. ..... 124/25
5,987,724 A 11/1999 Kleman
6,095,128 A 8/2000 Bednar
6,173,707 B1 1/2001 Howell et al.

(Continued)

*Primary Examiner* — Gene Kim
*Assistant Examiner* — Alexander Niconovich
(74) *Attorney, Agent, or Firm* — McCarter & English

(57) ABSTRACT

A crossbow includes a trigger mechanism having a trigger housing for receiving a bowstring of a crossbow and a bowstring catch mounted with respect to the housing and adapted to releasably engage a crossbow bowstring brought within the trigger housing. The crossbow further includes a trigger adapted to releasably engage the bowstring catch, the trigger being further adapted to be selectively actuated by a user so as to cause the trigger to release the bowstring catch, thereby causing the bowstring catch to release a crossbow bowstring. Optionally, the crossbow may include a ball disposed between the bowstring catch and the trigger, the ball being adapted to bear and react to forces arising between the bowstring catch and the trigger during at least one of the trigger so engaging the bowstring catch and the trigger so releasing the bowstring catch.

15 Claims, 45 Drawing Sheets

U.S. PATENT DOCUMENTS

| | | | | |
|---|---|---|---|---|
| 6,205,990 | B1 * | 3/2001 | Adkins | 124/25 |
| 6,286,496 | B1 | 9/2001 | Bednar | |
| 6,390,294 | B1 | 5/2002 | Fiore, Jr. et al. | |
| 6,425,386 | B1 * | 7/2002 | Adkins | 124/31 |
| 6,571,785 | B1 | 6/2003 | Choma | |
| 6,672,299 | B2 | 1/2004 | Proctor | |
| 6,705,304 | B1 | 3/2004 | Pauluhn | |
| 6,718,962 | B2 | 4/2004 | Adcock | |
| 6,736,123 | B1 * | 5/2004 | Summers et al. | 124/25 |
| 6,799,566 | B1 | 10/2004 | Malucelli | |
| 6,802,304 | B1 * | 10/2004 | Chang | 124/25 |
| 6,820,606 | B1 * | 11/2004 | Duffey | 124/31 |
| 6,868,845 | B1 | 3/2005 | Moore | |
| 6,874,491 | B2 | 4/2005 | Bednar | |
| 6,874,492 | B1 * | 4/2005 | Schavone | 124/31 |
| 6,886,549 | B2 | 5/2005 | McPherson | |
| 6,990,970 | B1 | 1/2006 | Darlington | |
| 7,017,568 | B1 | 3/2006 | Smith | |
| 7,025,051 | B1 | 4/2006 | Gallops, Jr. | |
| 7,051,467 | B1 * | 5/2006 | Huber | 42/69.01 |
| 7,066,166 | B2 | 6/2006 | Crites, Jr. et al. | |
| 7,100,590 | B2 | 9/2006 | Chang | |
| 7,174,884 | B2 * | 2/2007 | Kempf et al. | 124/25 |
| 7,588,022 | B2 * | 9/2009 | Chang | 124/25 |
| 7,770,567 | B1 * | 8/2010 | Yehle | 124/25 |
| 2005/0011505 | A1 * | 1/2005 | Nygaard et al. | 124/31 |
| 2005/0072415 | A1 * | 4/2005 | Schavone | 124/31 |
| 2005/0279338 | A1 | 12/2005 | Dziekan | |
| 2008/0017177 | A1 * | 1/2008 | Pedemonte | 124/31 |
| 2009/0078243 | A1 * | 3/2009 | Bednar et al. | 124/31 |
| 2009/0194086 | A1 * | 8/2009 | Kempf | 124/25 |

* cited by examiner

CROSSBOW

FIELD OF THE INVENTION

The present disclosure is directed to an archery device. More particularly, the present disclosure is directed to a crossbow having at least one of a cocking mechanism, a trigger mechanism, a dry-fire prevention mechanism, and a hinged-limb mechanism.

BACKGROUND OF THE INVENTION

As target and sport archery increases in popularity, several shortcomings of the standard archery equipment limit many users and lead to safety concerns for all. In order to improve the experience and safety, improvements to the standard equipment in the areas of transporting and assembling the crossbow, drawing back the bowstring, releasing the bowstring, and preventing dry-fires are needed.

The basic crossbow form, with a stock and transverse limbs, can be bulky and difficult to store and transport. A case for storing and transporting the crossbow may be determined by the shape of the crossbow, and as such may require a considerable amount of storage space, and may be awkward to carry and move from place to place.

A crossbow having fixed limbs and a stock may be stored or transported in a pre-loaded state, with its bowstring strung between the limbs, avoiding the time and effort required for reassembly, but potentially creating safety concerns and/or elevated component wear over time due to the presence of a continuous preload in the bowstring and the limbs. A crossbow having fixed limbs and a stock may alternatively be stored or transported in an unloaded state (e.g., without a bowstring), allowing relaxation of the limbs during periods of non-use and transport, but potentially requiring a great deal of effort to string the crossbow each time the crossbow is retrieved prior to use.

A crossbow may have limbs that are moveable relative to the stock, thereby permitting the limbs to be collapsed for purposes of storage and transport of the crossbow. In such circumstances, a bowstring of the crossbow may be retained, in a slackened state, between the limbs during storage and transport, or removed therefrom and replaced upon retrieval of the crossbow prior to use. A user may begin the process of placing the limbs in a shooting position by rotating the limbs outward from the stock from the collapsed configuration of the crossbow to arrive at the partially reassembled configuration of the crossbow. Each of the limbs can be rotated outward from the stock to a substantial fraction of its total rotational throw relative thereto before the bowstring loses all of its slack and begins to build tension.

A user may continue the process of placing the limbs in a shooting position by rotating the limbs further outward from the stock from the partially reassembled configuration of the crossbow to the fully assembled configuration. It is only with respect to this relatively small remaining portion of the total rotational throw of the limbs relative to the stock that that the total magnitude of force required to be applied to the limbs and the stock truly begin to grow, and grow rapidly. Further complicating this strenuous task is the general requirement that each of the limbs remain both accurately positioned relative to the stock, as well as securely retained therein, at all times during and after final assembly in order to prevent accidents from occurring (e.g., especially while the crossbow is in use during the hunt).

Once the crossbow is properly configured in the regular position, the user may cock the crossbow in preparation for loading and firing a crossbow arrow or bolt via the bowstring. In general, the crossbow must impart a substantial amount of force in order to accurately propel a bolt with respect to any intended target. In order to store in the crossbow the energy needed to imparting such force to the bolt, the user must draw the bowstring back along the stock to a distance extent sufficient to preload or 'cock' the crossbow. This task can also be quite strenuous, generally requiring the user to generate a large amount of force.

A user may cock the crossbow via direct manual cocking. For example, a user of sufficient strength may elect simply to hold the stock with one hand, and draw the bowstring backward along the stock to a sufficient distance extent with the other. Alternatively, a user may cock the crossbow via indirect manual cocking. For example, a user may choose to employ an assist device, such as a cord assembly. The cord assembly may include a cord and a pair of manual gripping handles disposed at opposite ends of the cord. Such a user may use their feet to hold a crossbow pointed downward against the ground, couple the cord of the cord assembly to a bowstring of the crossbow, and pull upward as necessary with both hands using the gripping handles. Either way, manual cocking of a crossbow requires a user to generate considerable force, which can quickly become tiring, especially when attempted repeatedly during the course of a hunt.

Various mechanisms have been developed over time to assist the user in generating the force necessary to cock a crossbow. An example of such a mechanism is a crossbow having a stock and a bowstring may further include a crank assembly having a housing, a length of cord, and a rotatable crank arm. A catch is further disposed at an end of the cord. In operation, a user typically manually draws the bowstring far enough toward the housing to permit the bowstring to be engaged by the catch. The rotatable crank arm is typically of sufficient length, and/or is typically associated with a sufficient amount of mechanical advantage, to permit the user to relatively easily reel the cord back into the housing, thereby continuing the process of drawing the bowstring back gradually along the stock, even as the amount of tension in the bowstring begins to grow rapidly. Eventually, the bowstring will have been drawn back along the stock sufficiently to cause the crossbow to become cocked, at which time the cord may be safely detached from the bowstring and fully reeled back into the housing (e.g., for storage in advance of next use). While plainly useful for completing the strenuous final state of drawing back the bowstring, such a crank assembly can add considerable weight and/or bulk to the crossbow.

A cocked crossbow embodies a great deal of stored energy. Such stored energy may be released in different ways. For example, a user can load an arrow or 'bolt' onto a cocked crossbow and thereafter actuate an associated trigger mechanism, thus firing the bolt from the crossbow (i.e., energy release via transfer/conversion). For another example, a user may decide not to fire a bolt, but rather to 'decock' the crossbow by reversing (e.g., in a safe, controlled fashion) the process by which the crossbow was cocked (i.e., energy release via dissipation). In most if not all instances, however, it will generally be important to prevent the crossbow from releasing such stored energy prematurely, and/or as a result of an accident. For example, while the crossbow is being moved during hunting, but prior to firing, it may be advantageous to keep the crossbow fully cocked (e.g., for purposes of readiness), but unloaded (e.g., for purposes of safety and/or convenience), such that all a user would need to do to fire the crossbow, once the decision to do so is finally made, is to load a bolt onto the crossbow stock, and then actuate an associated trigger mechanism (e.g., by pulling a trigger), allowing the bowstring to move forward and outward of the trigger mechanism, thereby rapidly propelling the bolt away from the crossbow along the same forward direction.

Keeping the trigger mechanism in such an advanced state of readiness can tend to minimize both the total amount of time needed, as well as the total amount of physical effort required to be expended in actually firing the crossbow, once the decision is finally made to do so. Unfortunately, however, the same advanced state of firing readiness in the trigger mechanism can tend to leave the crossbow vulnerable to so-called 'dry fire', in which a cocked bowstring of the crossbow is unintentionally released prior to a bolt being loaded in the crossbow, such that the time and effort needed to cock the crossbow in the first place must now be repeated. Dry fire can occur in any number of situations, including, for example, situations in which the crossbow is dropped, or in which the trigger mechanism is mistakenly actuated (e.g., while the crossbow is being moved, stowed, or retrieved during hunting).

In order to protect against dry fire, modern crossbow designs will typically include corresponding safety mechanisms. For example, a crossbow may include a stock, a trigger mechanism, and a stop mechanism. The stop mechanism may include an arm that may be biased (e.g., via spring-loading) toward movement in the counter clockwise direction, but is deflectable as necessary in the opposite rotational direction. The stop mechanism may further include a manually operable handle. During a process of cocking the crossbow, the bowstring is drawn along the stock toward the trigger mechanism. Reaching the position of the stop mechanism, the bowstring will tend, as it passes the arm, to displace the arm upward and away from the rearward directed path of the bowstring along the stock. Upon further drawing of the bowstring into the trigger mechanism and past the position of the stop mechanism to complete cocking of the crossbow, the arm, now no longer in contact with the bowstring, is urged (e.g., via the aforementioned spring load) or otherwise allowed to rotate downward again, such that the arm is caused to rest against the stock.

In firing operation of the crossbow (i.e., after the same has been cocked as described above), the dry fire prevention function (described more fully below) of the stop mechanism is overridden. More particularly, a bolt may be loaded onto the crossbow by being moved backward along the stock along the direction, toward and into the trigger mechanism. In the process of being loaded onto the crossbow, a tail end of the bolt displaces the arm upwards and out of the rearward path of the bolt. At this time, and up until a moment of firing the bolt, the arm may be allowed to rest atop a longitudinal shaft of the bolt. Upon the trigger mechanism being actuated, the bowstring is released. Since the arm of the stop mechanism remains displaced away from a forward path of the bowstring and of the bolt along the direction, the stop mechanism presents no obstruction with respect to continued forward motion of the same.

The crossbow is further operable in a dry fire prevention mode, with respect to which the arm of the stop mechanism, at least initially, tends to rest against the stock of the crossbow. More particularly, after the crossbow has been cocked, but before the crossbow has been loaded with a bolt as described above, the trigger mechanism may be vulnerable to inadvertent actuation, normally leading to an unintended release of the bowstring from the trigger mechanism. Upon the now released bowstring moving forward to the position of the stop mechanism, the arm serves to 'catch' the bowstring at a position along the stock just forward of the trigger mechanism. Thereafter, the arm further cooperates with the stock to block any further forward motion of the bowstring. The user is now permitted to recock the bowstring by drawing the bowstring back into engagement with the trigger mechanism, or, alternatively, to allow a full, but now gradual release of the bowstring by a) partially drawing the bowstring back toward the trigger mechanism, b) manually displacing the arm upward and away from the bowstring by pulling downward on the handle, and c) permitting the bowstring to move slowly forward again along the direction.

By limiting unintended discharge of the bowstring to a relatively small throw during dry fire, the stop mechanism provides an important safety feature. However, even when working as intended, the stop mechanism not only still fails to prevent dry fire, but also requires the bowstring to be redrawn to at least some extent backward along the stock and back into engagement with the trigger mechanism to restore the crossbow to the fully cocked state. Accordingly, apparatus and methods for preventing unintended discharge of a trigger mechanism of an unloaded crossbow remain both desirable and necessary.

As discussed above, once a crossbow has been cocked, it may be loaded with a bolt and fired. Referring now to FIGS. 1, 2 and 3, numerous trigger mechanisms have been devised for use in releasing the bowstring of a cocked and loaded crossbow. Referring specifically to FIG. 1, a so-called 'power-touch' trigger mechanism 1100 is shown, including a string stop 1102 for engaging and retaining a cocked bowstring 1104, and a trigger 1106. The string stop 1102 includes a forward—(e.g., rightward) facing reaction surface 1108 and the trigger 1106 includes a corresponding rearward—(e.g., leftward) facing reaction surface 1110. Forward-directed pulling force from the bowstring 1104 tends to urge the string stop 1102 in a counter-clockwise direction 1112. However, the trigger 1106 is itself biased toward movement in the counter-clockwise direction, such that prior to actuation of the trigger 1106, the reaction surface 1110 of the trigger 1106 engages (e.g., via surface-to-surface or edge-to-surface contact) the reaction surface 1108 of the string stop 1102, and the forward-directing pulling force from the bowstring 1104 is squarely opposed. A user actuates the trigger 1106 via a rearward-directed pull on a trigger blade 1114, pivoting the trigger 1106 in a clockwise direction 1116, thereby withdrawing the reaction surface 1110 from the reaction surface 1108 and allowing the bowstring 1104 to begin pulling the string stop 1102 in the counter-clockwise direction 1112 such that the latter releases the former.

Referring now to FIG. 2, a so-called 'drop latch' trigger mechanism 1200 is shown, including a string stop 1102 for engaging and retaining a cocked bowstring 1204, and a trigger 1206. The string stop 1202 includes a rearward-facing reaction surface 1208 and the trigger 1206 includes a corresponding forward-facing reaction surface 1210. Forward-directed pulling force from the bowstring 1204 tends to urge the string stop 1202 in a clockwise direction 1212. However, the trigger 1206 is biased toward movement in the counter-clockwise direction, such that prior to actuation of the trigger 1206, the reaction surface 1210 of the trigger 1206 engages (e.g., via surface-to-surface or edge-to-surface contact) the reaction surface 1208 of the string stop 1202, and the forward-directing pulling force from the bowstring 1204 is squarely opposed. A user actuates the trigger 1206 via a rearward-directed pull on a trigger blade 1214, pivoting the trigger 1206 in a clockwise direction 1216, thereby withdrawing the reaction surface 1210 from the reaction surface 1208 and allowing the bowstring 1204 to begin rotating the string stop 1202 in the clockwise direction 1212 such that the latter releases the former.

Turning now to FIG. 3, a so-called 'roller touch' trigger mechanism 1300 is shown, including a string stop 1302 for engaging and retaining a cocked bowstring 1304, and a trigger 1306. The string stop 1302 includes a rearward-facing reaction surface 1308 and the trigger 1306 includes a roller 1309 exhibiting a rotating reaction surface 1310. Forward-directed pulling force from the bowstring 1304 tends to urge the string stop 1302 in a clockwise direction 1312. However, the trigger 1306 is biased toward movement in the counter-clockwise direction, such that prior to actuation of the trigger 1306, the reaction surface 1310 of the trigger 1306 engages (e.g., via line-to-surface contact) the reaction surface 1308 of the string stop 1302, and the forward-directing pulling force from the bowstring 1304 is squarely opposed. A user actuates the trigger 1306 via a rearward-directed pull on a trigger blade 1314, pivoting the trigger 1306 in a clockwise direction 1316, thereby rolling the roller 1309 across the reaction surface 1308 to a point where the reaction surface 1310 releases the reaction surface 1308, allowing the bowstring 1304 to begin rotating the string stop 1302 in the clockwise direction 1312, rapidly causing the latter to release the former.

As discussed above with respect to FIGS. 1, 2 and 3, each of the trigger mechanisms 1100, 1200 and 1300 includes opposing pairs of reaction surfaces 1108 and 1110, 1208 and 1210, and 1308 and 1310 that are at least temporarily aligned and brought into load-bearing contact with each other as part of the crossbow cocking process. At different times and during different phases of the crossbow cocking and firing process, the bowstring 1104, 1204, 1304 will tend to pull with a considerable amount of force on the string stop 1102, 1202, 1302. Typical trigger mechanism designs, however, including the trigger mechanisms 1100, 1200, 1300 discussed herein, tend to confine actual force-bearing interaction as between such reaction surfaces to a relatively short line (e.g., as in line-to-surface or edge-to-surface contact) or to a relatively small area (e.g., as in surface-to surface contact). While this may beneficially reduce the required rotational throw of the trigger blade 1114, 1214, 1314 to a minimum extent, and perhaps enhance the overall precision of the instrument, such an arrangement unfortunately also tends to result in an elevated contact pressure between the reaction surfaces involved. Unfortunately, at least with respect to the present context, along with such elevated contact pressure between the reaction surfaces typically comes an elevated degree of friction between the string stop 1102, 1202, 1302 and the trigger 1106, 1206, 1306 which a user must manually overcome in order to successfully actuate the trigger mechanism 1100, 1200, 1300. Accordingly, apparatus and methods for limiting or reducing the amount of user-generated force required to actuate a crossbow trigger mechanism are both desirable and necessary.

SUMMARY OF THE INVENTION

In accordance with embodiments of the present disclosure, a crossbow is provided including a stock having a fore end, a limb for engaging a bowstring of the crossbow and maintaining a bowstring of the crossbow in a tensioned state, the limb being moveably coupled to the stock in a vicinity of the fore end such that the limb is adapted to be rotated outward from a relatively collapsed position relative to the stock, toward and into a shooting position relative to the stock, and a finger moveably coupled to the stock in a vicinity of the fore end such that the finger is capable of being rotated relative to the stock, the finger further being adapted, via the finger so rotating relative to the stock, to engage and impart an urging force to the limb, and to thereby rotate the limb outward from a relatively collapsed position relative to the stock toward the shooting position relative to the stock.

In accordance with embodiments of the present disclosure, a crossbow is provided that includes a stock having a fore end and a rear end and including a longitudinal extent extending toward the rear end from a vicinity of the fore end; a cocking mechanism for cocking the crossbow, the cocking mechanism including a car moveably coupled to the stock such that the car is capable of translating along the longitudinal extent of the stock from a vicinity of the fore end toward the rear end, the car being further adapted to engage a portion of a bowstring of the crossbow such that as the car so translates, the car further urges the bowstring portion rearwardly along the longitudinal extent of the stock toward and into engagement with a trigger mechanism of the crossbow; and a linkage moveably coupled to the stock in a vicinity of the rear end such that the linkage is capable of being rotated relative to the stock, the linkage further being adapted to engage the car and, via the linkage so rotating relative to the stock, to impart an urging force to the car, and to thereby translate the car rearwardly from a vicinity of the fore end toward the rear end along the longitudinal extent of the stock.

In accordance with embodiments of the present disclosure, a crossbow trigger mechanism is provided that includes a trigger housing for receiving a bowstring of a crossbow, a bowstring catch mounted with respect to the housing and adapted to releasably engage a crossbow bowstring brought within the trigger housing, a trigger adapted to releasably engage the bowstring catch, the trigger being further adapted to be selectively actuated by a user so as to cause the trigger to release the bowstring catch, thereby causing the bowstring catch to release a crossbow bowstring, and a ball disposed between the bowstring catch and the trigger, the ball being adapted to bear and react to forces arising between the bowstring catch and the trigger during at least one of the trigger so engaging the bowstring catch and the trigger so releasing the bowstring catch.

In accordance with embodiments of the present disclosure, a crossbow trigger mechanism is provided that includes a trigger housing for receiving a bowstring of a crossbow, a bowstring catch moveably mounted with respect to the housing and adapted to releasably engage a crossbow bowstring brought within the trigger housing, and a trigger, the trigger including a first trigger element adapted to releasably engage the bowstring catch, and a second trigger element adapted to rotate relative to the first trigger element and to be selectively actuated by a user so as to engage and impart an urging force to the first trigger element for rotating the first trigger element relative to the bowstring catch, and thereby causing the first trigger element to release the bowstring catch.

In accordance with embodiments of the present disclosure, a crossbow trigger mechanism is provided that includes a trigger housing for receiving a bowstring of a crossbow, a bowstring catch mounted with respect to the housing and adapted to releasably engage a crossbow bowstring brought within the trigger housing, and a dry fire stop including a first projection adapted to engage the bowstring catch for limiting a rotation of the bowstring catch away from a crossbow bowstring with which the bowstring catch is releasably engaged, and second projection adapted to extend into a path of a crossbow bolt being loaded into the trigger housing such that as such crossbow bolt is so loaded into the trigger housing, the crossbow bolt rotates the dry fire stop relative to the bowstring catch by impinging on and displacing the second projection away from the bolt loading path, thereby disengaging the first projection of from the bowstring catch and allowing rotation of the bowstring catch away from a crossbow bowstring with which the bowstring catch is releasably engaged.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DETAILED DESCRIPTION OF THE INVENTION

Figure 1:
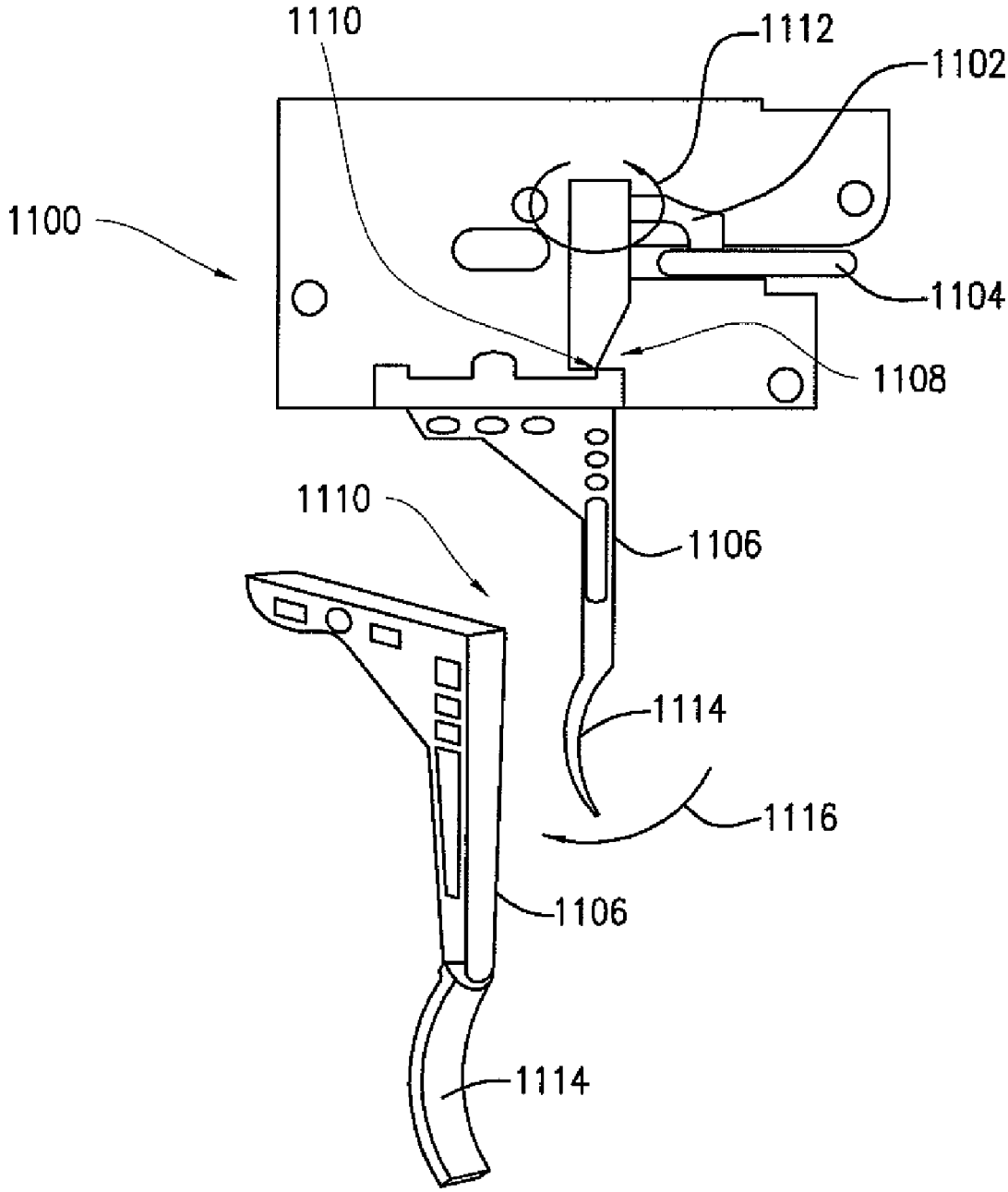
(Prior Art) FIG. 1
FIGS. 1-3 are schematic side views of prior art crossbow trigger mechanisms.
Figure 2:
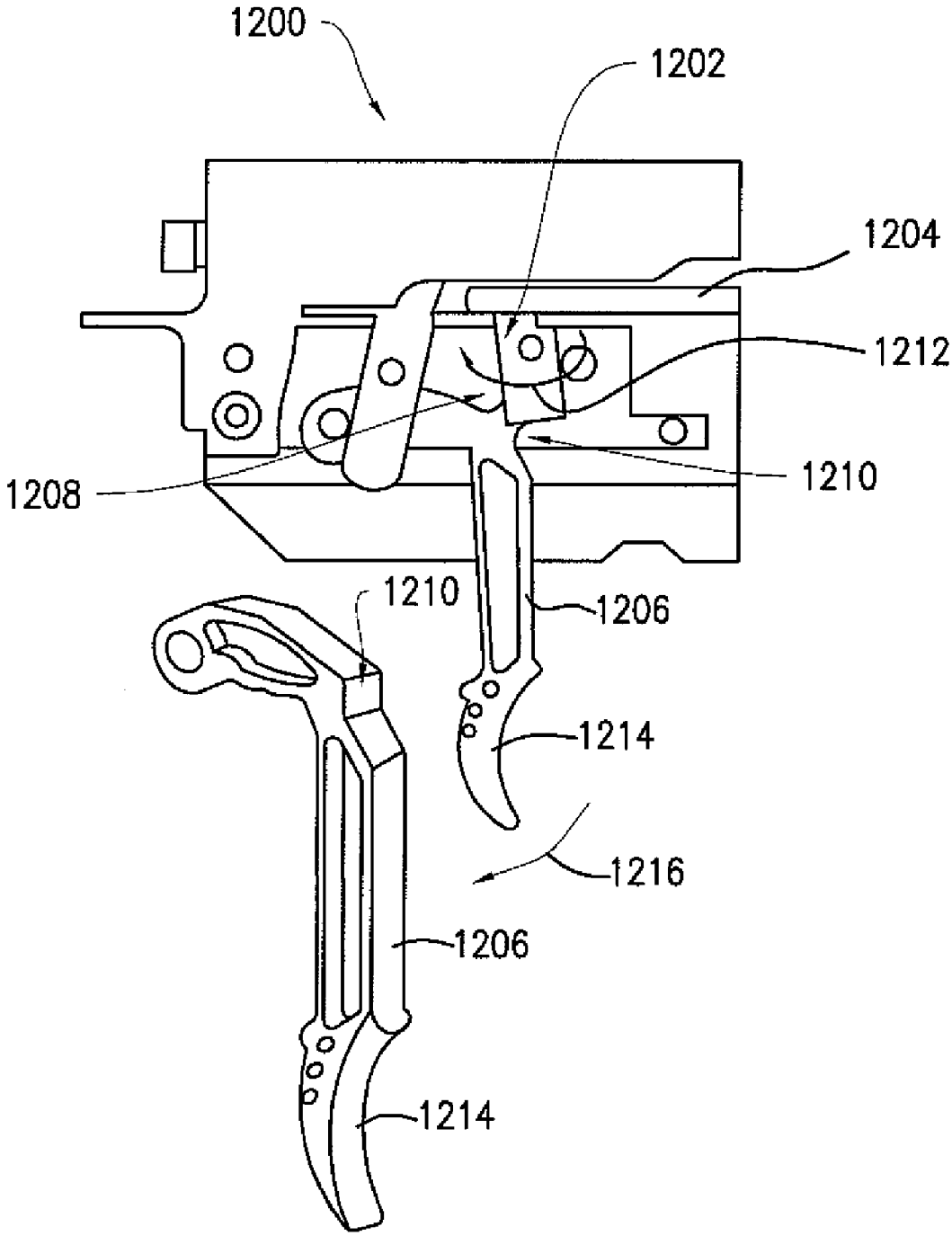
(Prior Art) FIG. 2
Figure 3:
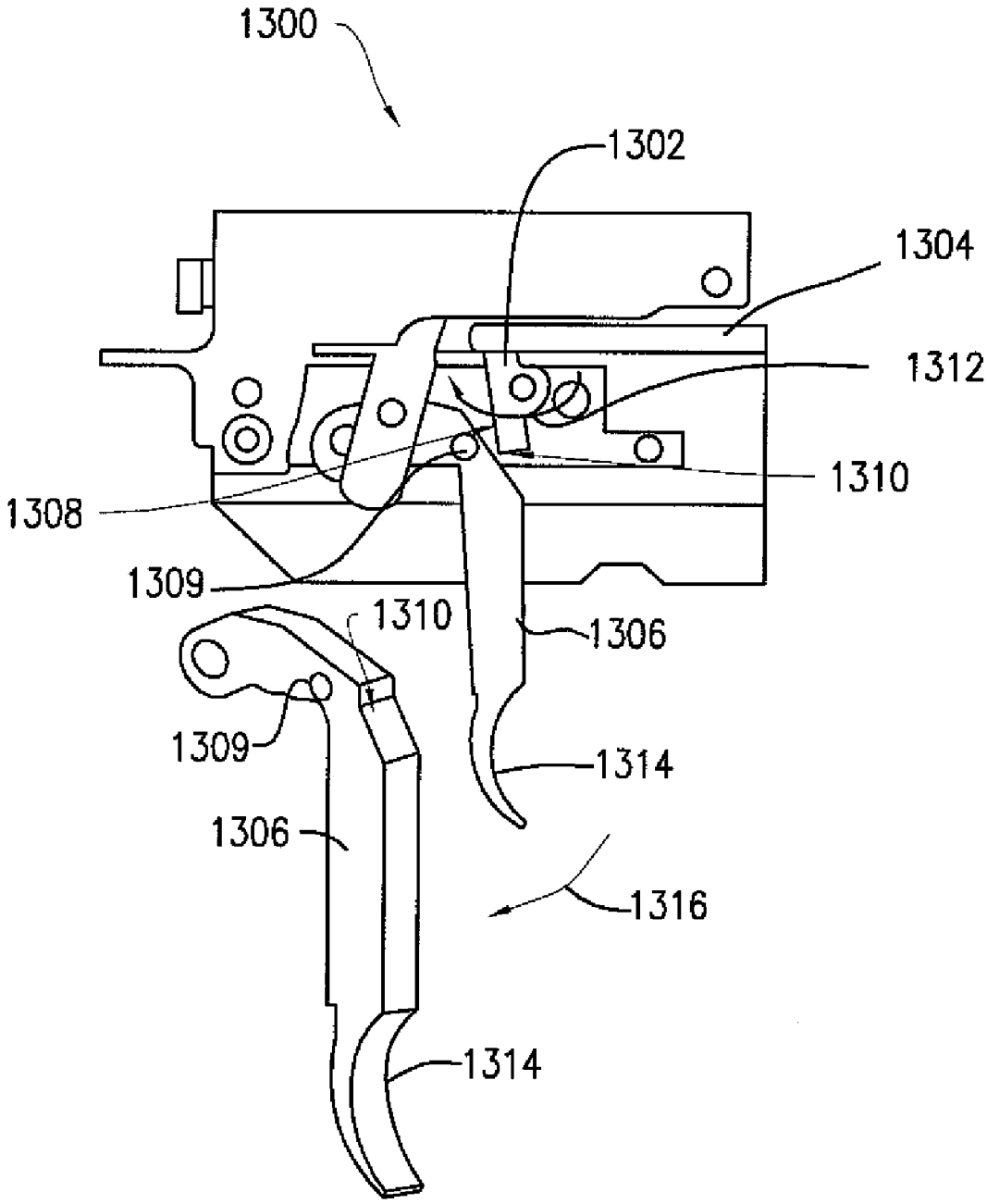
(Prior Art) FIG. 3
Figure 4:
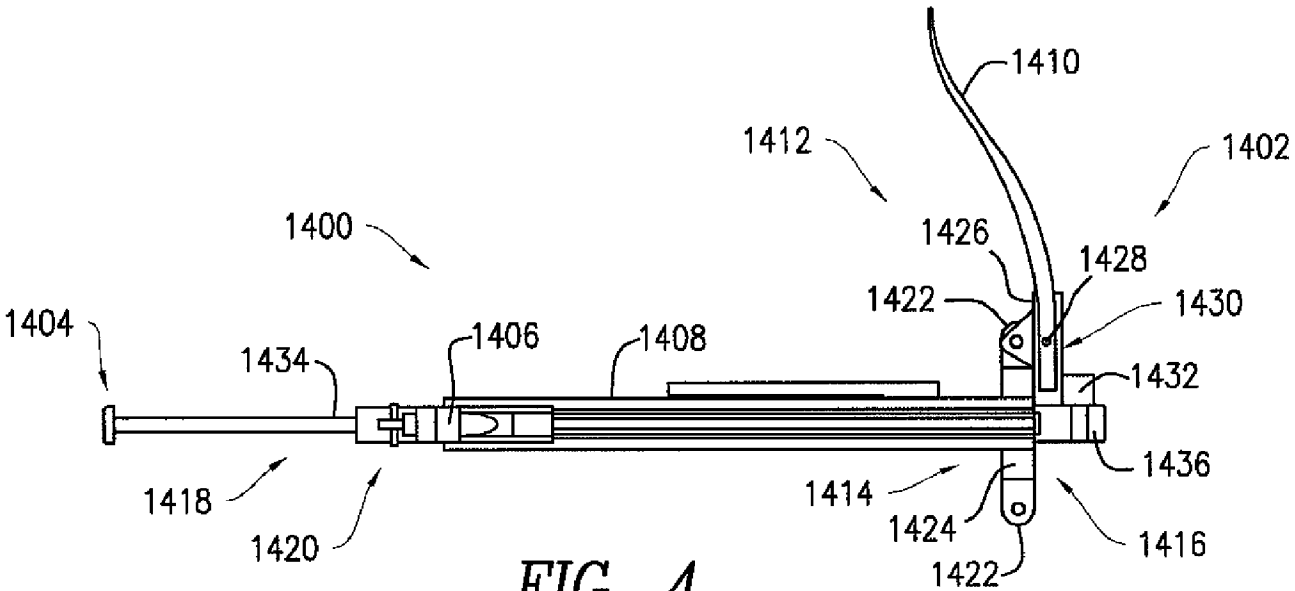
FIGS. 4-10 illustrate a crossbow in accordance with the present disclosure including collapsible limbs, a limb actuator, and a limb locking device.

Referring now to FIG. 4, a crossbow 1400 in accordance with embodiments of the present disclosure is partially shown, in top view. The crossbow 1400, which in FIG. 4 exhibiting a shooting configuration, may have a fore end 1402 and a rear end 1404, and may include a gripper 1406 positioned in a vicinity of the rear end 1404, a stock 1408 coupled to extending from the gripper 1406 and toward the fore end 1402, and limbs 1410 coupled to the stock 1408, at respective sides 1412, 1414 thereof, and in a vicinity of the fore end 1402. As will be described below, the crossbow 1400 may further include a limb support mechanism 1416 via which the limbs 1410 may be both moveable and selectively collapsible relative to the stock 1408. As will also be described below the crossbow 1400 may include a limb actuator 1418, the limb actuator 1418 being interoperable with the limb support mechanism 1416 for permitting a user of no greater than average strength to quickly and easily selectively cause the crossbow 1400 to transition from a collapsed state to the final shooting configuration shown in FIG. 4. As will further be described below, the crossbow 1400 may include a limb locking device 1420 for selectively securing the limbs 1410 in place with respect to the stock 1408 (e.g., so as to ensure that the crossbow 1400 remains in the shooting configuration shown in FIG. 4 as needed or as desired during the hunt).

The limb support mechanism 1416 may include respective hinges 1422 for rotatably coupling the limbs 1410 to the stock 1408. For example, the limb support mechanism 1416 may include a support brace 1424 coupled crosswise with respect to the stock 1408 in a vicinity of the fore end 1402, and a pair of limb receiving elements 1426 rotatably coupled to the support brace 1424 via a respective one of the hinges 1422. Each of the limb receiving elements 1426 may include a pocket 1428 sized, shaped, and otherwise configured and equipped to receive and securely hold a respective proximal end 1430 of one of the limbs 1410. Each of the limb receiving elements 1426 may further include a reaction element 1432 for allowing the limb actuator 1418 to interoperate with the limb support mechanism 1416 as described more fully below.

The limb actuator 1418 may include an arm 1434 (shown partially obscured by the gripper 1406, the stock 1408, and the support brace 1424) extending at least in part toward a vicinity of the rear end 1404 and a finger 1436 extending at least in part toward a vicinity of the fore end 1402. As will be described in greater detail below, the finger 1436 may form a part of the arm 1434, and may be selectively engageable with the reaction elements 1432 as part of a process of placing the crossbow 1400 in the shooting configuration shown in FIG. 4.

Figure 5:
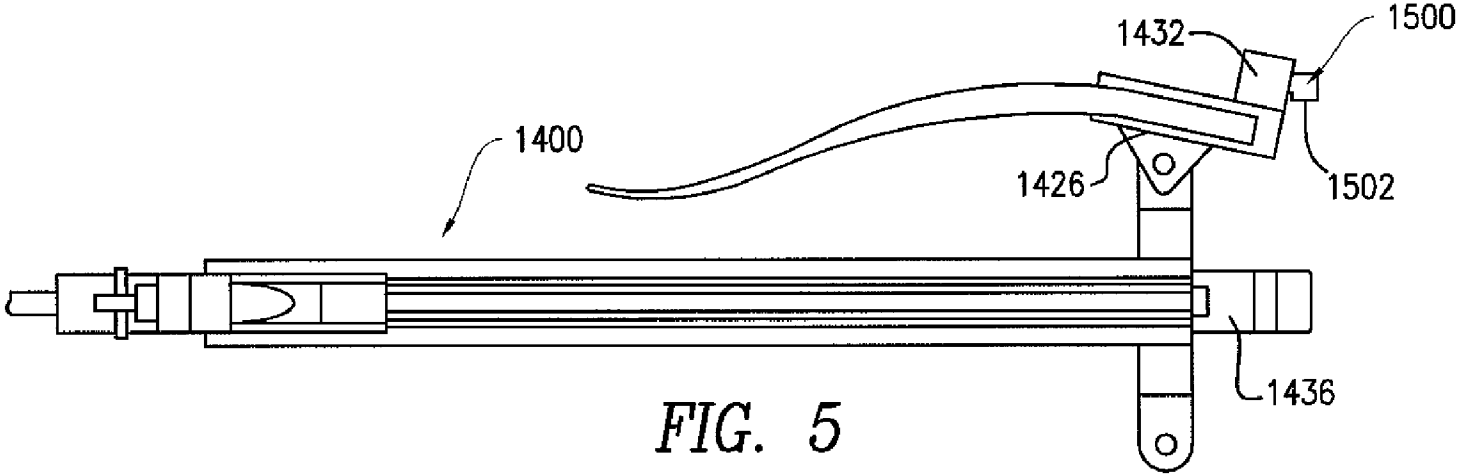

Referring now to FIG. 5, each of the respective reaction elements 1432 of the limb receiving elements 1426 may include a stud 1500. As will be described in greater detail below, each such stud 1500 may include a reaction surface 1502 for interacting with a corresponding surface of the finger 1436 during assembly of the crossbow 1400.

Figure 6:
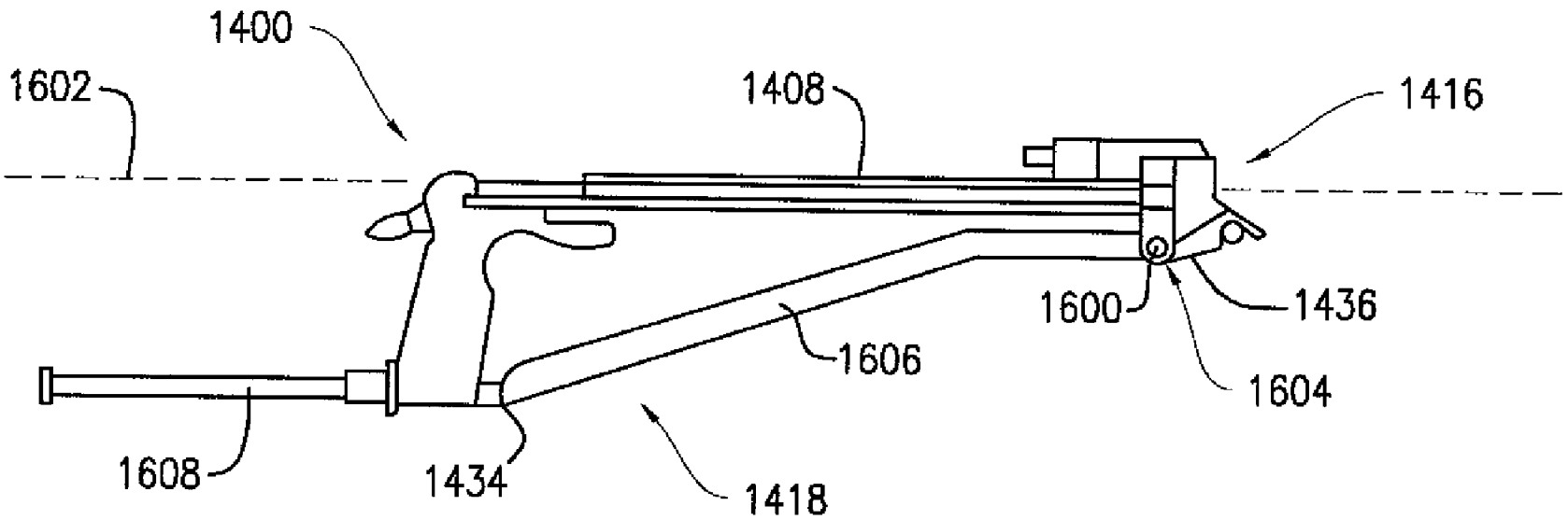

Turning now to FIG. 6, the crossbow 1400 may further include a hinge 1600 for rotatably coupling the limb actuator 1418 to the limb support mechanism 1416, and/or to the stock 1408 (e.g., via the limb support mechanism 1416). The crossbow 1400 may further exhibit a longitudinal axis 1602 defined by a longitudinal extent of the stock 1418. Most or all of the limb actuator 1418 may be disposed beneath the stock 1408, at which location the limb actuator 1418 may be oriented and/or positioned so as to be substantially vertically aligned with the longitudinal axis 1602. As indicated above, the arm 1434 of the limb actuator 1418 may include the finger 1436. The arm 1434 may further include a wrist 1604 (e.g., including a portion of the limb actuator 1418 corresponding to, and/or at least partially forming the hinge 1600), a first elongate portion 1606 (e.g., generally extending between the gripper 1604 and the hinge 1600), and a second elongate portion 1608 (e.g., generally disposed in a vicinity of the gripper 1604).

Figure 7:
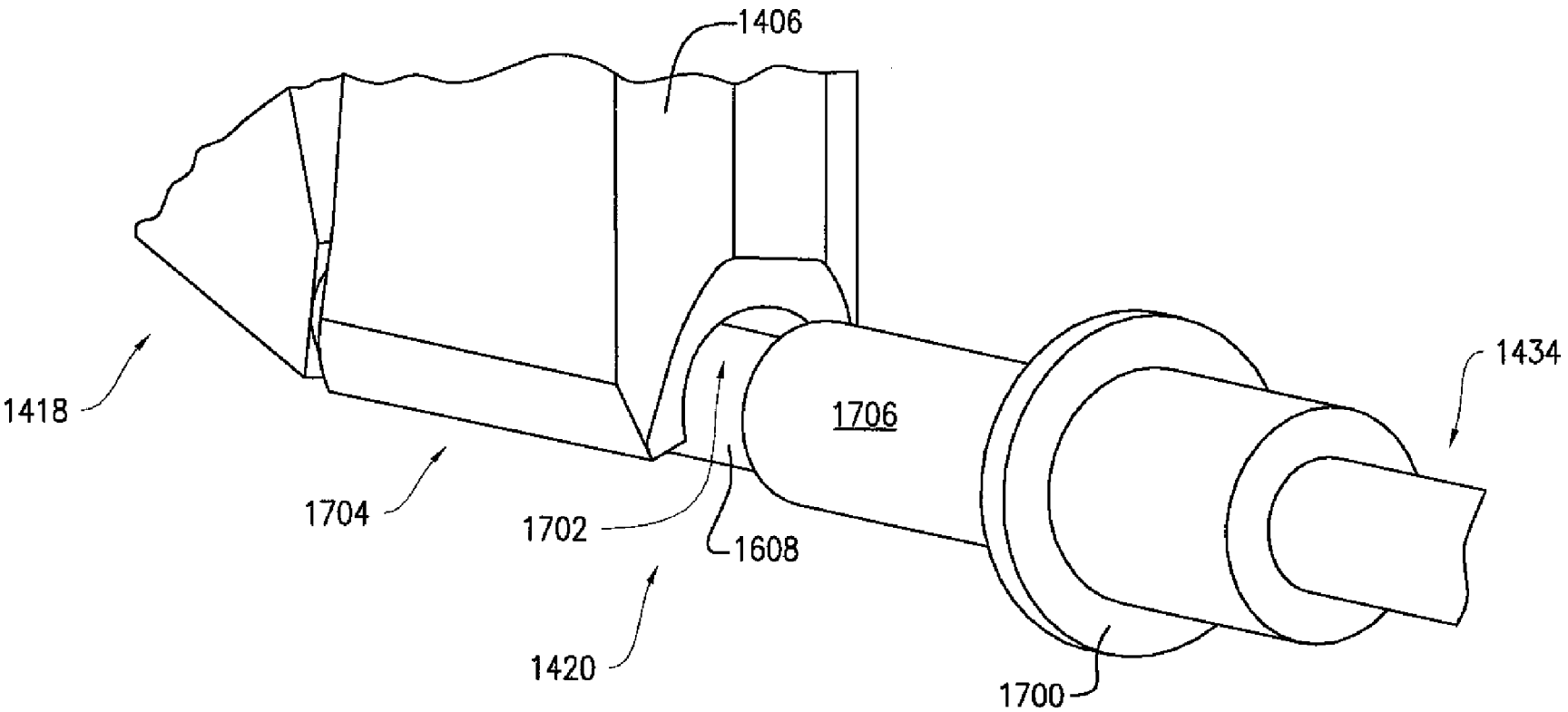

As shown in FIG. 7, the limb locking device 1420 may include a locking element 1700. In embodiments of the present disclosure, the limb locking device 1420 may further include a corresponding pocket 1702 formed in a lower end 1704 of the gripper 1406, wherein the locking element 1700 and the pocket 1702 may be cooperatively sized, shaped and/or configured to permit the former to be securely, slidably, and/or selectably removably received within the latter. In embodiments of the present disclosure, and as described in greater detail below, an internal diameter of the pocket 1702 may be matched to within a relatively close tolerance to a corresponding external diameter of the locking element 1700 to provide a corresponding degree of mechanical precision in the use of the limb locking device 1420. Further with regard to embodiments of the present disclosure, the pocket 1702 need not necessarily constitute a closed through-hole, but, instead, may be at least partially open along the lower end 1704 of the gripper 1406. For example, the pocket 1702 may be open along a lower margin to an extent sufficient to permit the second elongate portion 1608 of the arm 1434 to be rotated upwards into the pocket 1702 in the absence of the locking element 1700.

The locking element 1700 may further be moveably coupled to the arm 1434 of the limb actuator 1418. For example, the locking element 1700 and the second elongate portion 1608 may be cooperatively sized, shaped and/or configured to permit the former to be securely slidably mounted with respect to the latter. In such circumstances, an extent of the material of the gripper 1406 forming the pocket 1702 may be sufficient to substantially prevent rotational 'pull-out' of the arm 1434 relative to the gripper 1406 when the second elongate portion 1608 of the arm 1434 is disposed within the pocket 1702 together with the locking element 1700. For example, an extent of the material of the gripper 1406 may be sufficient to enclose the locking element 1700 to an extent of at least approximately two-thirds of an external perimeter 1706 of the locking element 1700. Other dimensions of the pocket 1702 are possible.

Figure 8:
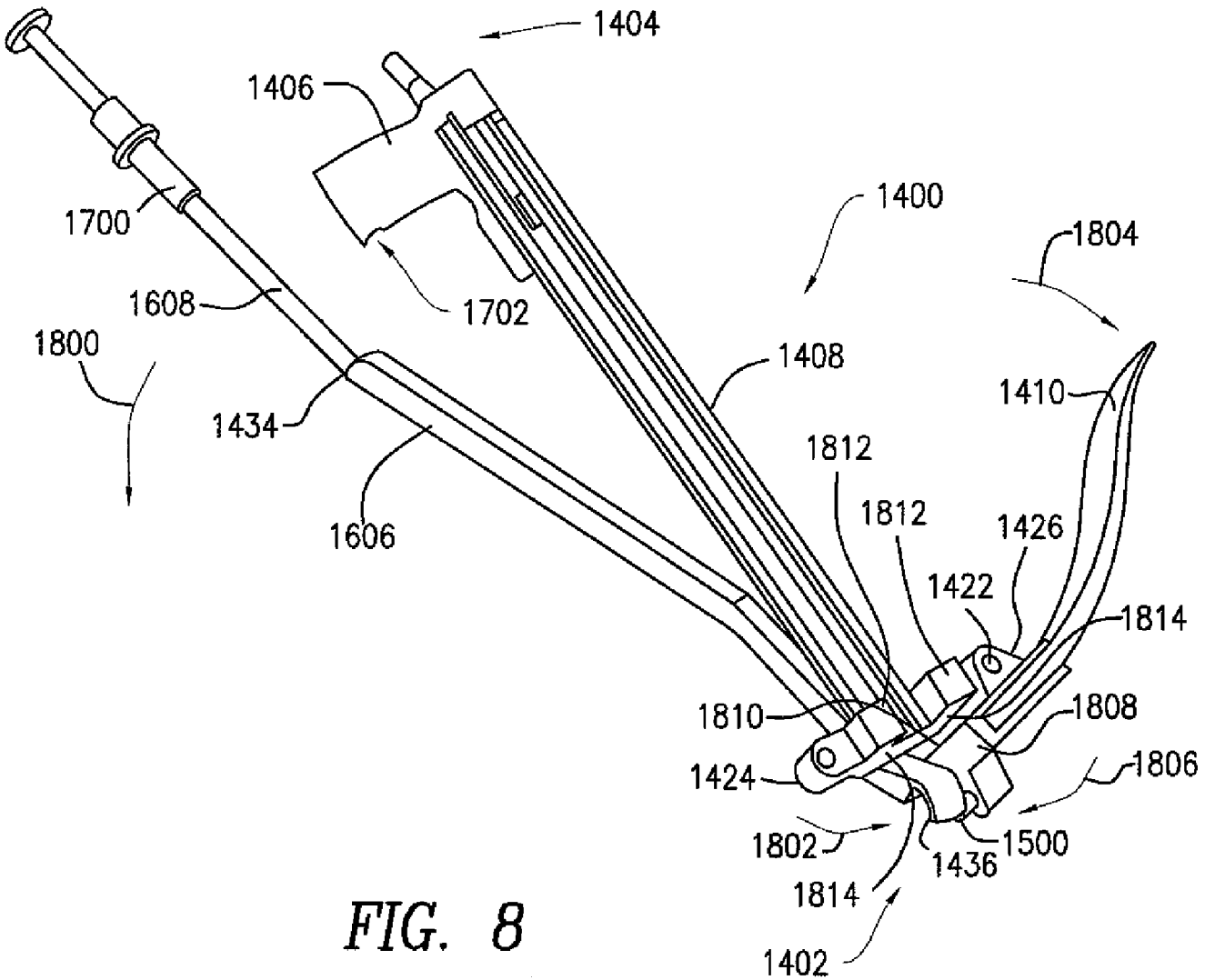

Turning now to FIG. 8, in operation, a procedure to place the crossbow 1400 in the shooting configuration shown in FIG. 4 may begin with the crossbow 1400 assuming a relatively collapsed configuration, e.g., similar to the collapsed configuration of the crossbow. Beginning with such a collapsed configuration, a user may orient the crossbow 1400 such that arm 1434 is positioned beneath the stock 1408 (e.g., vertically aligned with the longitudinal axis 1602), and withdraw the locking element 1700 from the pocket 1702 along the second elongate portion 1608 of the arm 1434 to a distance sufficient to unlock the arm 1434 from the gripper 1406. The arm 1434 may now be permitted to rotate (e.g., to at least some extent in response to the force of gravity, and/or by the user pushing or pulling on the arm 1434 as necessary) about the hinge 1600 (FIG. 6) in the counter clockwise direction. In such circumstances, the first and second elongated portions 1606, 1608 may tend to rotate generally downward as indicated at 1800, and the finger 1436 may tend to rotate generally upward as indicated at 1802, and generally away from the anticipated rotational traverses of the limb receiving elements 1426, as described in greater detail below.

The user may further orient the crossbow 1400 such that the fore end 1402 thereof is directed downwardly, and such that rear end 1404 of the crossbow is positioned above the fore end 1402. In such circumstances, the limbs 1410 of the crossbow 1400 may tend to rotate to at least some extent generally outwardly (e.g., to at least some extent in response to the force of gravity, and/or by the user pushing or pulling on the limbs 1410 as necessary) about the hinges 1422. In such circumstances, the limb 1410 shown in FIG. 8 may tend to rotate (e.g., along with the limb receiving element 1426) generally downward as indicated at 1804, thereby 'opening up' with respect to the stock 1408. In like fashion, the stud 1500 of the respective reaction element 1432 of the limb receiving element 1426 may tend to rotate generally inward and/or upward as indicated at 1806, bringing the stud 1500 beneath (e.g., vertically aligned with) the finger 1436.

At this point, that fraction or portion of the rotational throw of the limb receiving element 1426 (and thus of the limb 1410) relative to the stock 1408 which is possible to achieve solely via the downward-pulling force of gravity may be complete. In such circumstances, the crossbow 1400 may exhibit a configuration in which whatever slack may have previously existed in the associated bowstring is now gone, and substantial force must now be applied to the limbs 1410 in order to cause the crossbow to complete the preload by transitioning into the shooting configuration shown in FIG. 4.

Referring specifically to FIG. 8, each limb receiving element 1426 may further include a rotational stop 1808 exhibiting a surface 1810, and the support brace 1424 may further include a corresponding pair of respective stops 1812 exhibiting corresponding surfaces 1814. In accordance with embodiments of the present disclosure, only when the surfaces 1810 of the rotational stops 1808 have been rotated into contact with the corresponding surfaces 1814 of the stops 1812, will the crossbow 1400 have been placed in the shooting configuration shown and described with respect to FIG. 4.

Figure 9:
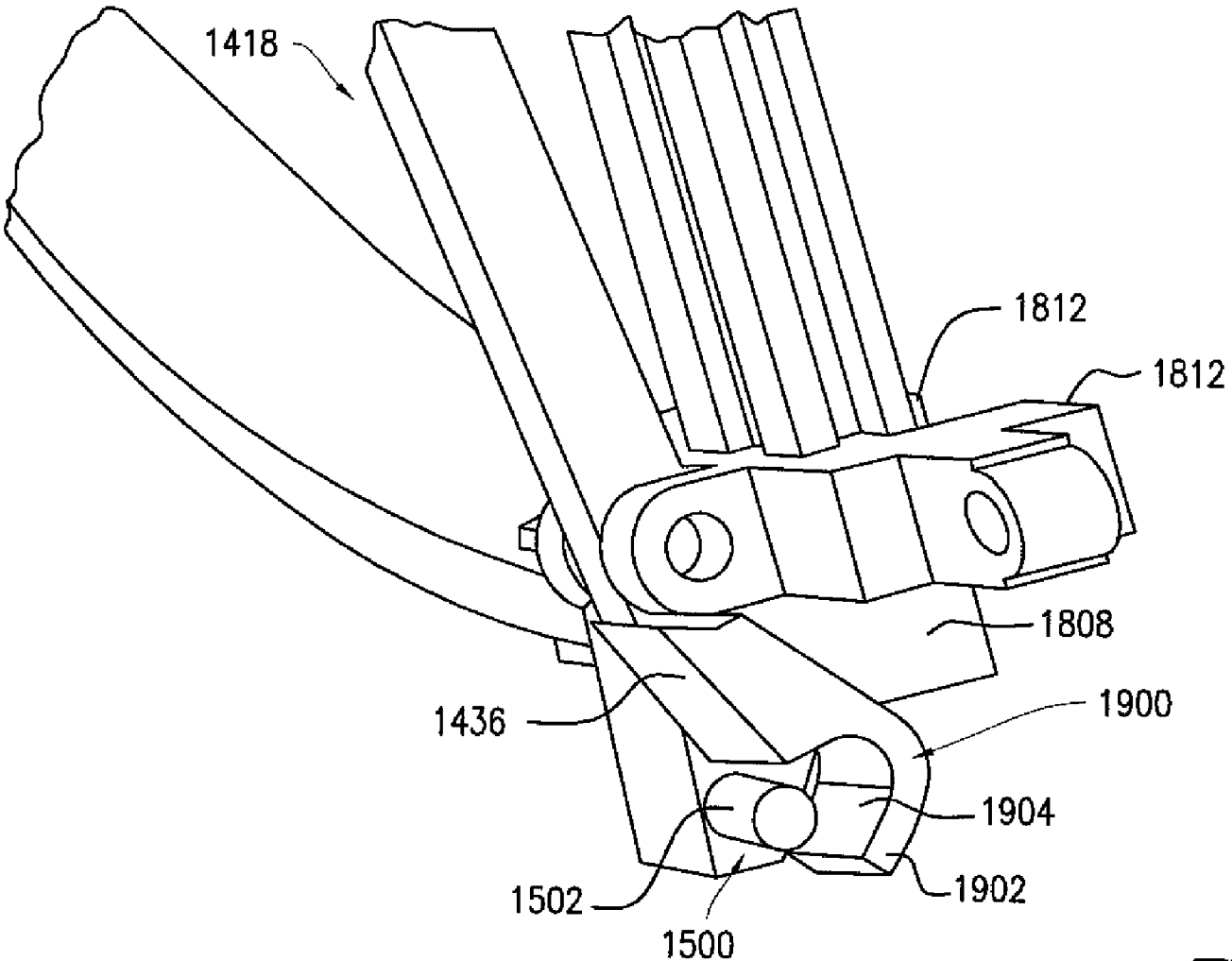

Turning now to FIG. 9, the finger 1436 may further include a latch 1900 for capturing the stud 1500 upon the latter being rotated to a sufficient extent about the hinge 1422 (FIG. 4) to bring the stud 1500 beneath the finger 1436. More particularly, in accordance with embodiments of the present disclosure, the latch 1900 may include a cam 1902 having a reaction surface 1904 sized, shaped and/or configured (e.g., describing an appropriately radiused slope) so as to cooperate with respect to the reaction surface 1502 of the stud 1500. Such cooperation between the reaction surfaces 1904, 1502 may permit the cam 1902 to engage in such force-transmitting contact and/or other interaction (e.g., sliding contact) with the stud 1500 as may be necessary to urge the stud 1500 into further rotation about the hinge 1422 (FIG. 4) sufficient to cause the surfaces 1810 (FIG. 8) of the rotational stops 1808 to contact and/or locate with respect to the corresponding surfaces 1814 (FIG. 8) of the stops 1812.

Figure 10:
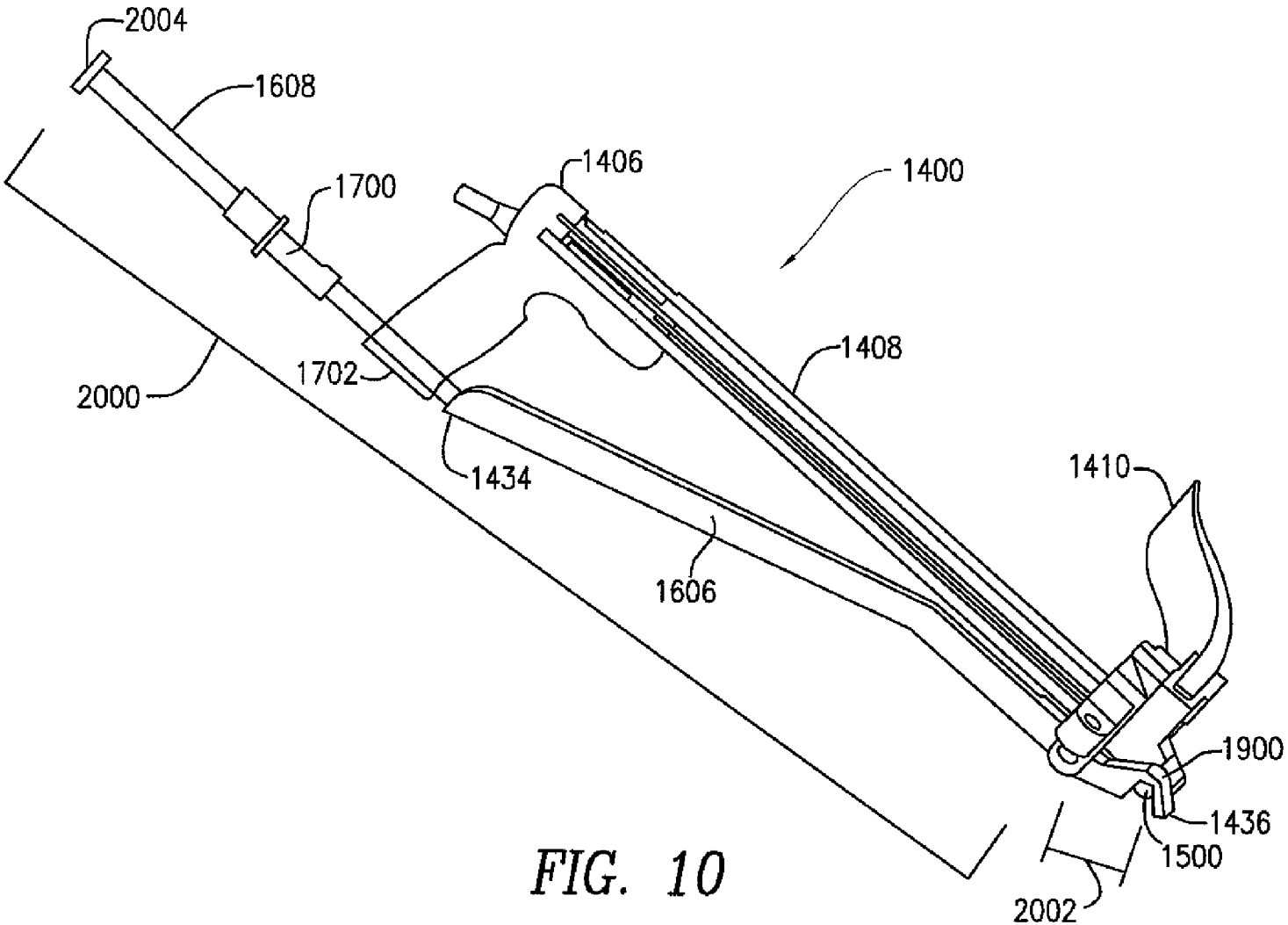

In accordance with embodiments of the present disclosure, the user may employ the limb actuator 1418 to bring about such further rotation of the stud 1500 about the hinge 1422 (FIGS. 4 and 8) as will be sufficient to produce locating contact between the respective locating surfaces 1810, 1814 (FIG. 8). More particularly, and as best shown in FIG. 10, in a long side 2000 of the arm 1434, the length of which is an additive function of respective lengths of the first and second elongated portions 1606, 1608 of the arm 1434, the user has at their disposal significant mechanical advantage relative to a short side 2002 of the arm 1434, the length of which consists substantially solely of a respective length of the finger 1436 (adjusted to whatever slight extent may be necessary at any given time to account for the camming interaction between the latch 1900 of the finger 1436 and the stud 1500 of the reaction element 1432). Accordingly, in order to transition the crossbow 1400 from the partially assembled configuration shown in FIG. 8 to the shooting configuration thereof shown in FIGS. 4 and 10, the user may grasp and pull upward on an end portion 2004 of the arm 1434 to and until the second elongated portion 1608 of the arm 1434 enters the pocket 1702 formed in the gripper 1406. In so doing, the user may employ the above-described mechanical advantage provided by the arm 1434 to urge the posts 1500 inward and upward sufficiently so as to produce the desired locating contact between the respective locating surfaces 1810, 1814 (FIG. 8), thereby placing the limbs 1410 in the precise position they must assume relative to the stock 1408 to permit firing operation of the crossbow 1400.

In accordance with embodiments of the present disclosure, the crossbow 1400 may be configured such that, upon the above-discussed locating contact being achieved between the respective locating surfaces 1810, 1814 (FIG. 8), the second elongated portion 1608 of the arm 1434 will be disposed within the pocket 1702 formed in the gripper 1406. Accordingly, in order to lock the limbs 1410 in place relative to the stock 1408 with the crossbow 1400 in the shooting configuration shown and described above with respect to FIGS. 4 and 10, the user may slide the locking element 1700 along the second elongated portion 1608 of the arm 1434 and into the pocket 1702. To the extent the material of the gripper 1406 includes a sufficient overlap with the locking element 1700, such overlap, combined with tension created in the arm 1434 (e.g., by the preloaded limbs 1410) and/or such frictional forces as may predictably arise from such tension, will securely and rigidly lock the arm 1434 in place relative to the gripper 1406 as against unintentional and/or unplanned disassembly of the crossbow 1400 prior to or during the use of same during the hunt.

Figure 11:
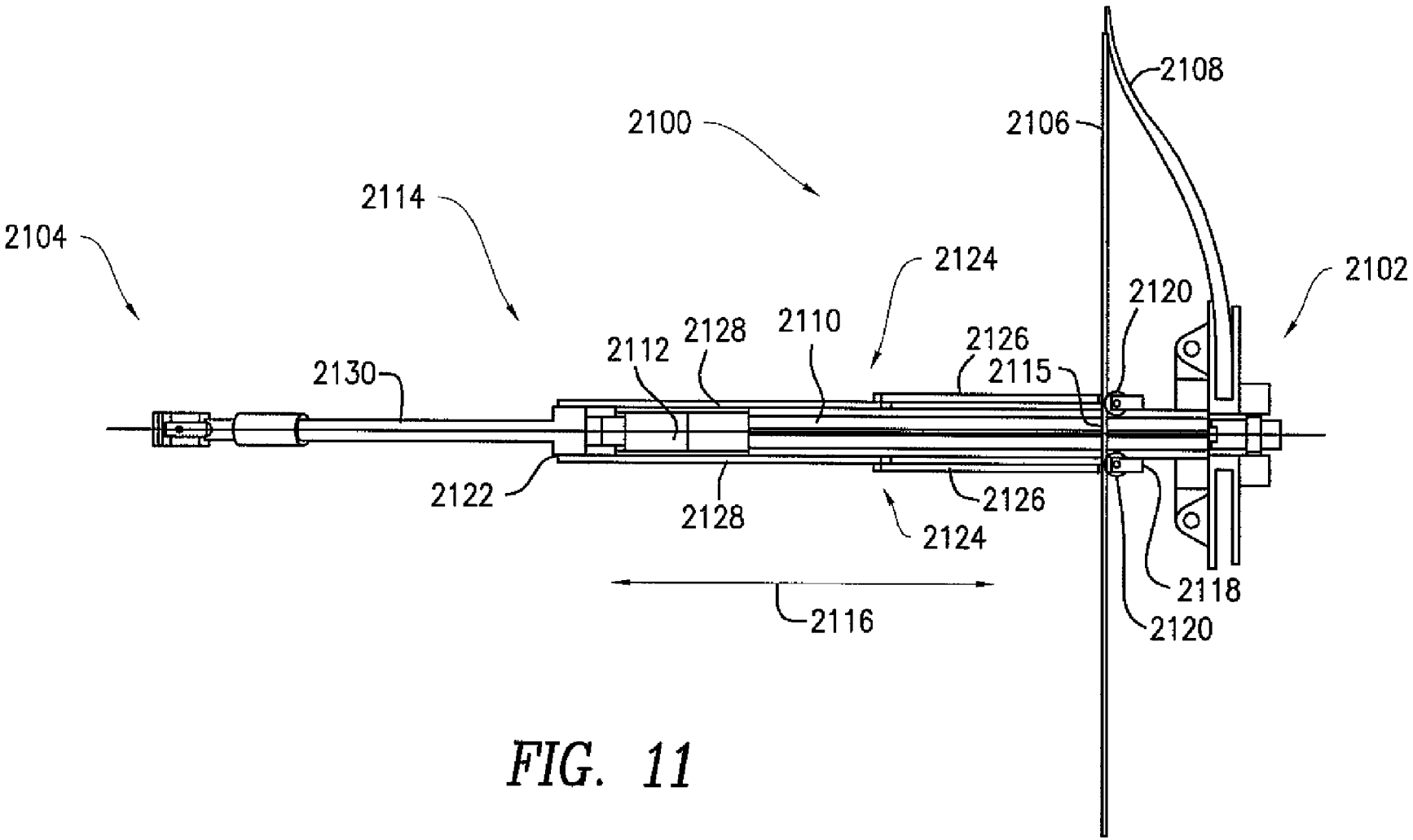
FIGS. 11-19 illustrate a crossbow in accordance with the present disclosure including a crossbow cocking mechanism.
Figure 12:
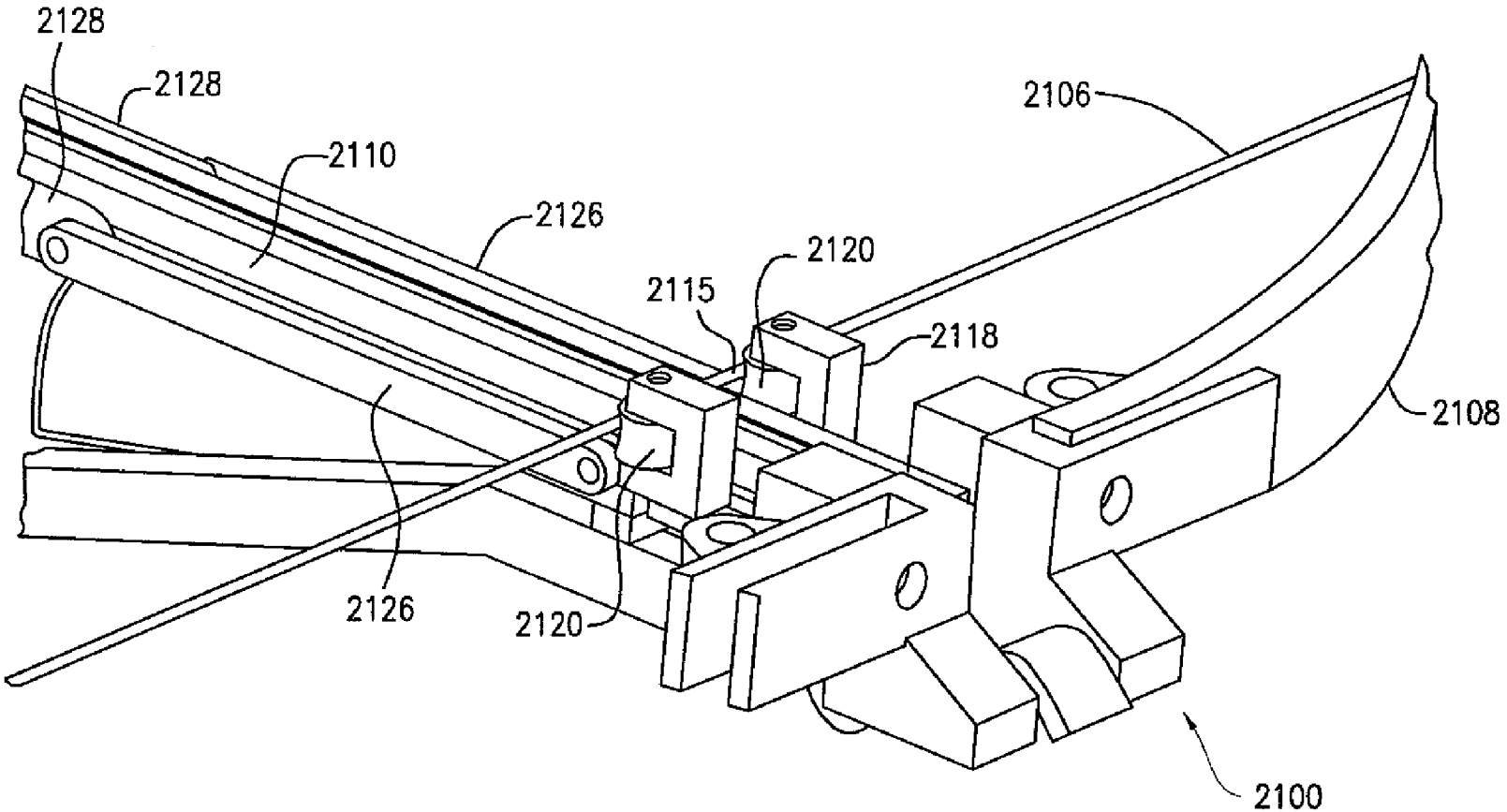

Turning now to FIGS. 11 and 12, a crossbow 2100 in accordance with embodiments of the present disclosure is shown. The crossbow 2100 may be similar in at least most, if not all, important respects to the crossbow 1400 shown and described above with reference to FIGS. 4-10. The crossbow 2100 may further include differences, and/or additional structure, and/or additional functions, at least some of which may be described below, as compared to the crossbow 1400 shown and described above with reference to FIGS. 4-10.

The crossbow 2100 may include a fore end 2102, a rear end 2104, a bowstring 2106, limbs 2108, a stock 2110, a trigger mechanism 2112, and a cocking mechanism 2114. In accordance with embodiments of the present disclosure, the cocking mechanism 2114 may be used to engage a central portion 2115 of the bowstring 2106 (e.g., that portion of the bowstring 2106 which is located substantially at a midpoint thereof), and to keep the central portion 2115 aligned with a longitudinal axis of the stock 2110 while simultaneously moving the central portion 2115 rearward relative to the stock 2110 along a direction shown at 2116, eventually causing the bowstring 2106 to engage with the trigger mechanism 2112 at the central portion 2115. This same action of the cocking mechanism 2114 with respect to the central portion 2115 of the bowstring 2106 may further serve to ensure that the limbs 2108 are stretched substantially equally. The cocking mechanism 2114 may include a slider 2118, wherein the slider 2118 may be translatably mounted on the stock 2110 for longitudinal movement with respect thereto along the direction shown at 2116, and a pair of rollers 2120 for rotatably contacting the central portion 2115 of the bowstring 2106. The cocking mechanism 2114 may also include a linkage 2122 for actuating the slider 2118. The linkage 2122 may include respective collapsible link pairs 2124, wherein each collapsible link pair 2124 may include a fore link 2126 and a rear link 2128, and a barrel 2130 for reversibly collapsing the collapsible link pairs 2124 as described in greater detail below.

Figure 13:
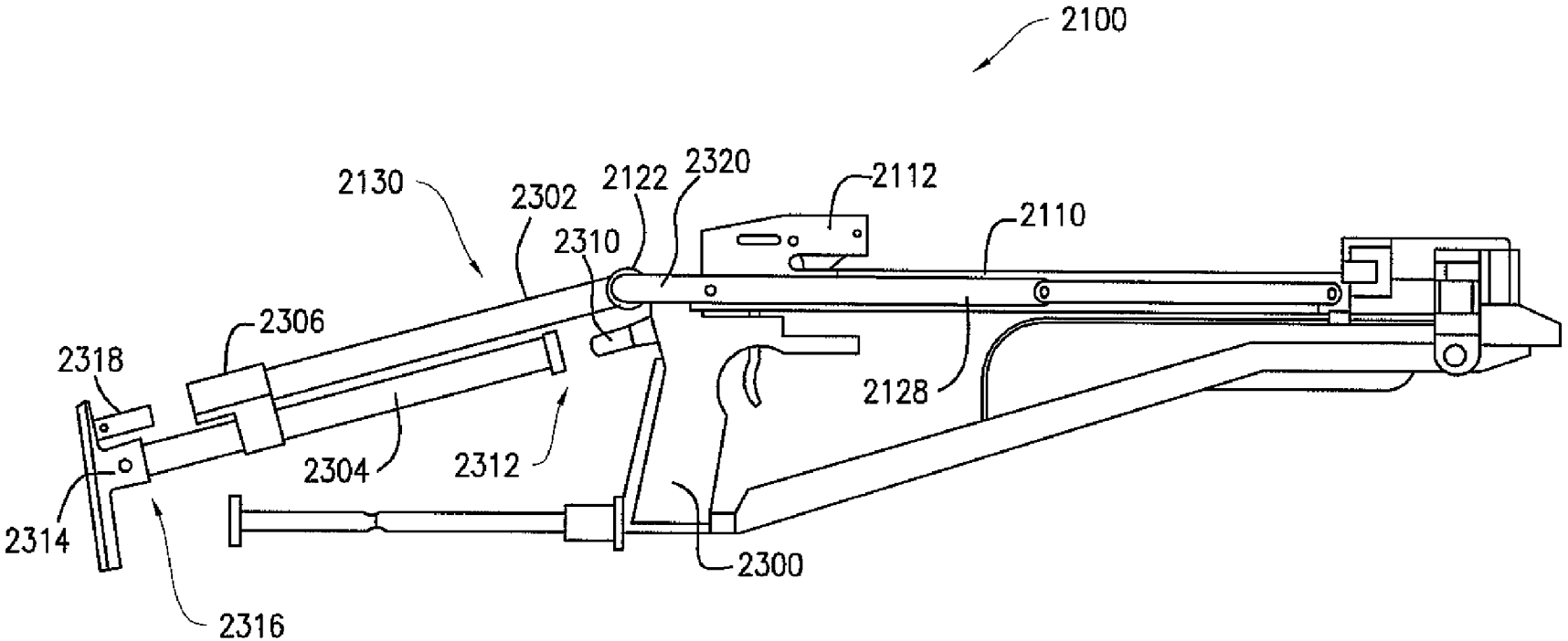
Figure 14:
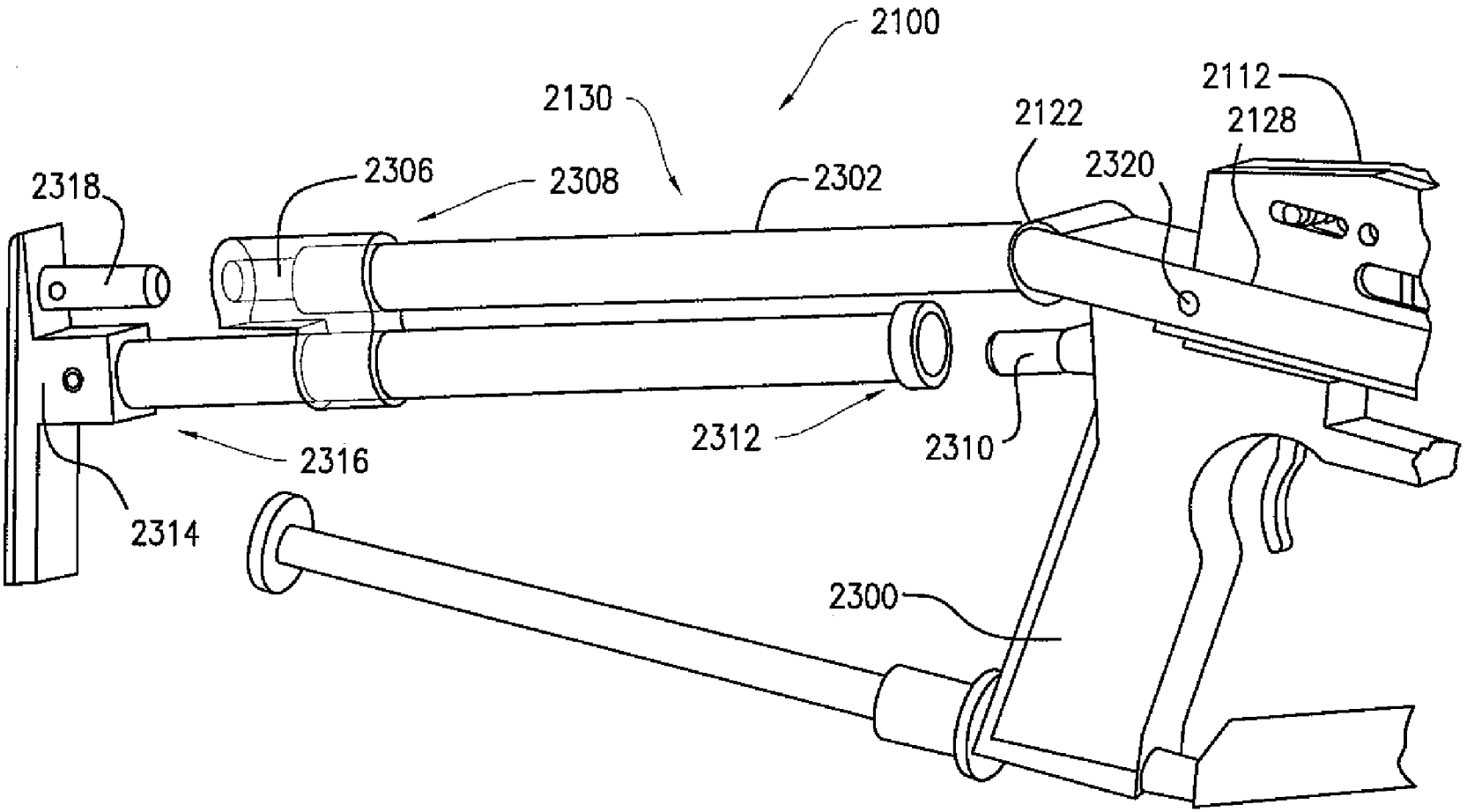
Figure 15:
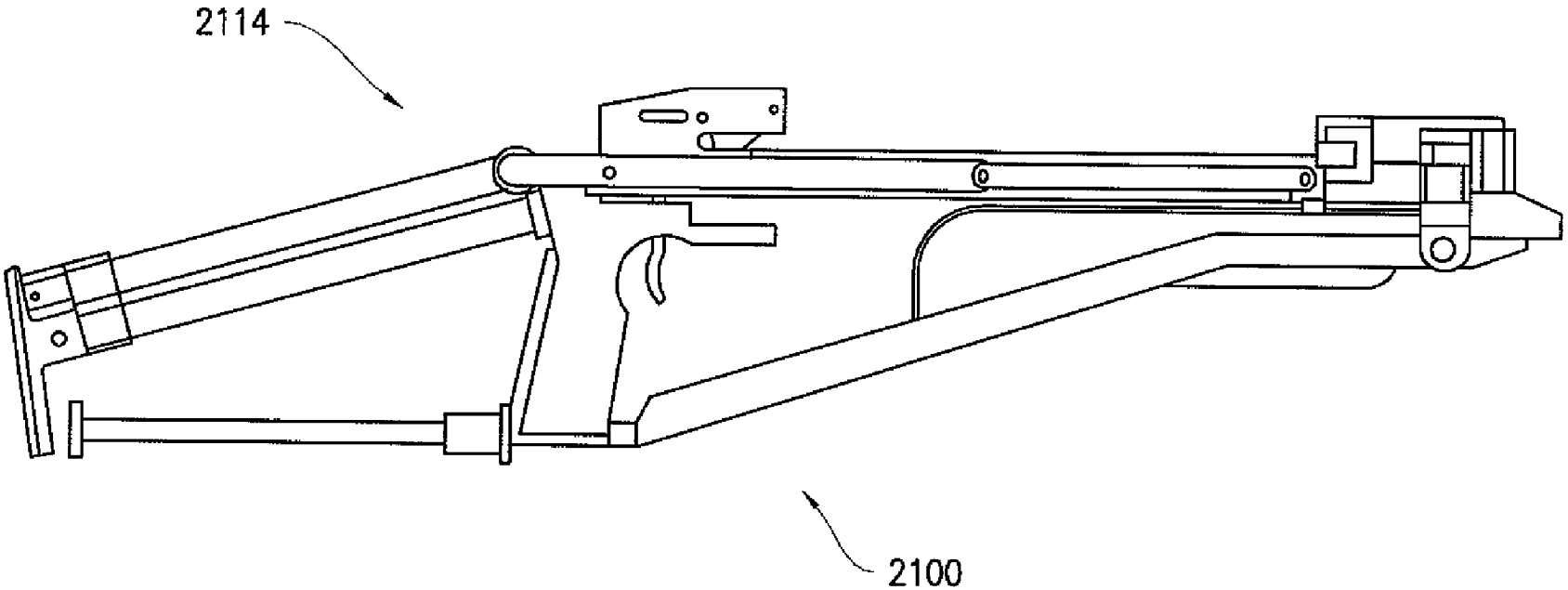

As shown in FIGS. 13-14, the crossbow 2100 may include a gripper 2300 extending downward from the stock 2110, wherein the trigger mechanism 2112 may be mounted to the stock 2110 in a vicinity of the gripper 2300. The barrel 2130 of the linkage 2122 may be retractably telescopic. More particularly, the barrel 2130 may include a fore extent 2302, and a rear extent 2304 slidably coupled to the fore extent 2302 so as to permit the barrel 2130 to be selectably extended and/or retracted as necessary, and/or as desired. The barrel 2130 may further include a gland 2306, wherein the gland 2306 may be mounted with respect to a rear end 2308 of the fore extent 2302, and wherein the structure and/or function of the gland 2306 may be described in greater detail below.

The crossbow 2100 may further include a pin 2310, wherein the pin 2310 may be mounted with respect to the gripper 2300 so as to permit a fore end 2312 of the rear extent 2304 to locate with respect to the gripper 2300 as described in greater detail below. The crossbow may still further include a shoulder rest 2314 coupled to a rear end 2316 of the rear extent 2304, and a plunger 2318, wherein the plunger 2318 may be mounted with respect to the shoulder rest 2314 so as to permit the gland 2306 to locate with respect to the shoulder rest 2314 as described in greater detail below. The rear links 2128 of the linkage 2122 may be movably coupled to the gripper 2300 at a pivot 2320 so as to permit the rear links 2128 to be urged into rotation with respect to the gripper 2300 and the stock 2110. In turn, the fore extent 2302 of the barrel 2130 may be coupled to (e.g., affixed to, so as to limit a rotational motion with respect to) each of the rear links 2128 to permit the barrel 2130 to be used to so urge the rear links 2128 into rotation with respect to the gripper 2300 and the stock 2110.

Figure 16:
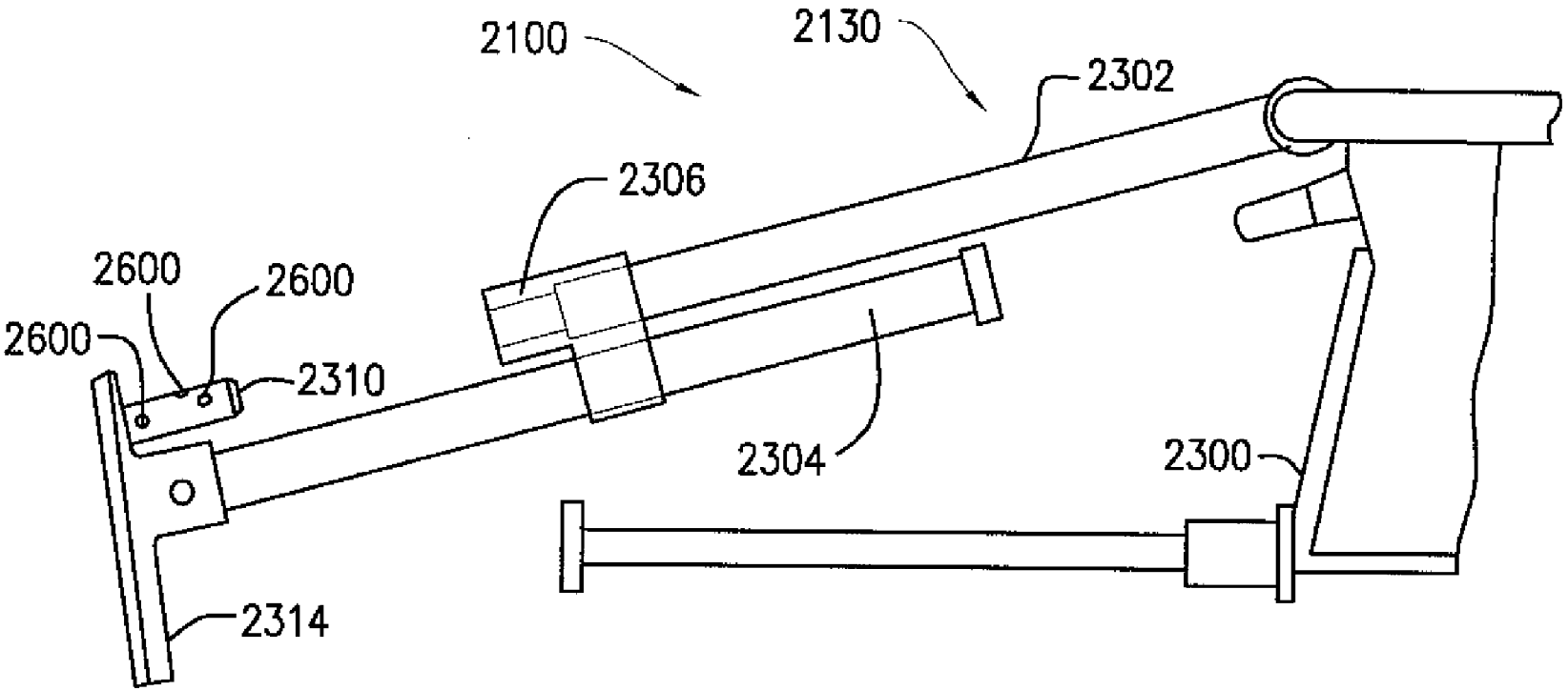
Figure 17:
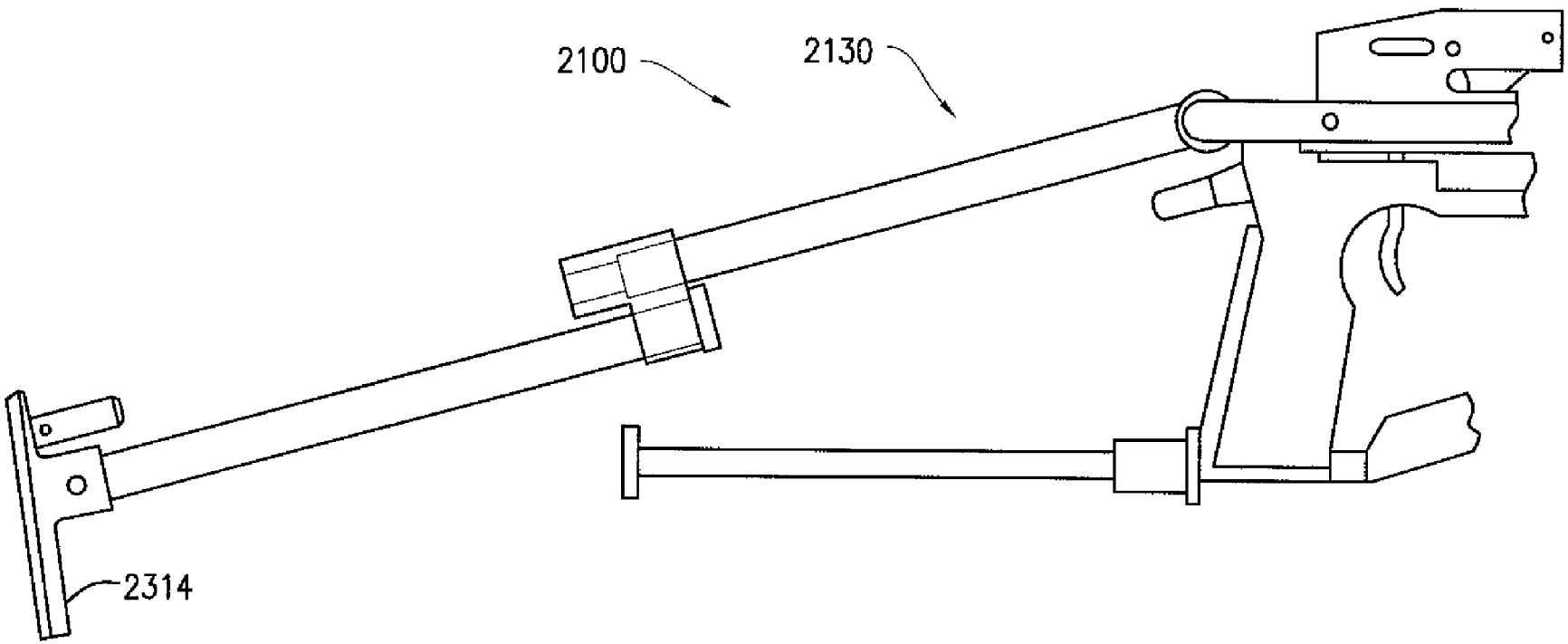

Referring now to the views of the crossbow 2100 shown in FIGS. 15-18, FIG. 15 shows an initial position of the cocking mechanism 2114. Referring now to FIG. 16, with one hand on the gripper 2300 and the other hand on a lower portion of the shoulder rest 2314, a user may begin to pull the shoulder rest 2314 rearwardly. As shown in FIG. 16, the plunger 2310 may include ball locks 2600 for interacting with corresponding structure and/or features (not separately shown) within the gland 2306. After the force applied by the user overcomes the initial resistance of the ball locks 2600, the plunger 2310 may be set free from the gland 2306, and the fore and rear extents 2302, 2304 of the barrel 2130 are permitted to move relative to each other. As shown in FIGS. 16-17, the user may continue to pull the shoulder rest 2314 rearward, causing the barrel 2130 to become fully extended ('telescoped').

Figure 18:
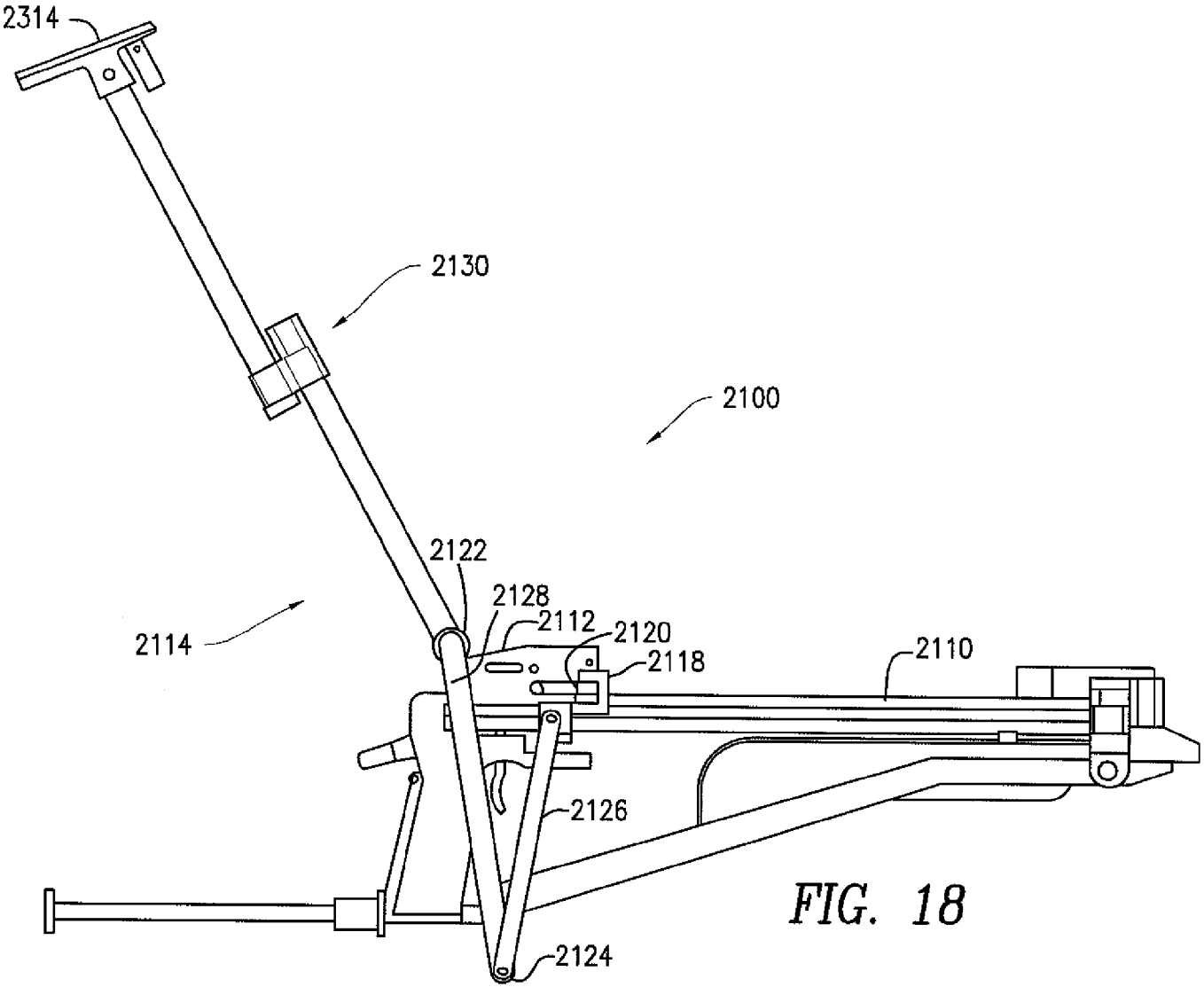

Referring now to FIG. 18, the user may now move the shoulder rest 2314 upward, lowering respective ends of the rear links 2128 and the fore links 2126 at which the same may be rotatably coupled to each other, and pulling the slider 2118 rearward along the stock 2110 via respective ends of the fore links 2126 coupled to the slider 2118. The rollers 2120 may ensure that the central portion 2115 of the bowstring 2106 (FIG. 11) is substantially always positioned at a center region of the crossbow 2100 above the stock 2110. As shown in FIG. 18, the cocking mechanism 2114 may be employed to fully cock the crossbow 2100, wherein the bowstring 2106 (FIG. 11) may now be fully engaged with the trigger mechanism 2112. In this manner, the barrel 2130 of the linkage 2122 may be utilized in conjunction with the rear links 2128 of the collapsible link pairs 2124 in an extended and/or telescoped configuration to offer a substantial amount of leverage, thereby permitting a user to use substantially less force to cock the crossbow 2100, and/or to cock the crossbow 2100 more quickly, than is typically the case with respect to traditional cocking processes. After the crossbow 2100 is cocked, the user may move the shoulder rest 2314 downward and the barrel 2130 may be collapsed.

Figure 19:
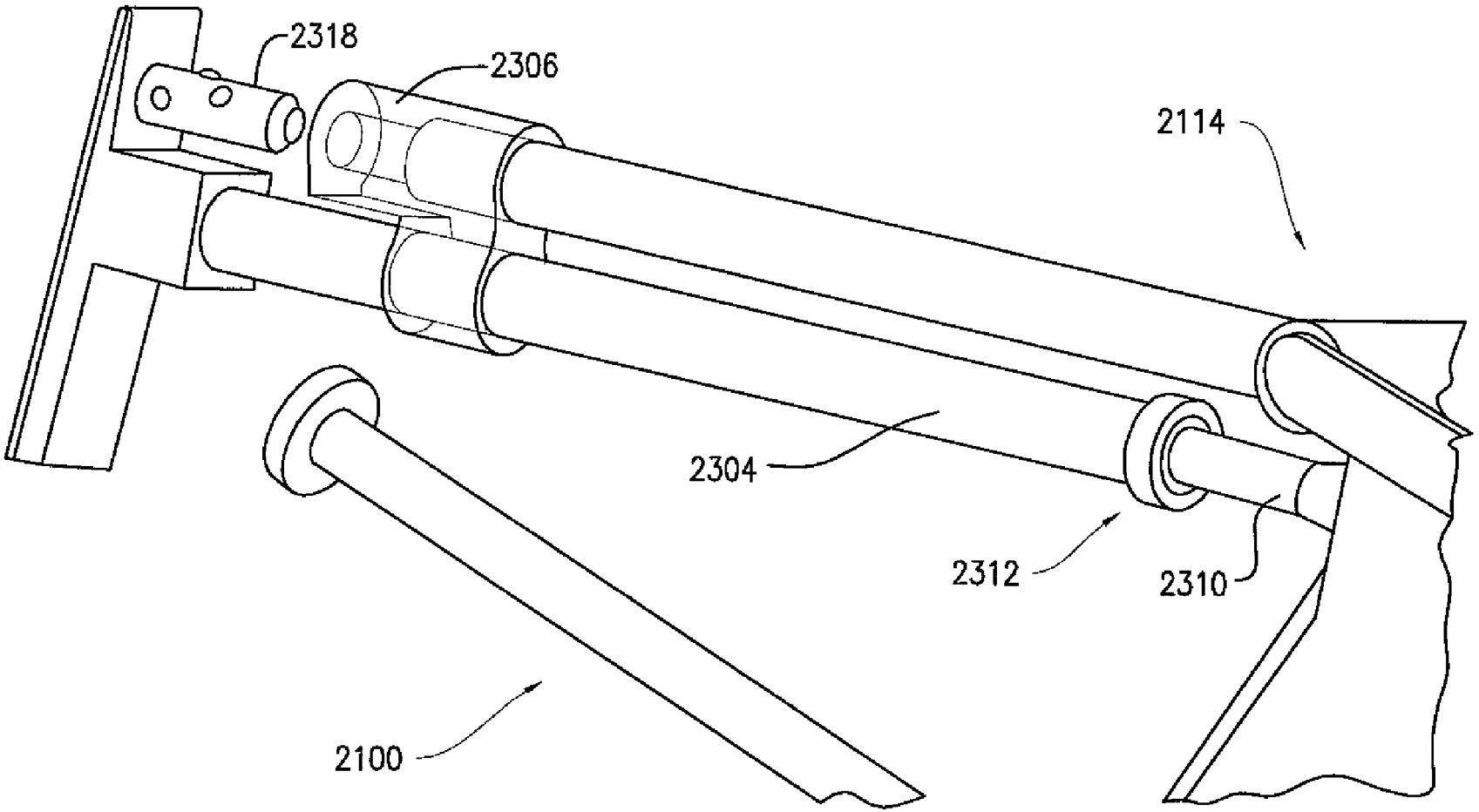

Referring now to FIG. 19, the user may lock the cocking mechanism 2114. More particularly, the fore end 2312 of the rear extent 2304, which may include a tapered hole (obscured), may engage the pin 2310, and the plunger 2318 may engage the gland 2306. The tapered hole formed in the fore end 2312 may allow engagement of the fore end 2312 with the pin 2310 to occur relatively quickly and easily, and in the fully locked position, and a corresponding geometry (e.g., a tapered geometry) of the pin 2310 may serve to locate the rear extent 2304 accurately. Additionally, the plunger 2318 may lock in place within the gland 2306, affording the overall mechanism an effective combination of rigidity, sturdiness, and accurate positioning.

As shown in FIGS. 11-19, the cocking mechanism 2114 may be a built-in cocking device which forms a rear end of the crossbow 2100. The rollers 2120 on the slider 2118 may keep a midpoint of the bowstring 2106 in the center of the crossbow 2100. Such a cocking mechanism 2114 may further be quick and easy to operate, and require less force from the user, at least in part due to the barrel 2130 being extensible or telescopic. By the use of the cocking mechanism 2114, a user may cock the crossbow 2100 substantially anywhere, such that the cocking mechanism 2114 may accurately be described as a "use-it-in-place" device. In addition, and/or alternatively, the cocking mechanism 2114 may be configured so as to permit a user to cock the crossbow 2100 using a traditional (e.g., manual) method, when desired or when necessary.

Figure 20:
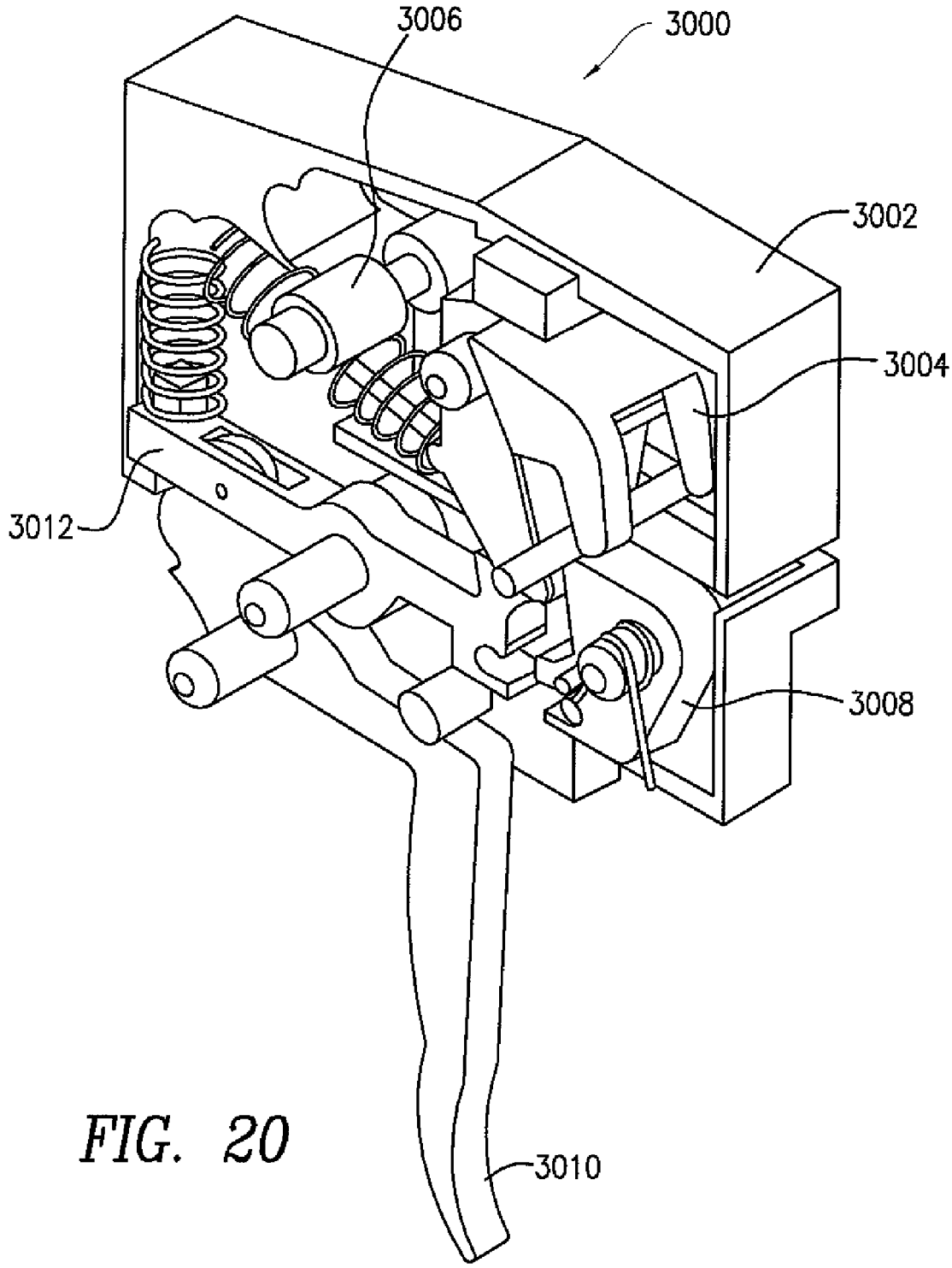
FIGS. 20-35 illustrate a crossbow trigger mechanism in accordance with the present disclosure.

Turning now to FIG. 20, a trigger mechanism 3000 in accordance with the present disclosure is shown. The trigger mechanism 3000 may include a housing 3002, wherein a portion (not shown) of the housing 3002 is not shown, having been omitted in FIG. 20 for purposes of clarity and/or to show an internal construction of the trigger mechanism 3000. As shown in FIG. 20, the trigger mechanism 3000 may include a string catch 3004, a lock 3006, a dry fire stop 3008, a cam trigger 3010, and an intermediate trigger 3012.

Figure 21:
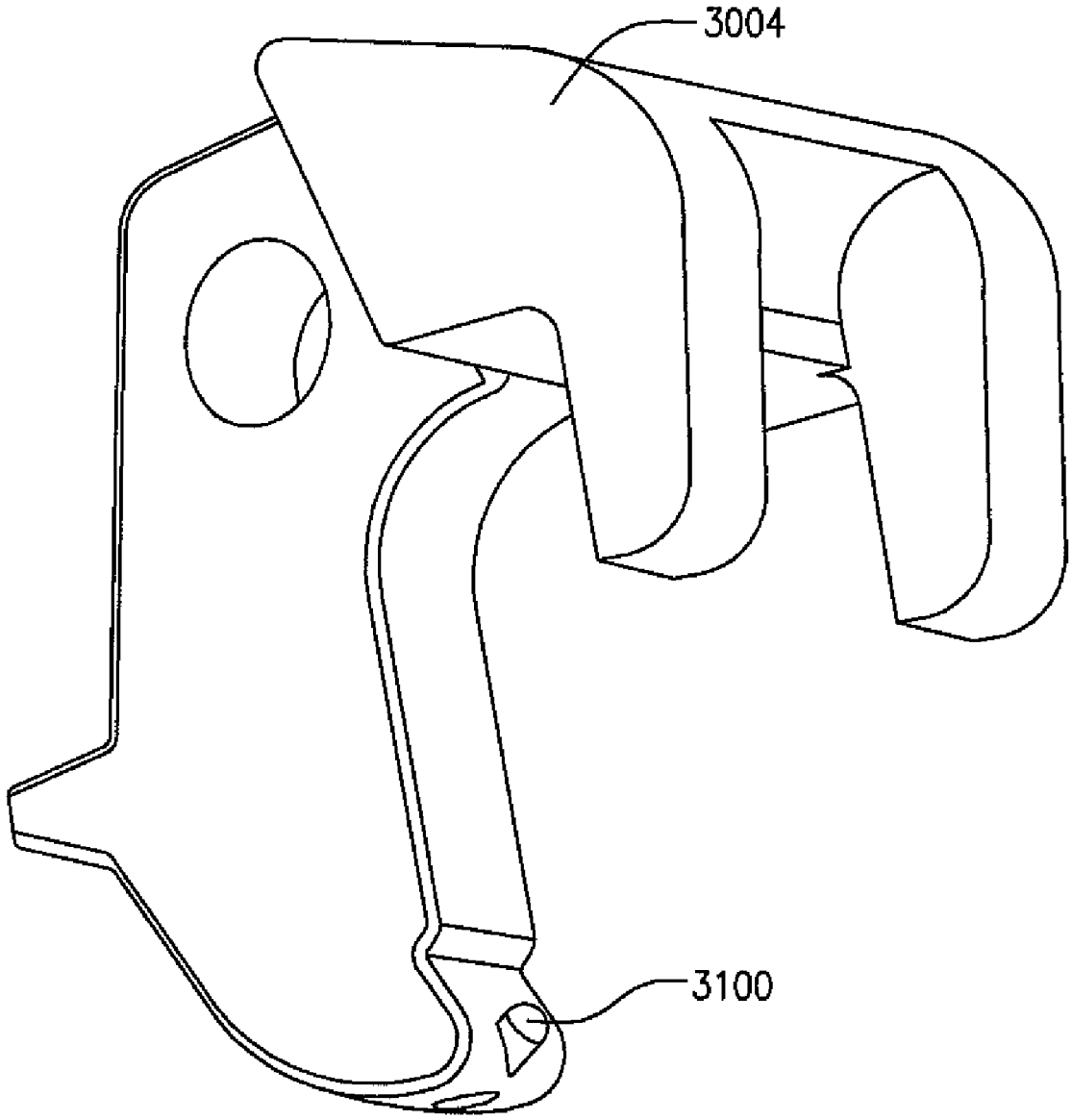

As shown in FIG. 21, the string catch 3004 may include a ball 3100 for contacting a corresponding surface of the intermediate trigger 3012. The structure and function of the string catch 3004 and the ball 3100 thereof are described in greater detail below.

Referring now to the views of the trigger mechanism 3000 shown in FIGS. 22-34, FIG. 22 shows a bowstring 3200 passing into the trigger mechanism 3000 and approaching the string catch 3004. As the bowstring 3200 is further pulled rearward (e.g., leftward) in FIG. 23, it may force the string catch 3004 to rotate in the clockwise direction. A front end of the lock 3006 may move toward the rear (e.g., to the left) to disengage the dry fire stop 3008. A bottom portion of the string catch 3004 may push the intermediate trigger 3012 downwards. A spring 3300 may be associated with a rear end of the intermediate trigger 3012 and may maintain contact between the intermediate trigger 3012 and the string catch 3004.

Figure 24:
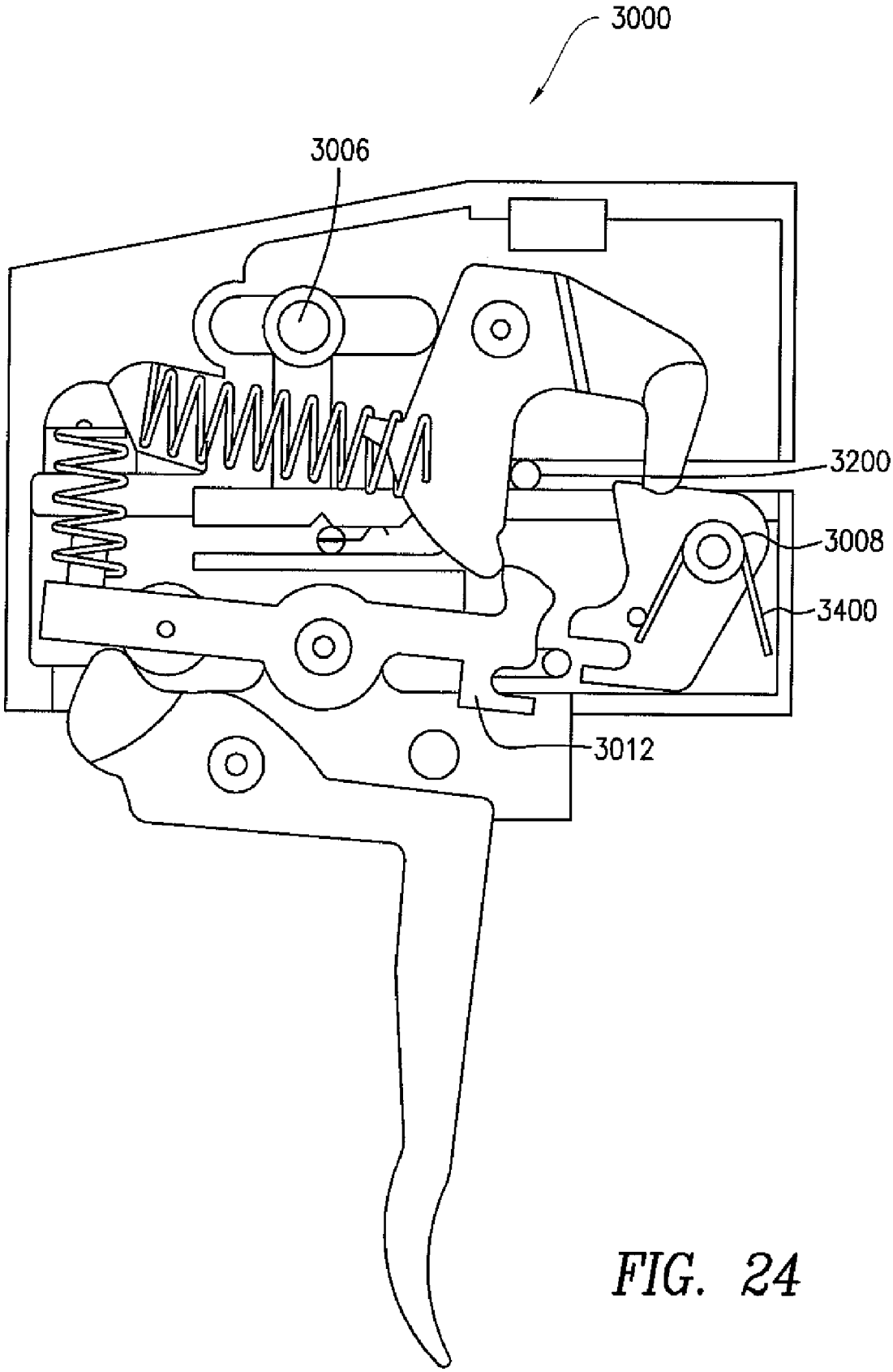

The bowstring 3200 may be pulled further rearward as in FIG. 24, which may cause the front end of the lock 3006 to completely disengage the dry fire stop 3008. A spring 3400 may be associated with the dry fire stop 3008, and may force the dry fire stop 3008 to move in the clockwise direction.

Figure 25:
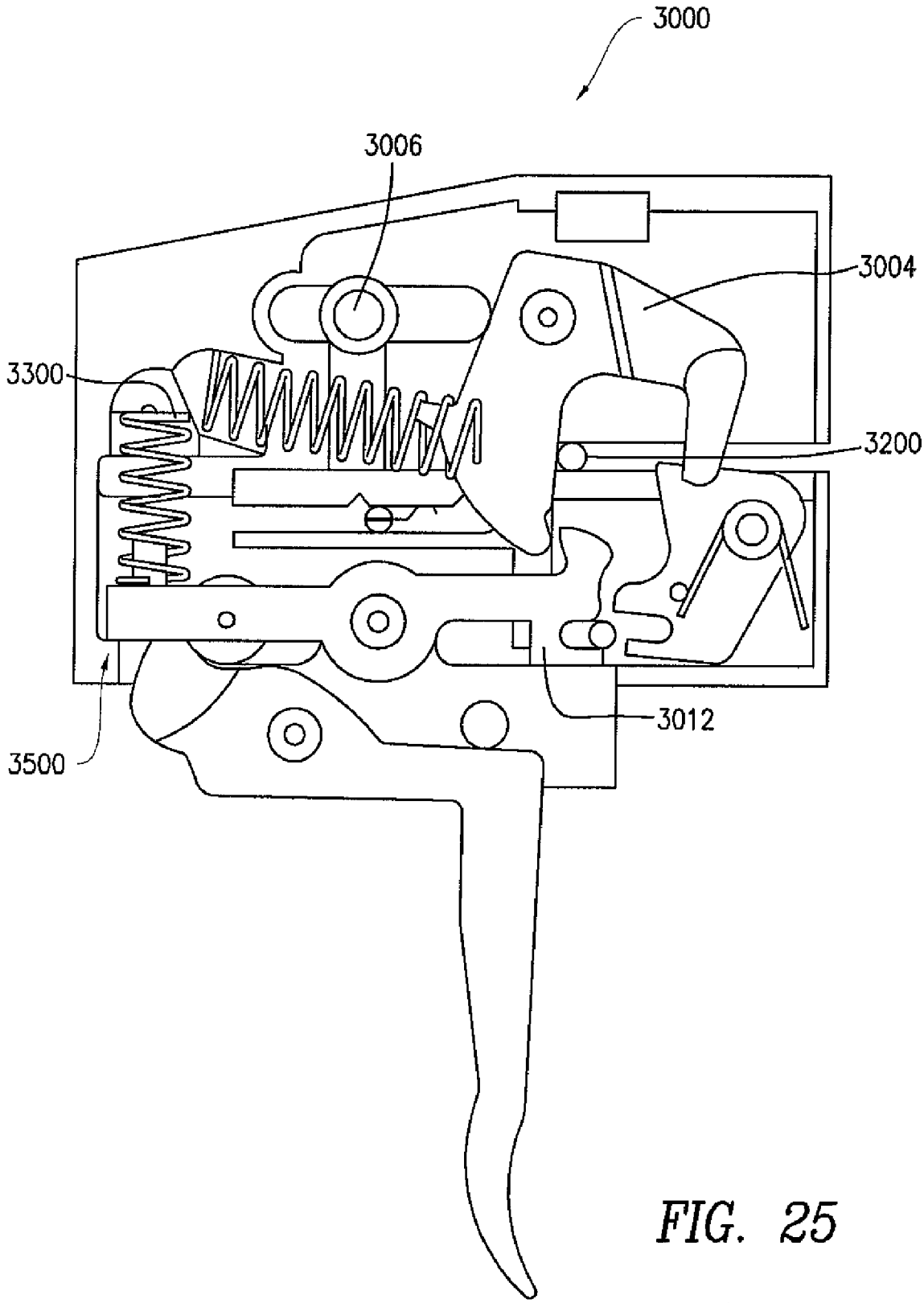

Upon further rearward pulling of the bowstring 3200 as in FIG. 25, the bottom portion of the string catch 3004 may move beyond contact with a front end of the intermediate trigger 3012. The spring 3300 may force the rear end of the intermediate trigger 3012 to move in the counter clockwise direction. Such counter clockwise movement of the intermediate trigger 3012 may be stopped when the rear portion of the intermediate trigger 3012 engages with the housing 3002 as indicated at 3500. The front end of the lock 3006 may now begin to engage a front end of the intermediate trigger 3012.

Figure 26:
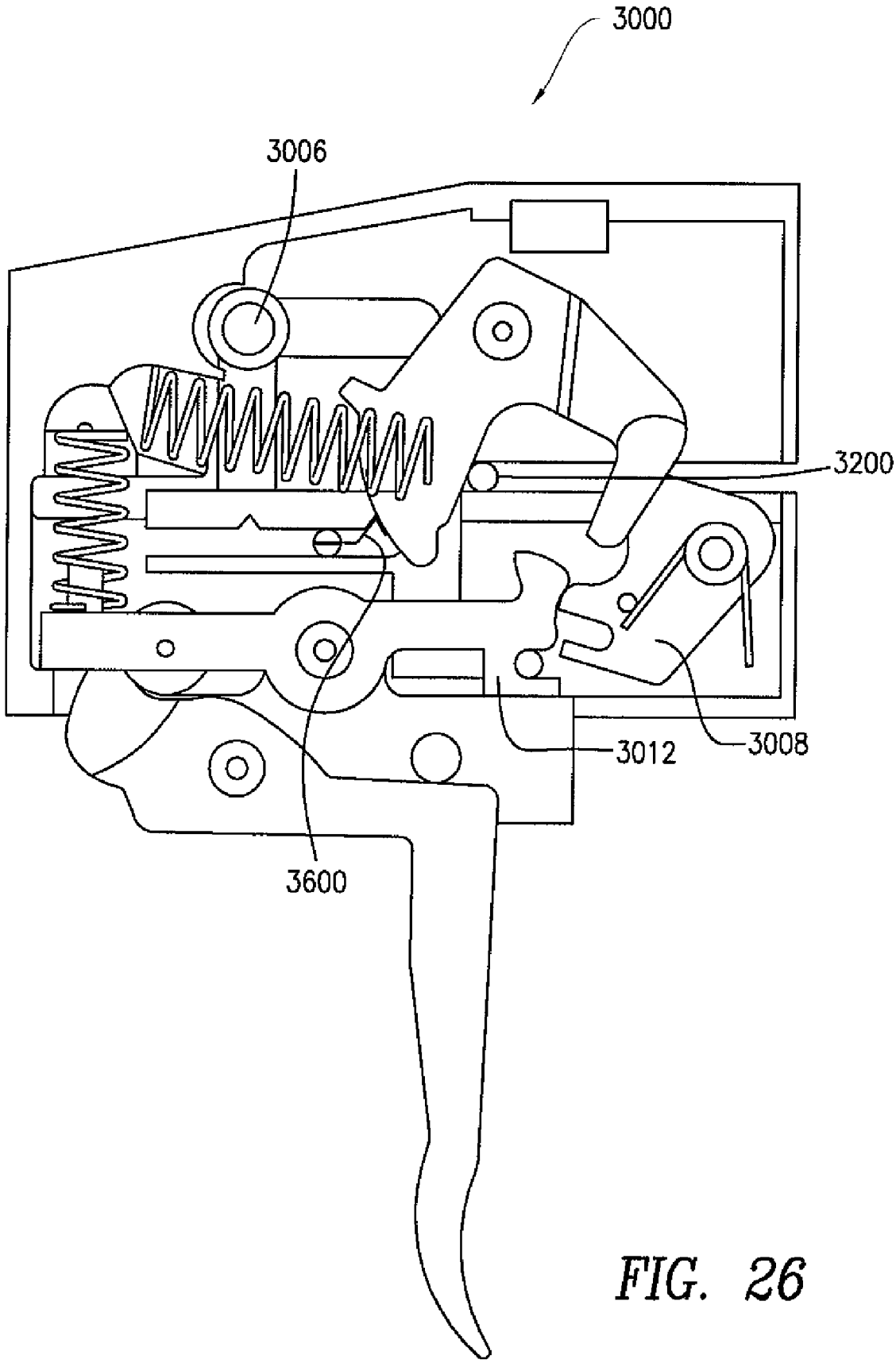

FIG. 26 shows wherein the bowstring 3200 may be pulled far enough rearward to: 1) complete a release of the dry fire stop 3008 such that the dry fire stop 3008 may be activated to prevent any dry fire, and/or 2) cause the intermediate trigger 3012 to be locked by the lock 3006. A lock retainer 3600 may keep the lock 3006 in the current position relative to the intermediate trigger 3012 such that an upright movement or rotation of the crossbow may not tend to move the lock 3006 from such position.

Figure 27:
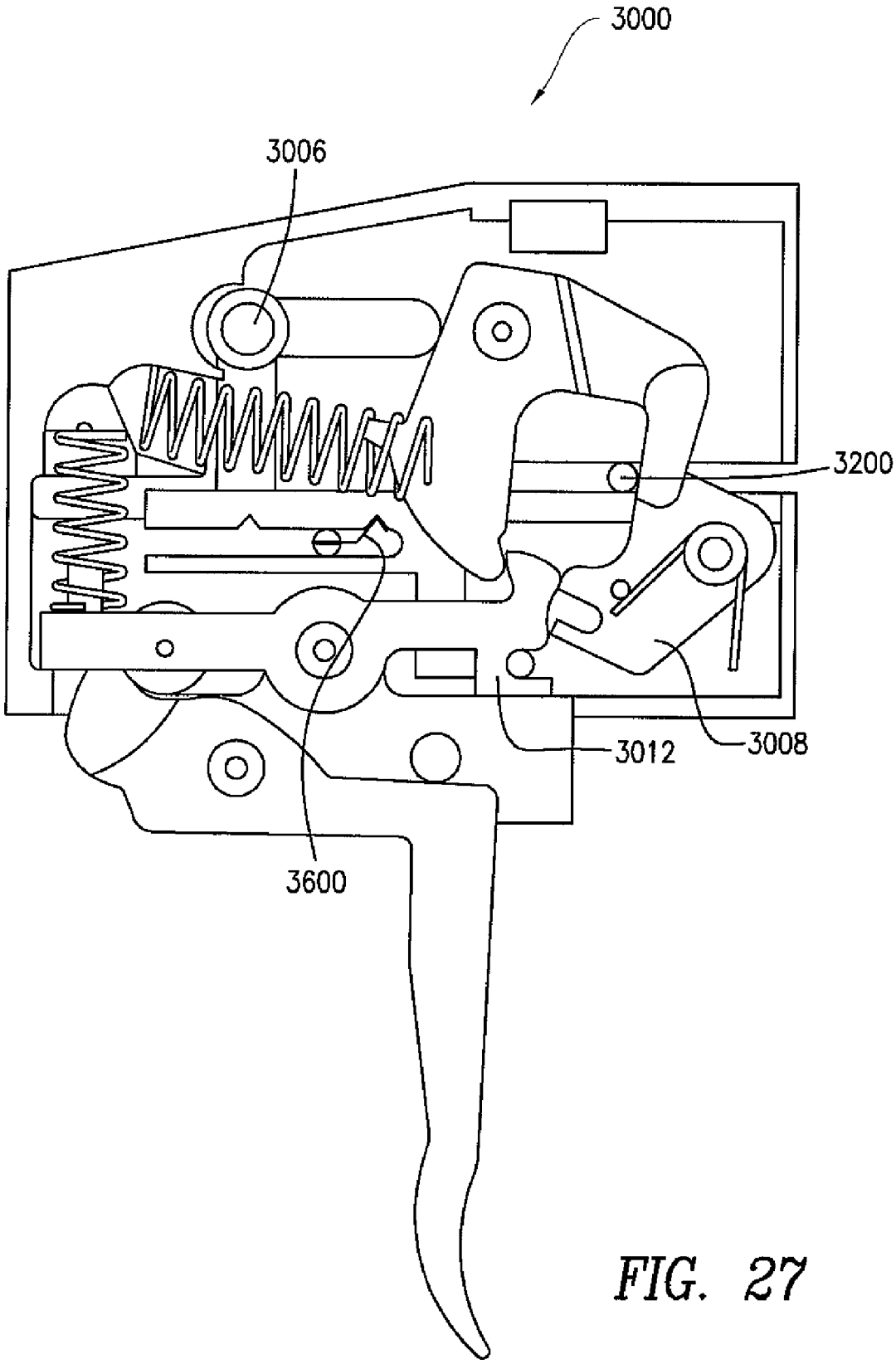

As shown in FIG. 27, the bowstring 3200 may now be released, and the intermediate trigger 3012 may be fully cocked. In this position, the trigger mechanism 3000 may be locked. Moreover, in the event of any accident, the dry fire stop 3008 may prevent the bowstring 3200 from leaving the trigger mechanism 3000.

Figure 28:
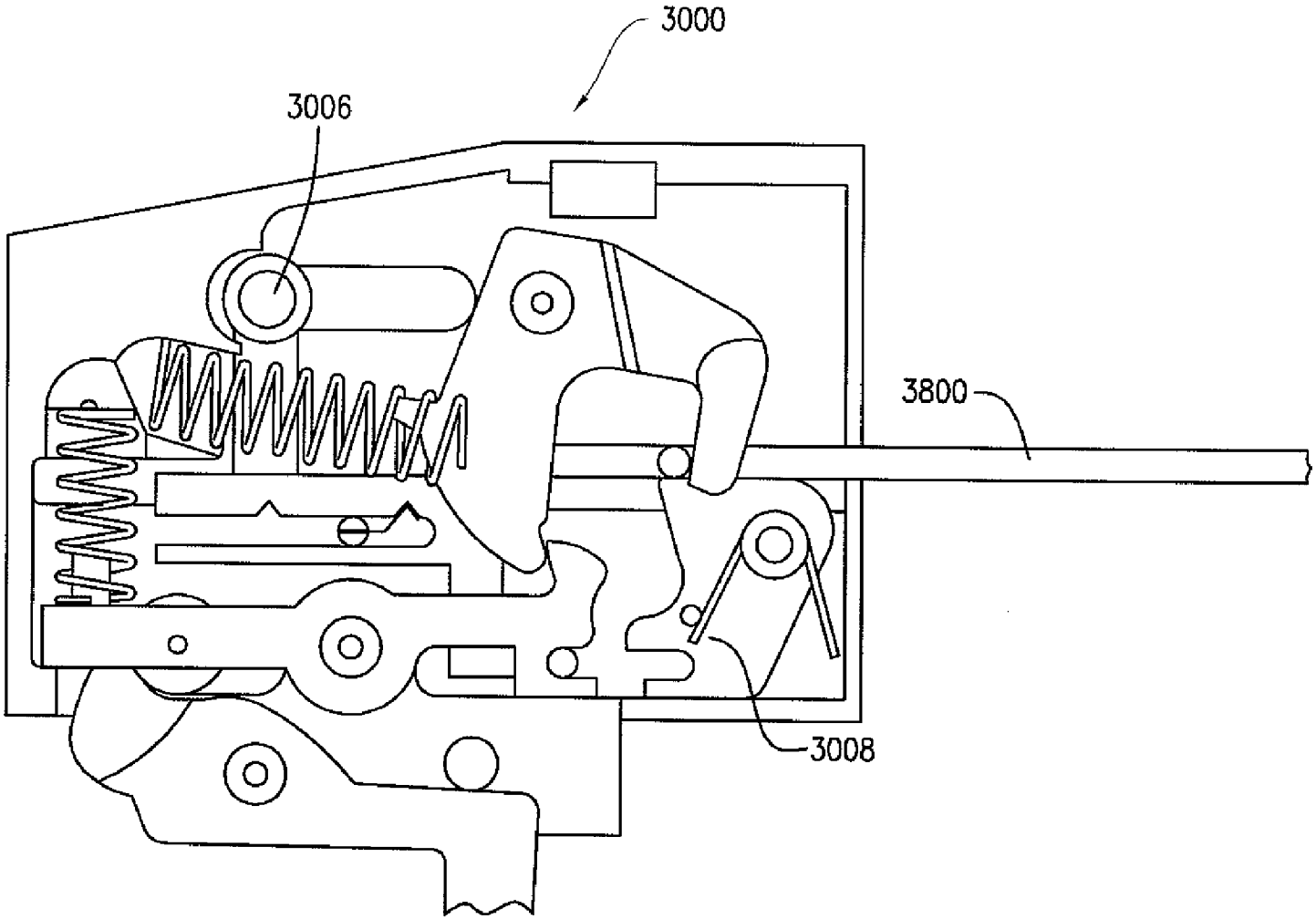

Once an arrow 3800 is inserted into the trigger mechanism 3000 as shown in FIG. 28, a rear end of the arrow 3800 may force the dry fire stop 3008 to move in the counter clockwise direction. Even in this position, the trigger mechanism 3000 may be locked by the lock 3006.

Figure 29:
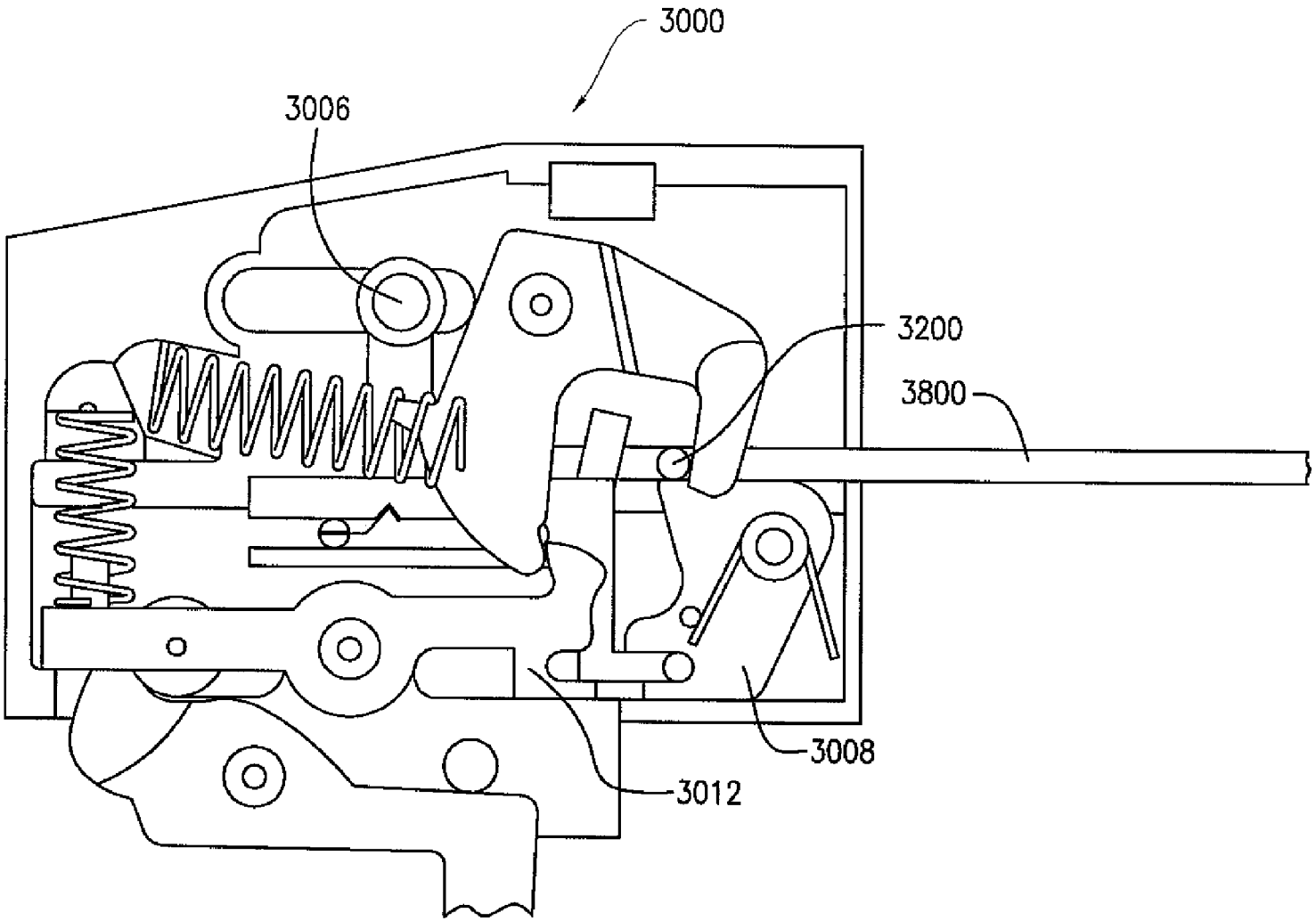

As shown in FIG. 29, to fire the arrow 3800, the lock 3006 may be moved forward, which may cause the lock 3006 to disengage the front end of the intermediate trigger 3012 and engage the dry fire stop 3008. In such circumstances, such engagement of the dry fire stop 3008 may be necessary, at least insofar as when the arrow 3800 is fired outward of, and thereby leaves the trigger mechanism 3000, the dry fire stop 3008 should not necessarily act to hold or otherwise block the bowstring 3200.

Figure 30:
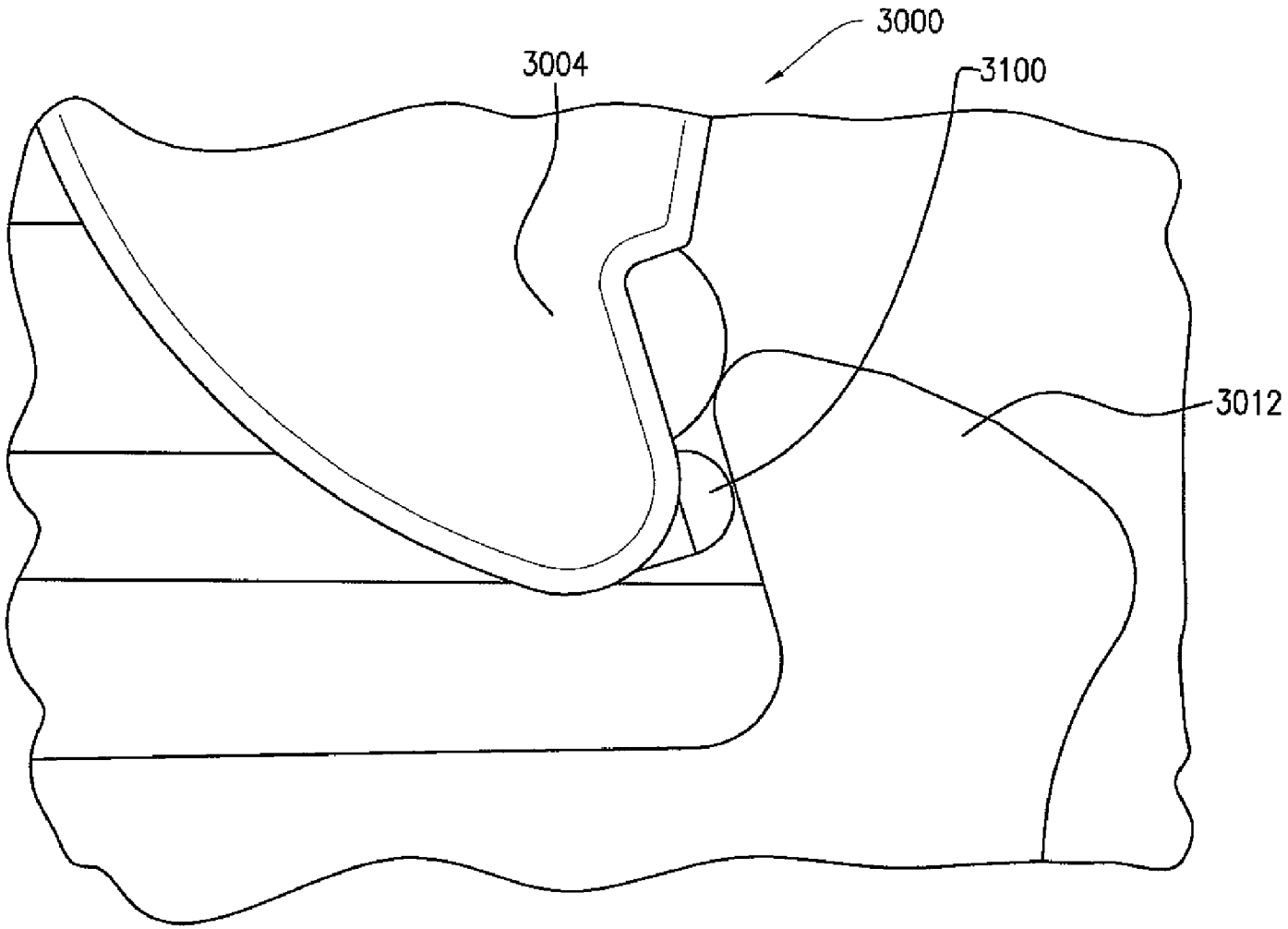

Referring now to FIG. 30, whereas traditional trigger mechanisms typically feature surface contact between the string catch and the trigger, the present trigger mechanism 3000 may use the ball 3100 between the string catch 3004 and the intermediate trigger 3012. Such an arrangement may help to reduce friction. An alternative, possibly less expensive approach may involve replacing the ball 3100 with a roller (not separately shown). Yet another alternative approach, possibly still less expensive, may involve removing the ball 3100 and allowing surface-to-surface contact between the string catch 3004 and the intermediate trigger 3012.

Figure 31:
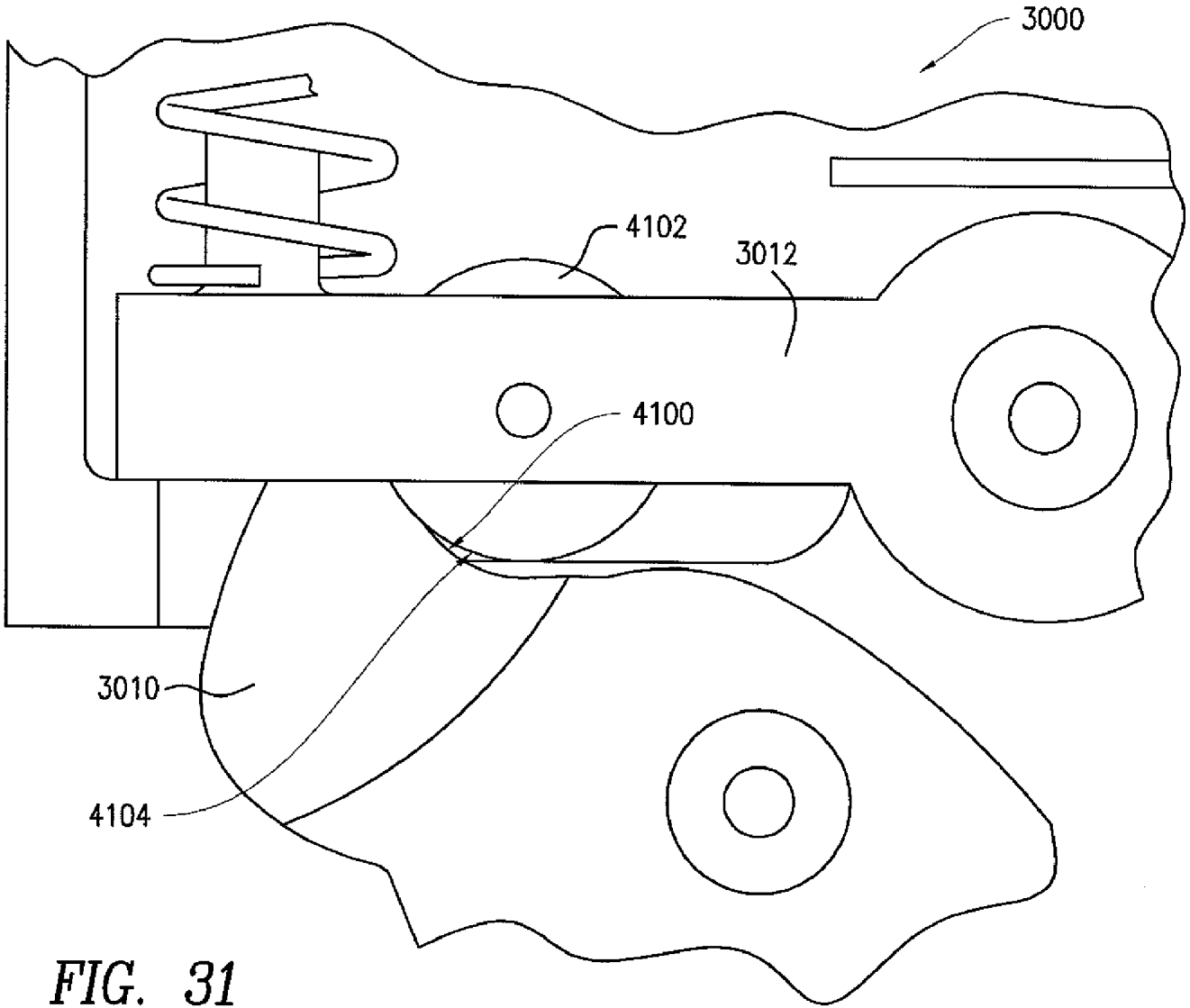

As shown in FIG. 31, the cam trigger 3010 of the trigger mechanism 3000 may include or define a camming surface 4100, and the intermediate trigger 3012 of the trigger mechanism 3000 may include a roller 4102 defining a cam interaction surface 4104. To the extent the cam trigger 3010 is adapted to urge and/or rotate the intermediate trigger 3012 during firing operation, such interaction may take place via a corresponding camming interaction between the camming surface 4100 of the cam trigger 3010 and the cam interaction surface 4104 of the roller 4102, wherein the roller 4102 may serve to reduce a friction with the cam trigger 3010, such that a smooth action may be felt throughout a process of shooting the arrow 3800 (FIG. 28) (e.g., as described below). For example, such a smooth action may include wherein the amount of pulling force needed to initially commence firing—related rotation of the intermediate trigger 3012 does not differ to any substantial extent from that which is needed to finish such rotation after such rotation has commenced. In such circumstances, the trigger mechanism 3000 may provide a distinct advantage over many existing trigger mechanisms, wherein the amount of pulling force needed to initially commence firing (e.g., upwards of eight (8) or ten (10) pounds or more of pulling force) may be considerably higher than that which is needed to finish firing (e.g., two (2) or three (3) pounds of pulling force). Such an elevated level of initial pulling force may be required with respect to such existing trigger mechanisms in order to overcome what may be a considerable amount of resistance to initial movement associated with static friction in the respective assemblies. Such a disparity between the initially required pulling force and the pulling force required thereafter to complete the firing process (e.g., a disparity of up to six (6) or eight (8) pounds or greater) can easily result in an abrupt movement in the crossbow at a most inconvenient time (e.g., just prior to release of the bolt), negatively impacting an overall accuracy of the weapon. Such a disparity in pulling force during the firing process, and/or the abrupt crossbow movements typically associated therewith, may be reduced and/or substantially eliminated in accordance with embodiments of the present disclosure by providing a trigger mechanism (e.g., the trigger mechanism 3000) associated with a substantially constant trigger pull force during the firing process, e.g., from initial trigger movement until release of the crossbow bolt.

In accordance with embodiments of the present disclosure, the cam interaction surface 4104 of the roller 4102 may define a variety of different radii, and/or the camming surface 4100 may exhibit a variety of different camming profiles, depending on the particular manner in which the cam trigger 3010 is desired to act on the intermediate trigger during firing operation. In addition, the camming surface 4100 and the cam interaction surface 4104 may exhibit respective geometries that are matched and/or cooperatively adapted to produce a desired manner of camming interaction therebetween. For example, in embodiments of the trigger mechanism 3000 in which the camming profile of the camming surface 4100 exhibits a relatively steep ramp, the trigger mechanism 3000 may exhibit a relatively faster firing action that that which would otherwise be the case. For another example, to the extent a relatively shallow ramp is exhibited in this regard, less energy and/or a relatively smaller trigger pull force may be sufficient to actuate the trigger mechanism 3000. For still another example, the camming surface 4100 may define a camming profile that presents the cam interaction surface 4104 of the roller 4102 with a ramp that varies with respect to its inclination depending on an extent to which the intermediate trigger 3012 has been deflected toward a release point with respect to the string catch 3004. In some such embodiments, the camming surface 4100 and the cam interaction surface 4104 may exhibit respectively cooperative geometries, including wherein the camming profile of the camming surface 4100 may includes a ramp exhibiting a progressive and/or accelerating inclination, allowing a user to exert a relatively constant pulling force (e.g., a pulling force of approximately three (3) pounds) on the cam trigger 3010, e.g., from an initial application of such pulling force, and through and until the bowstring 3200 (FIG. 22) is released.

In embodiments in accordance with the present disclosure, the cam trigger 3010 may be easily replaceable with similar components but defining camming surfaces 4100 exhibiting different camming profiles (e.g., having a relatively shallow ramp, a relatively steep ramp, and/or a variable inclination ramp), and/or which are adapted to be mounted with respect to different respective pivot points on trigger mechanism 3000 associated with different respective radial distances from the cam interaction surface 4104 of the roller 4102 (e.g., to permit a user to select from among a variety of different levels of mechanical advantage offered by the cam trigger 3010).

Figure 32:
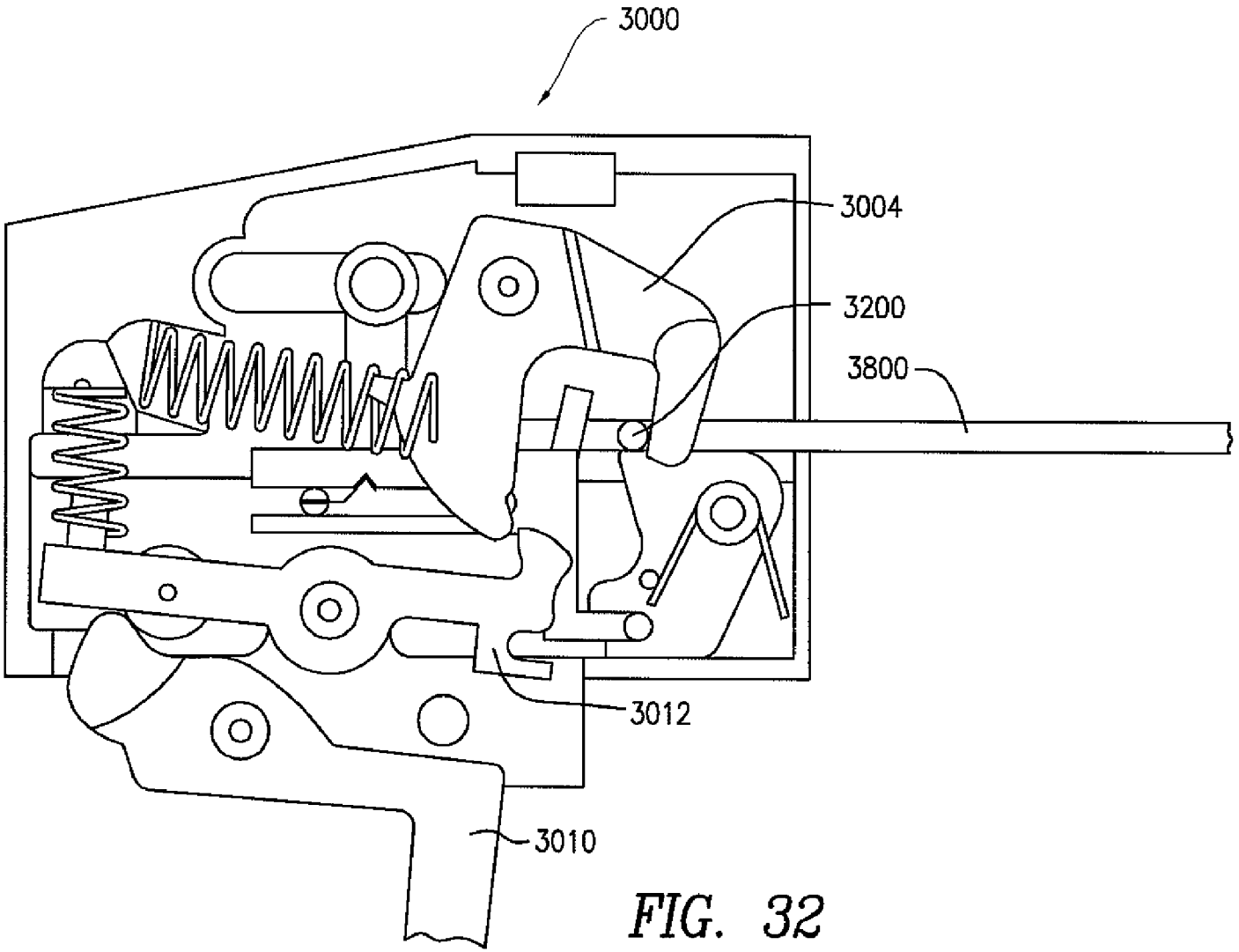

Turning now to FIG. 32, to fire the arrow 3800, a user may pull the cam trigger 3010, whereby the rear end of the cam trigger 3010 may force the rear end of the intermediate trigger 3012 upwards. The front end of the intermediate trigger 3012 may thus move downward, which may release the string catch 3004. The string catch 3004 may now rotate in the counter clockwise direction, releasing the bowstring 3200 and shooting the arrow 3800 from the trigger mechanism 3000.

Figure 33:
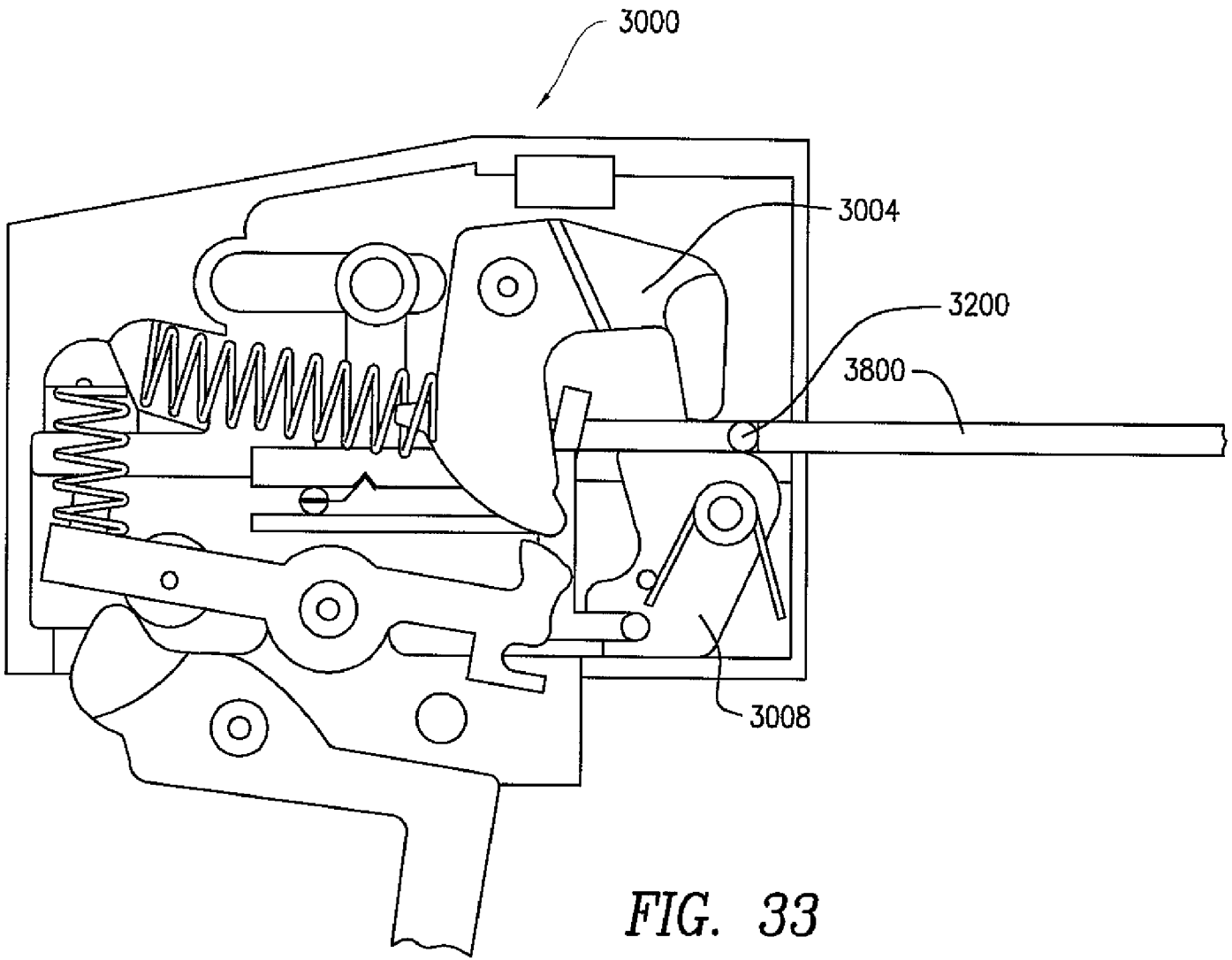
Figure 34:
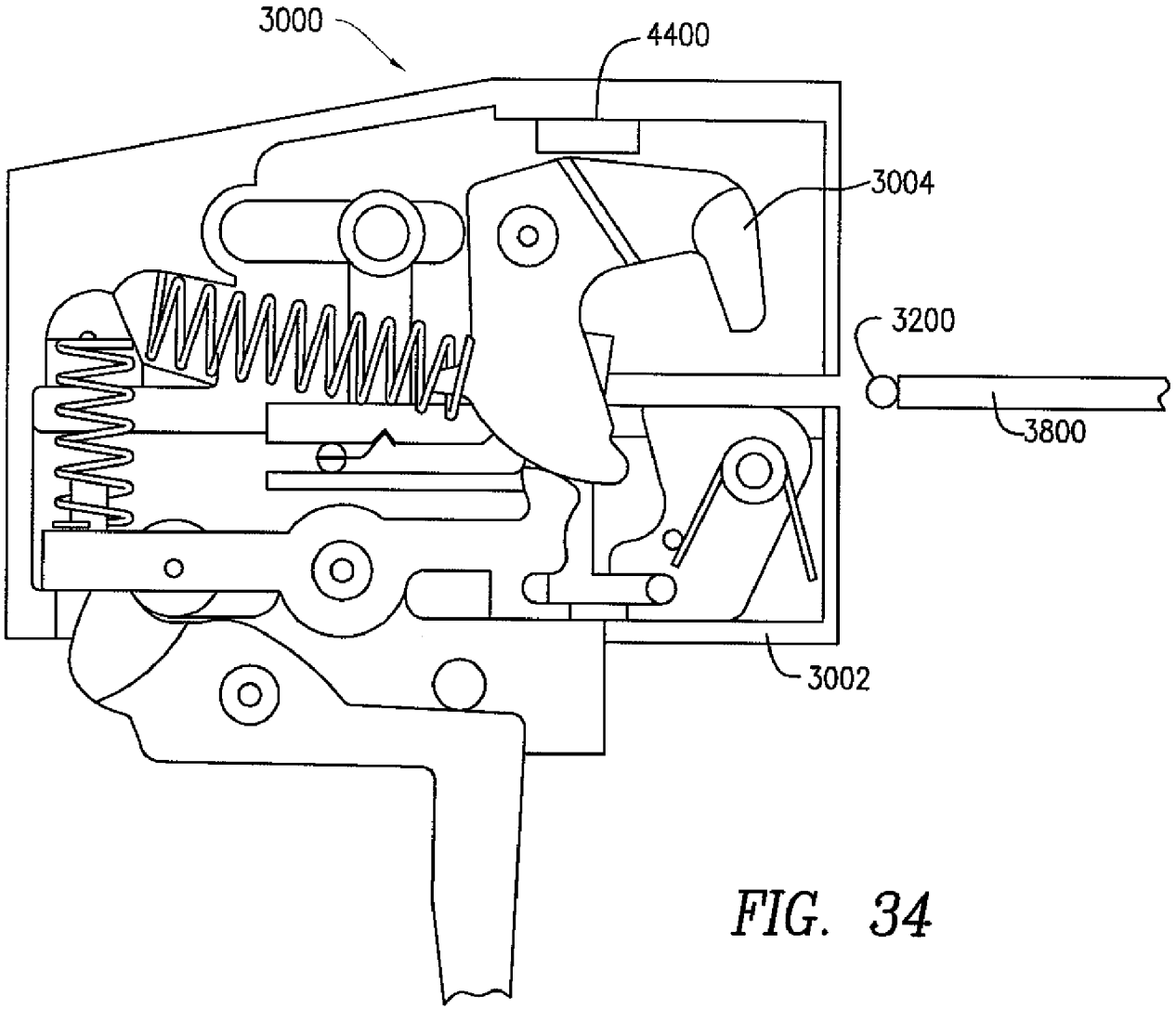

Release of the bowstring 3200 and exit of the arrow 3800 from the trigger mechanism 3000 are shown in FIG. 33. As shown in FIG. 33, the dry fire stop 3008 may be retained in its position (e.g., out of the way of the bowstring 3200 and the arrow 3800). FIG. 34 shows what a position of the various parts of the trigger mechanism 3000 may be after the bowstring 3200 and the arrow 3800 have exited the trigger mechanism 3000. More particularly, the string catch 3004 may be stopped by a rubber block 4400 disposed along a top margin of the housing 3002.

Figure 35:
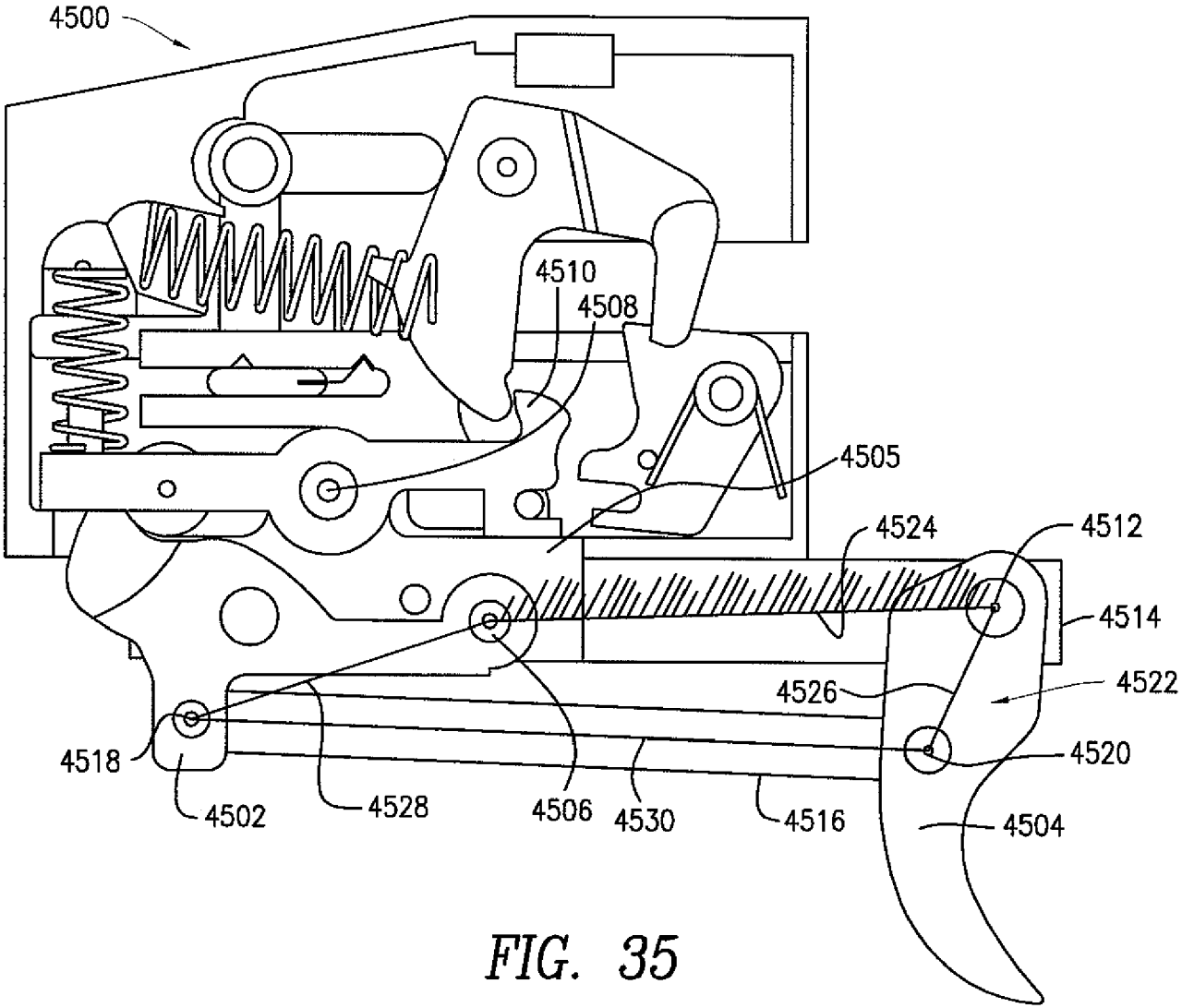
Figure 36:
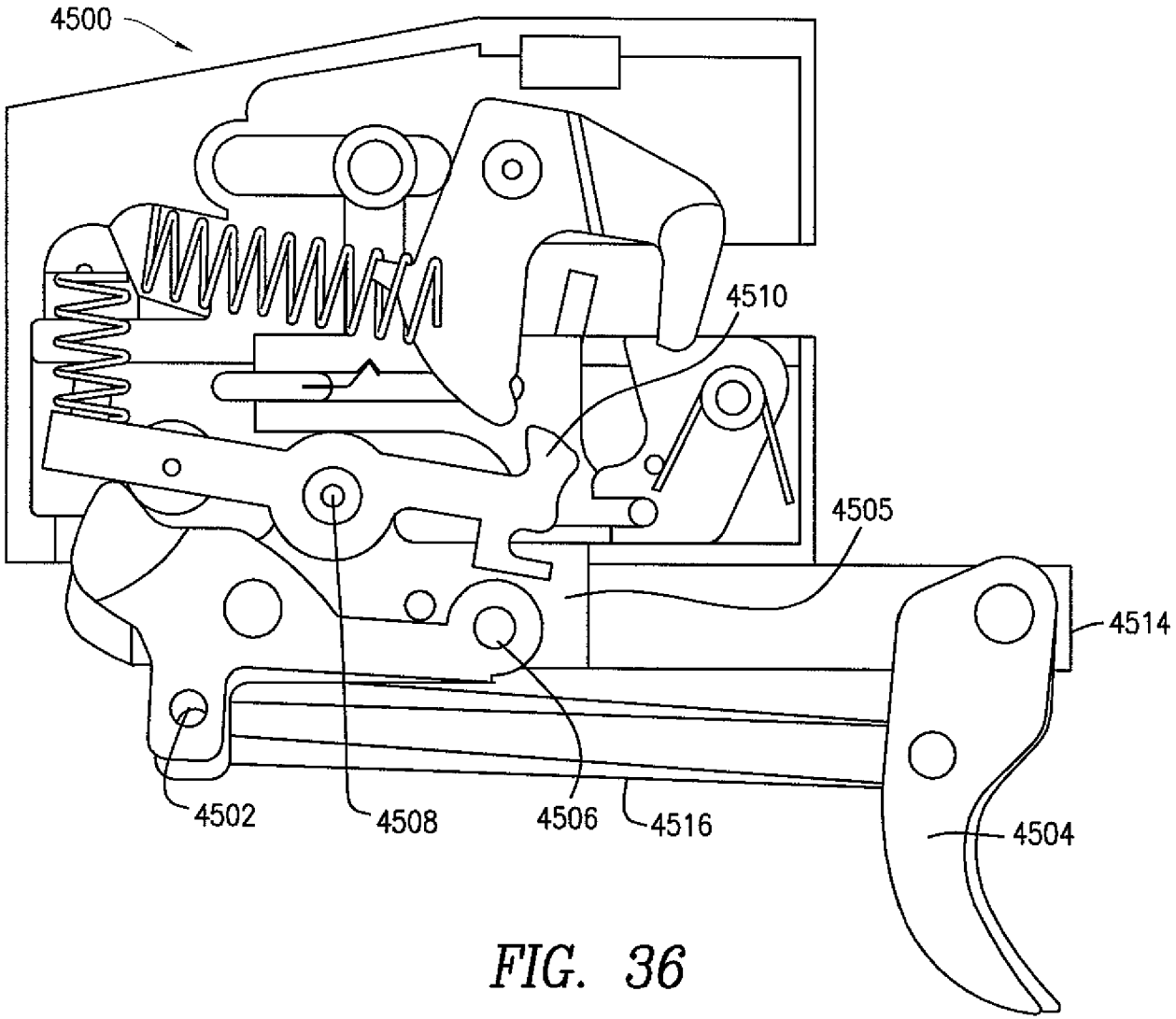
FIGS. 36-37 illustrate a variation of the crossbow trigger mechanism of FIGS. 20-35 in accordance with the present disclosure.

As shown in FIGS. 35-36, a trigger mechanism 4500 otherwise substantially similar to the trigger mechanism 3000 may include a further split in the trigger apparatus to provide a relatively more forward mounting position for an associated pull trigger, appropriate for at least some crossbow designs reflecting a shorter shoulder stock, and/or a more compact overall longitudinal dimension, as may be preferred by some crossbow users. More particularly, a structure and/or function cam trigger 4502 of the trigger mechanism 4500 may be abbreviated, e.g., at least insofar as the cam trigger 4502 may not include a trigger pull surface. In this regard, the trigger mechanism 4500 may further include a separate pull trigger 4504 that remains functionally coupled to, but is further rotatable with respect to, the cam trigger 4502.

The cam trigger 4502 may be pivotally mounted with respect to a housing 4505 of the trigger mechanism 4500 at a first pivot point 4506, the first pivot point 4506 being in a vicinity of a second pivot point 4508 at which an intermediate trigger 4510 of the trigger mechanism 4500 is similarly pivotally mounted. The pull trigger 4504 may be pivotally mounted with respect to the housing 4505 at a third pivot point 4512. The third pivot point 4512 may be located in a vicinity of a forward portion 4514 of the housing 4505, such that the pull trigger 4504 is located in spaced relation with, and forward of, the cam trigger 4502.

Figure 22:
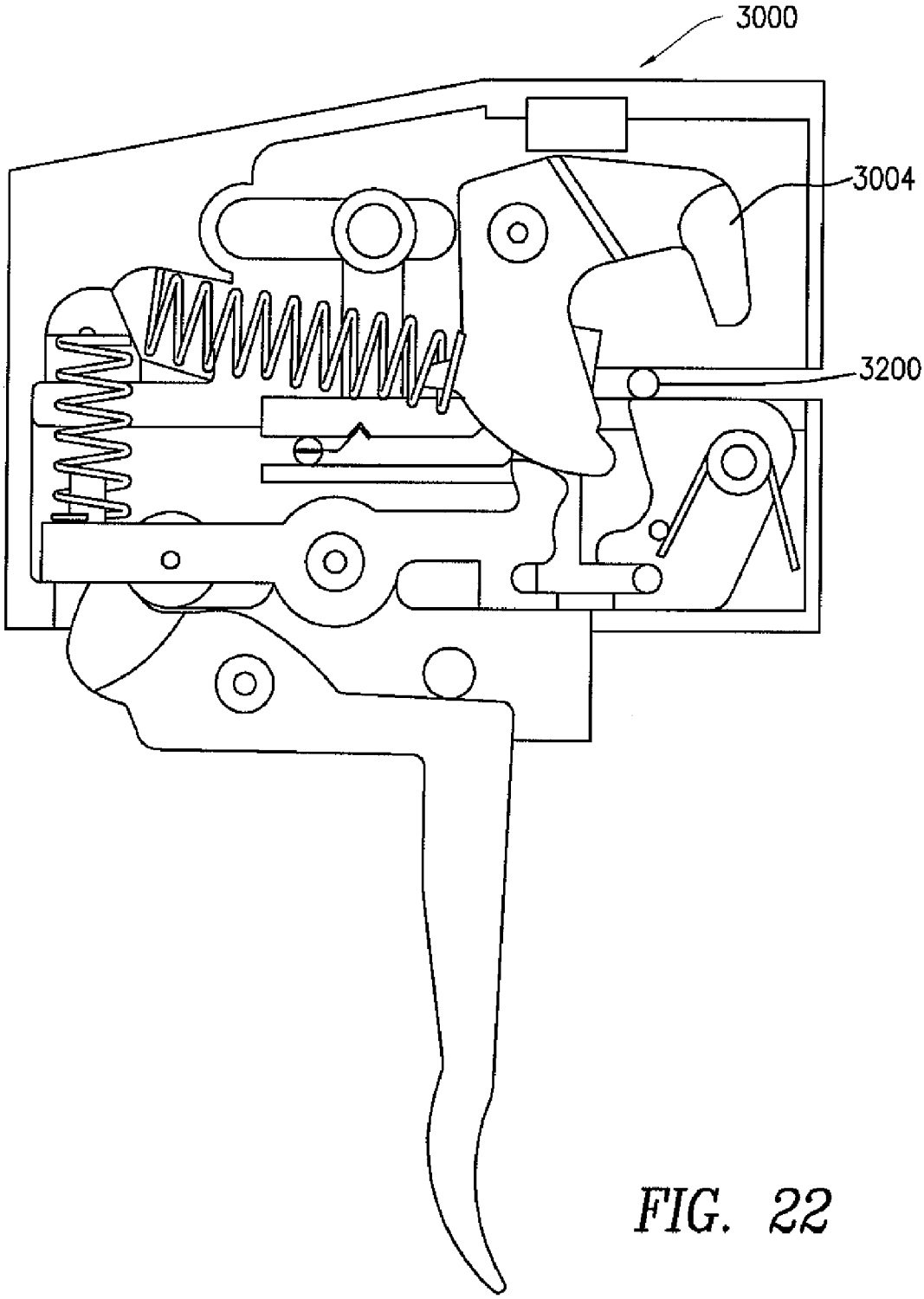
Figure 23:
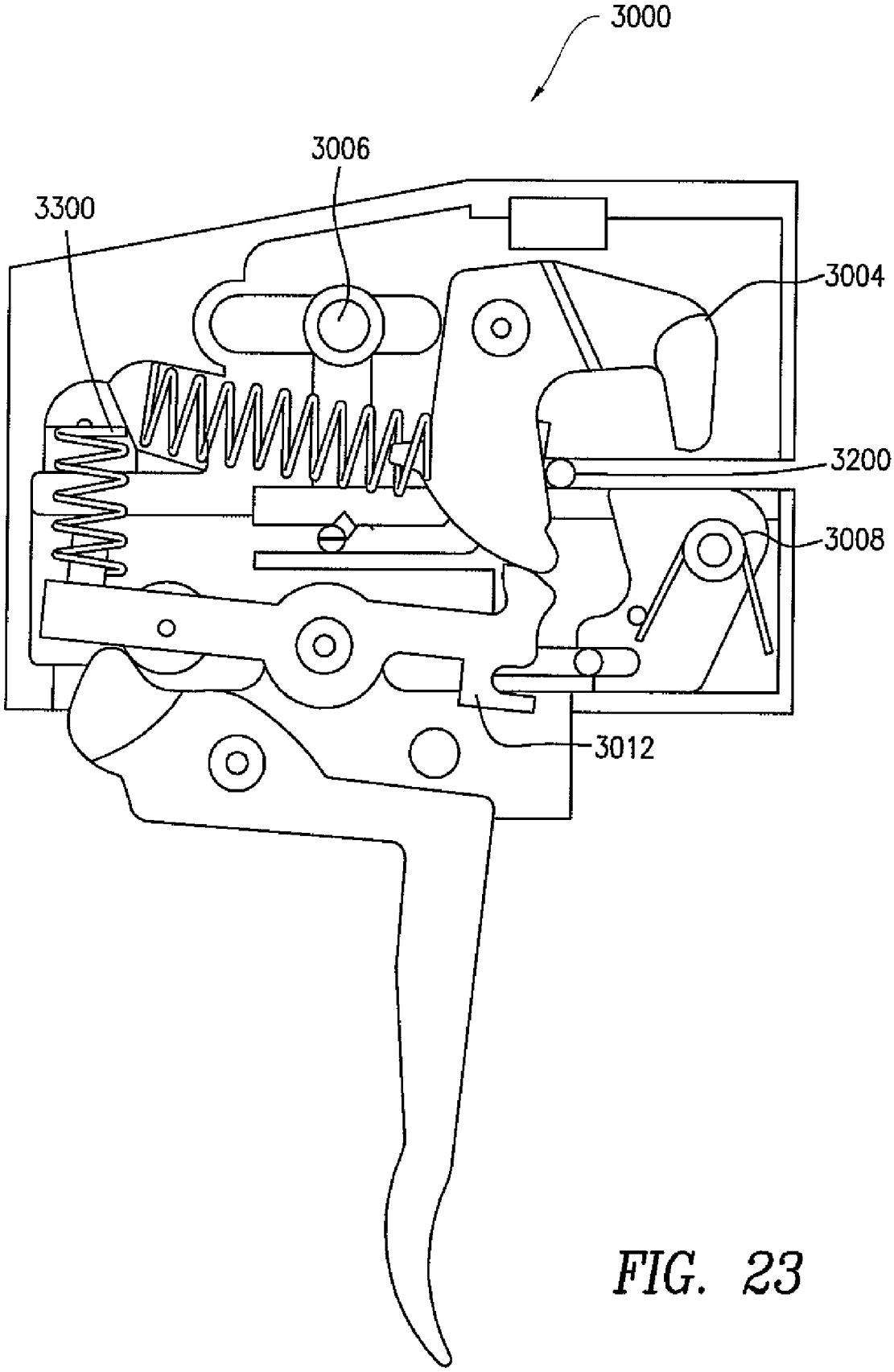

The trigger mechanism 4500 may further include a connecting piece 4516 extending between the cam trigger 4502 and the pull trigger 4504. The cam trigger 4502 may be pivotally mounted with respect to the connecting piece 4516 at a fourth pivot point 4518, and the pull trigger 4504 may be pivotally mounted with respect to the connecting piece 4516 at a fifth pivot point 4520. Accordingly, the cam trigger 4502 and the pull trigger 4504 are coupled to each other both via the housing 4505, and via the connecting piece 4516. In such circumstances, the trigger mechanism 4500 may be considered to comprise an actuator linkage 4522, wherein the actuator linkage 4522 may be a so-called 'four bar' linkage including a base link 4524 associated with the housing 4505, a driving link 4526 associated with the pull trigger 4504, a driven link 4528 associated with the cam trigger 4502, and a coupling link 4530 associated with the connecting piece 4516. In accordance with embodiments of the present disclosure, the actuator linkage 4522 provides a forward-mounted trigger design that achieves a significant reduction in throw (e.g., as depicted in FIG. 36), as compared with, e.g., a corresponding throw associated with the cam trigger 3010 (FIG. 20), without a significant loss in mechanical advantage. In other words, the actuator linkage 4522 may be configured so as to provide the trigger mechanism 4500 with a sensitivity similar to that of the trigger mechanism 3000 (FIG. 20), e.g., such that a similar low level of pulling force is needed to release the bowstring 3200 (FIG. 22).

The trigger mechanism 4500 may further allow for ease of customization and user tuning by changing (e.g., moving forward, backward, upward, or downward) the respective positions of the first pivot point 4506 and/or the third pivot point 4512 with respect to the housing 4505 of the trigger mechanism 4500. The trigger mechanism may further allow for ease of customization by changing a distance between the cam trigger 4502 and the pull trigger 4504 (e.g., between first pivot point 4506 and the third pivot point 4512 along the housing 4505), including, e.g., allowing the user, while in the field, to select from among a variety of different instances of a cam trigger 4502 associated with differently-positioned first pivot points 4506, and defining respective camming surfaces (e.g., see camming surface 4104 in FIG. 31) exhibiting different respective camming profiles adapted for use in conjunction with correspondingly different radial pivot lengths. In accordance with embodiments of the present disclosure, a user may reduce pull force by increasing a distance between the pull trigger 4504 and the cam trigger 4502. Further in accordance with embodiments of the present disclosure, a user may reduce pull force, and/or increase a mechanical advantage, associated with the trigger mechanism 4500 by making appropriate adjustments in the respective lengths of, and/or in the respective angles between, the base link 4524, the driving link 4526, the driven link 4528, and the coupling link 4530 of the actuator linkage 4522, including but not limited to such appropriate adjustments thereto as may be known to those of skill in the related art.

Figure 37:
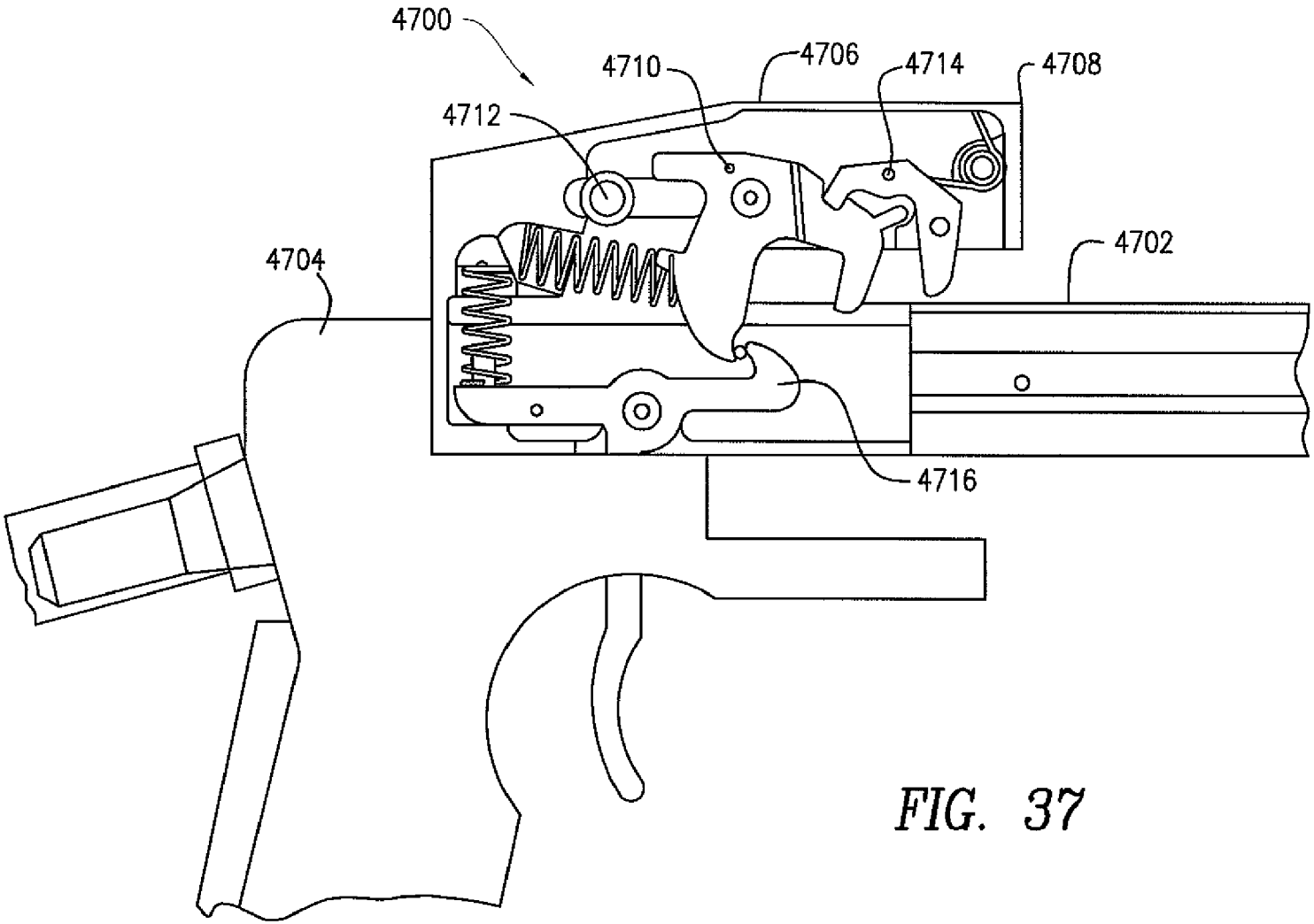

Turning now to FIG. 37, a crossbow 4700 in accordance with the present disclosure is shown, wherein the crossbow 4700 includes a stock 4702, a gripper 4704, and a trigger mechanism 4706. The trigger mechanism 4706 may include a housing 4708, wherein a portion (not shown) of the housing 4708 is not shown, having been omitted in FIG. 37 for purposes of clarity and/or to show an internal construction of the trigger mechanism 4706. As shown in FIG. 20, the trigger mechanism 4706 may include a string catch 4710, a lock 4712, a dry fire stop 4714, and a trigger 4716.

Figure 38:
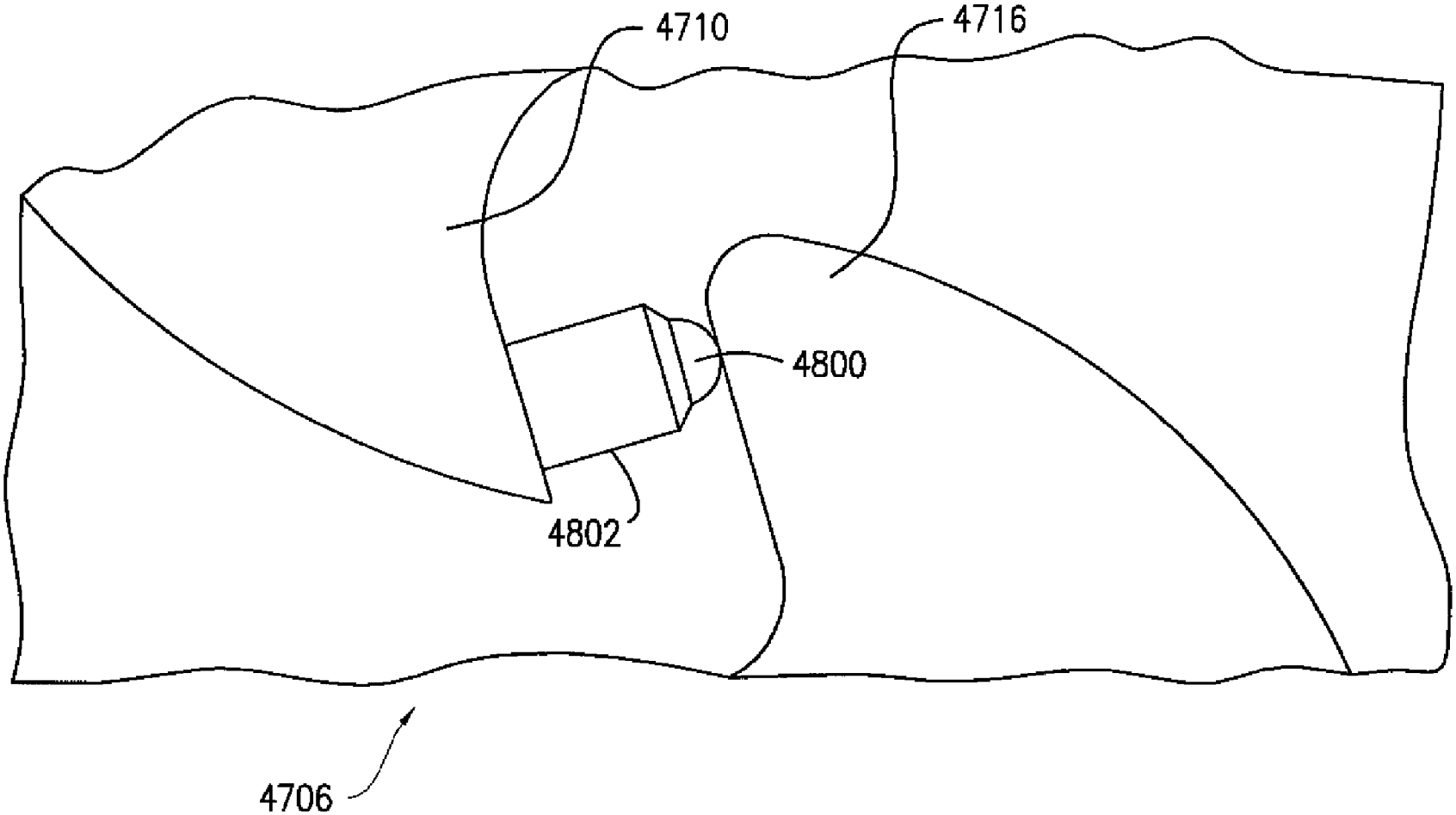
FIGS. 38-46 illustrate a crossbow trigger mechanism in accordance with the present disclosure including a dry fire stop.

Referring now to FIG. 38, whereas traditional trigger mechanisms typically feature surface contact between the string catch and the trigger, the present trigger mechanism 4706 may use a ball 4800 between the string catch 4710 and the trigger 4716, which ball 4800 may be contained within a socket or sleeve 4802. Such an arrangement may help to reduce friction. An alternative, possibly less expensive approach may involve replacing the ball 4800 with a roller (not separately shown). Yet another alternative approach, possibly still less expensive, may involve removing the ball 4800 and allowing surface-to-surface contact between the string catch 4710 and the trigger 4716.

Figure 39:
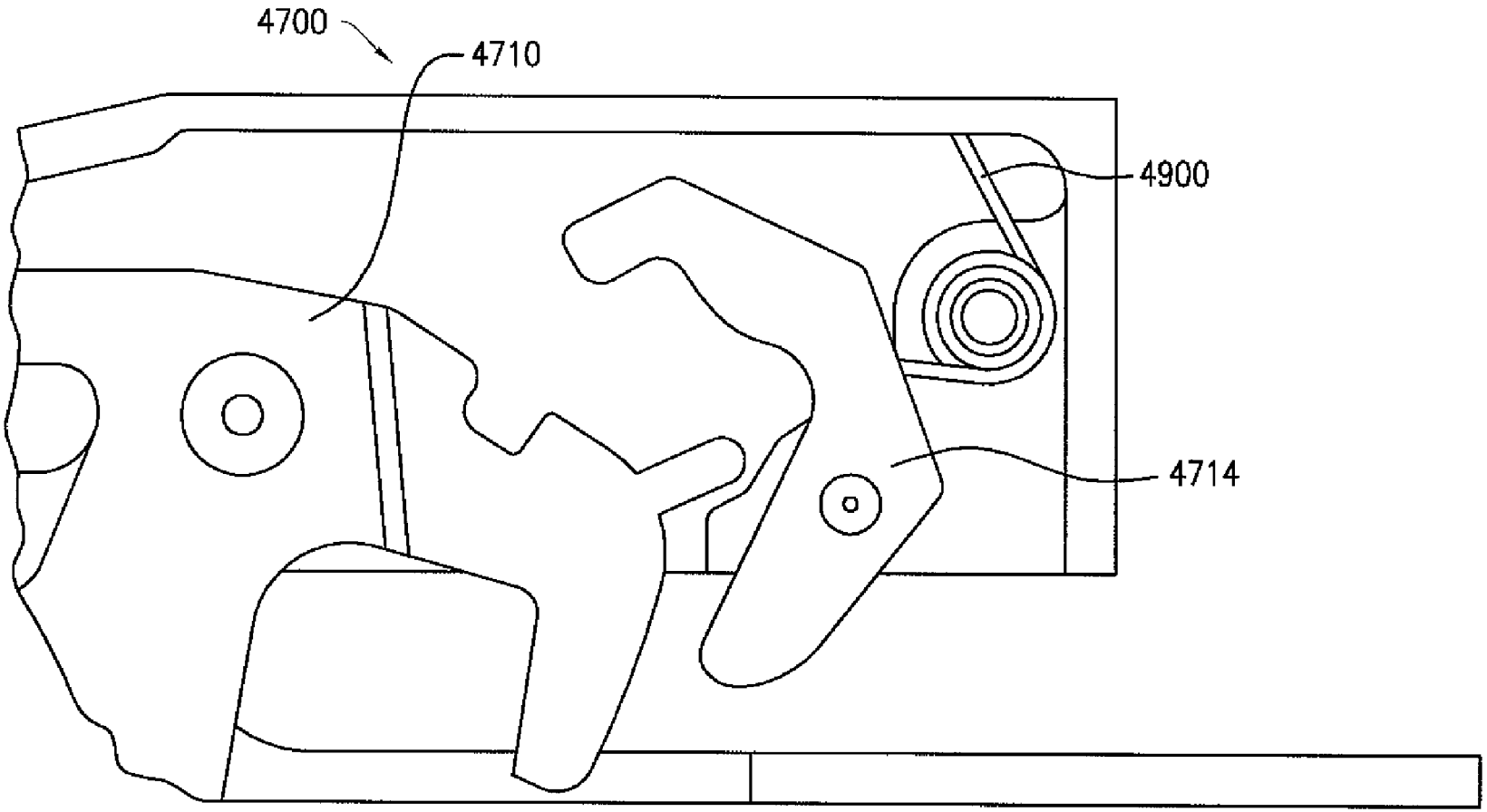
Figure 40:
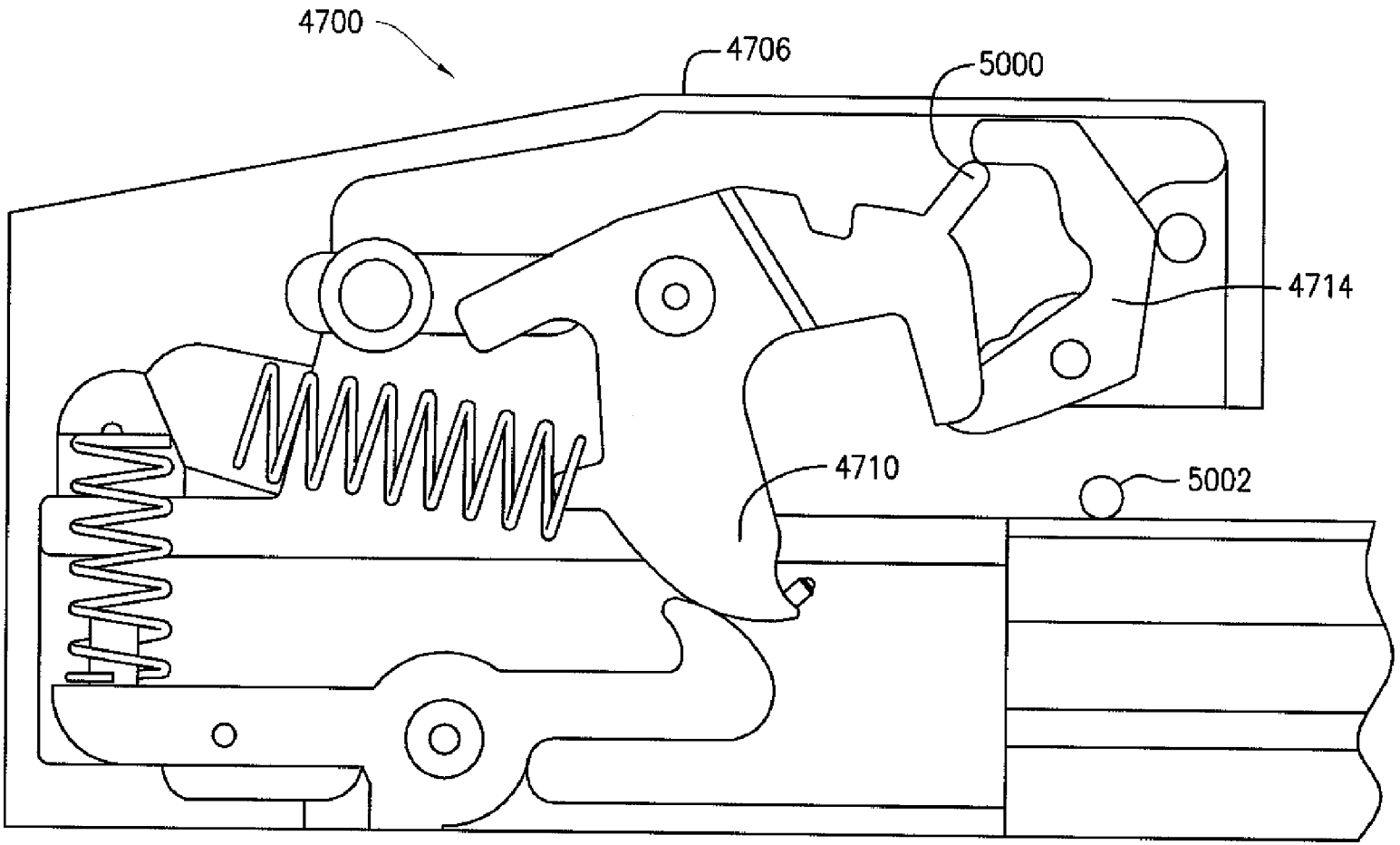

Referring now to the views of the crossbow 4700 and the trigger mechanism 4706 thereof shown in FIGS. 39-46, as shown in FIG. 39, the dry fire stop 4714 may lock and unlock the string catch 4710, preventing accidental discharge of the crossbow 4700 when no arrow (not shown) is loaded in the trigger mechanism 4706. The dry fire stop 4714 may further be associated with a spring 4900. In FIG. 40, an initial position of the trigger mechanism 4706 is shown, wherein a tip 5000 projecting from the string catch 4710 may keep the dry fire stop 4714 in a raised position, away from a bowstring 5002 being pulled into the trigger mechanism 4706 for charging the same.

Figure 41:
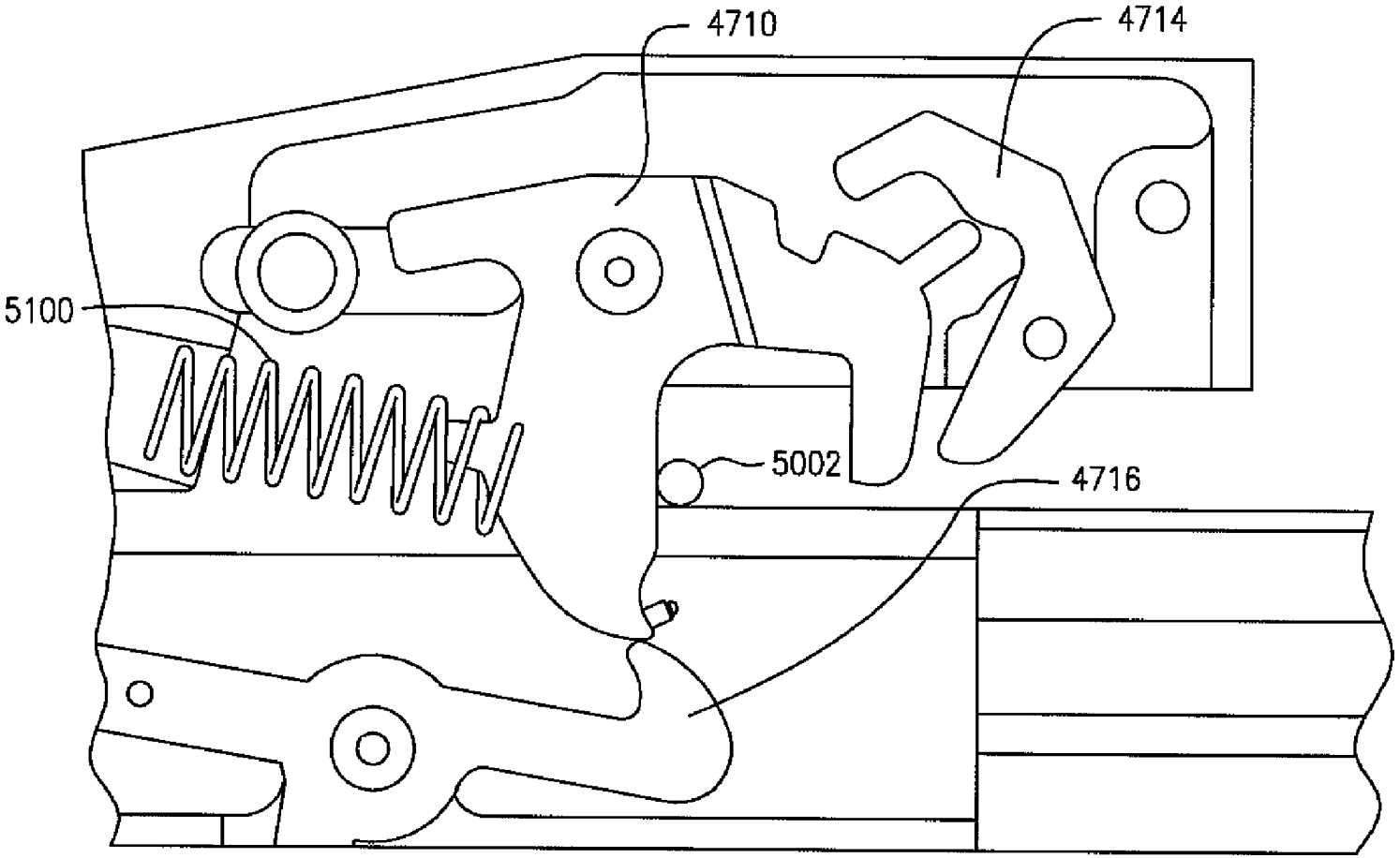

As shown in FIG. 41, continued rearward movement of the bowstring 5002 may cause the string catch 4710 to begin moving clockwise, such that a spring 5100 associated with the string catch 4710 may be compressed. The spring catch 4710 may further force a front end of the trigger 4716 downward and a rear end of the trigger 4716 to rotate upwards. The spring 4900 (FIG. 39) may further urge the dry fire stop 4714 to rotate downward.

Figure 42:
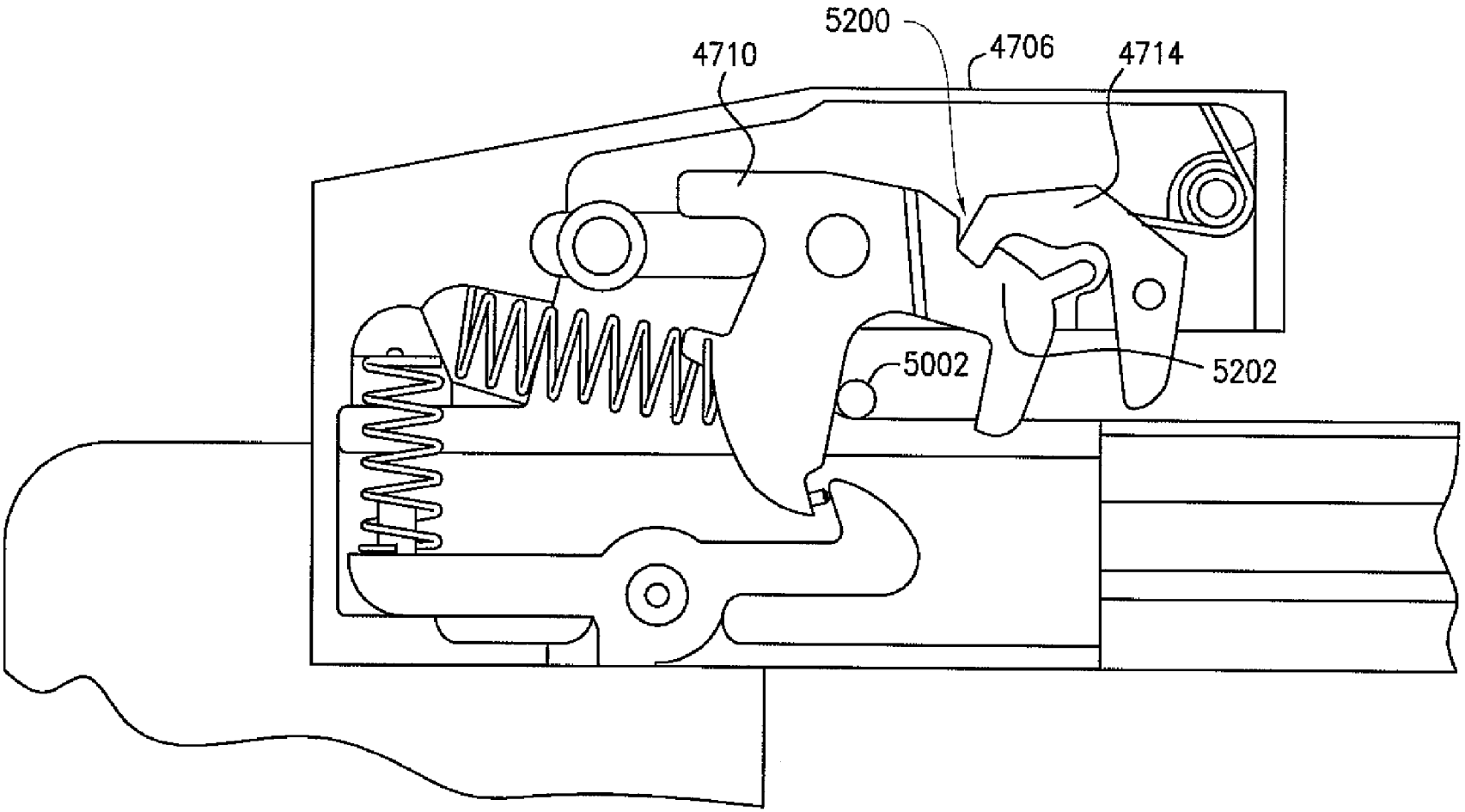

Turning now to FIG. 42, continued rearward movement of the bowstring 5002 may cause the trigger mechanism 4706 to transition into a fully charged state, with the bowstring 5002 in the rearmost position. At this stage, the dry fire stop 4714 may move downward and lock the string catch 4710 by engaging itself within a notch 5200 of a complementary shape and formed in the string catch 4710 (e.g., located on an upper portion 5202 of the string catch 4710).

Figure 43:
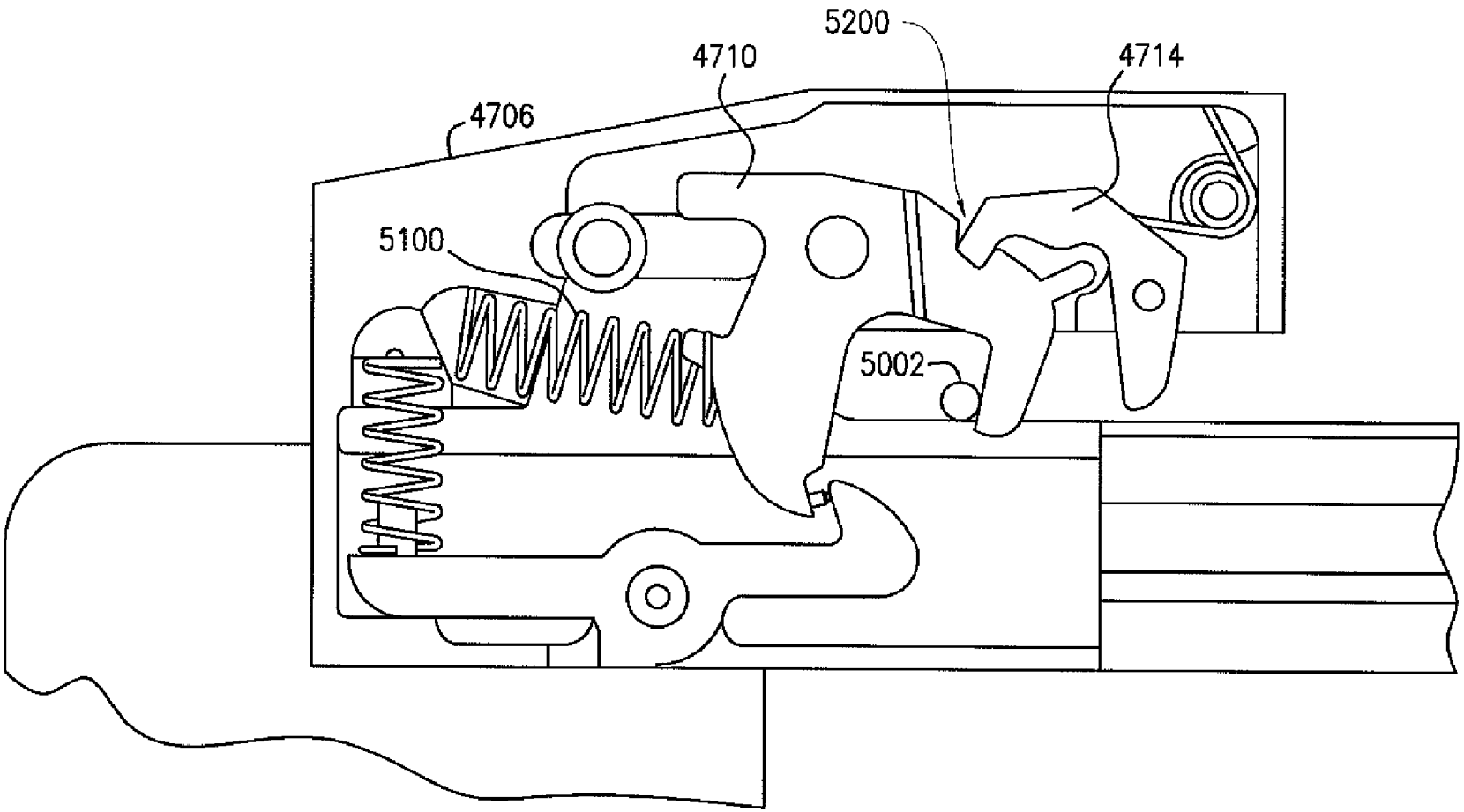

FIG. 43 shows the charged trigger mechanism 4706, wherein the bowstring 5002 may have been released by the user and/or caught by the string catch 4710. In this configuration, the spring 5100 may be in compression such that both the spring 5100 and the bowstring 5002 may be exerting a combined force on the string catch 4710 that, if unopposed, may tend to urge the string catch 4710 in the counter clockwise direction. Such combined force may, however, be opposed by the dry fire stop 4714, which in this configuration remains lodged within the notch 5200, thus blocking rotation of the string catch 4710.

Figure 44:
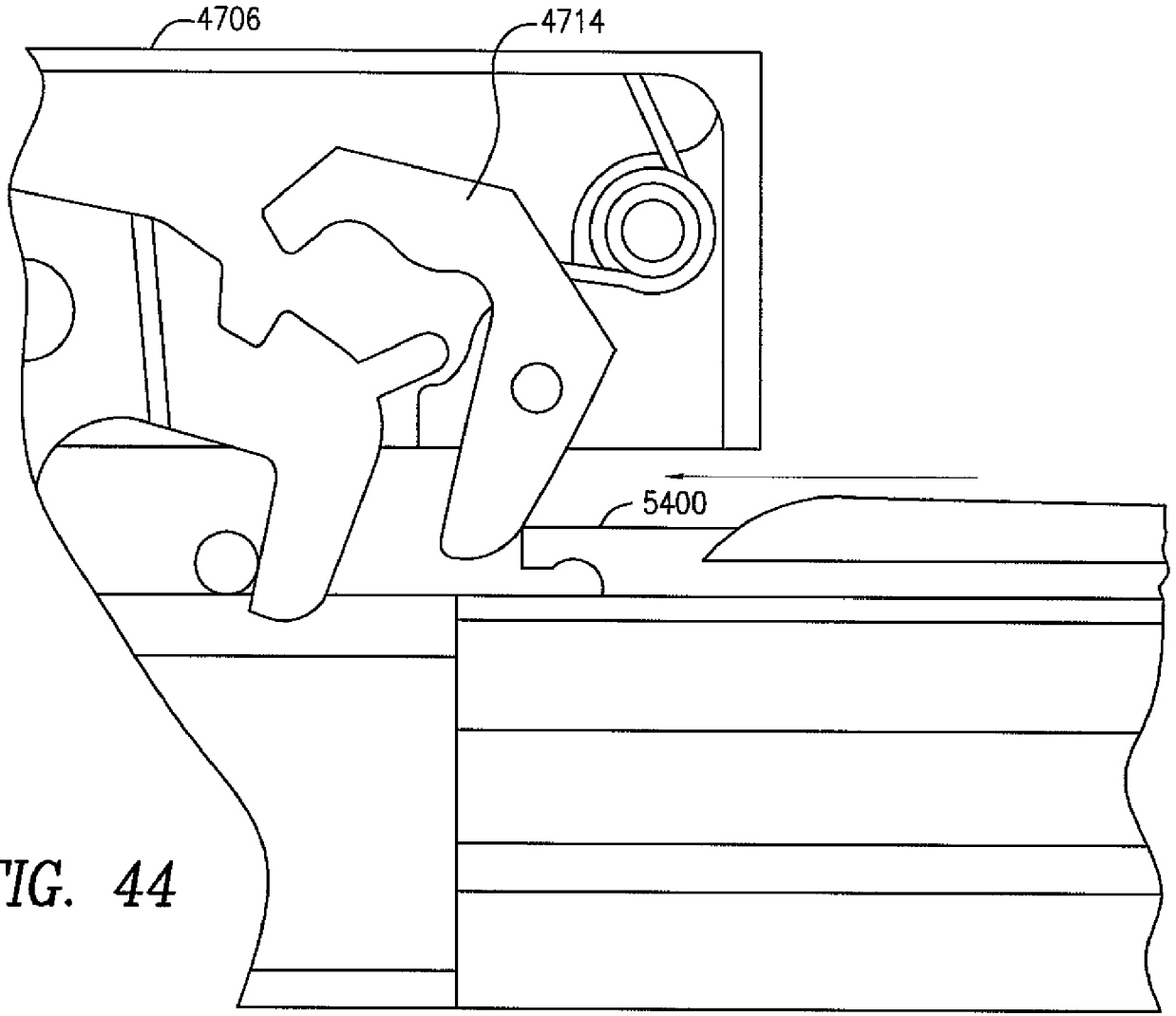
Figure 45:
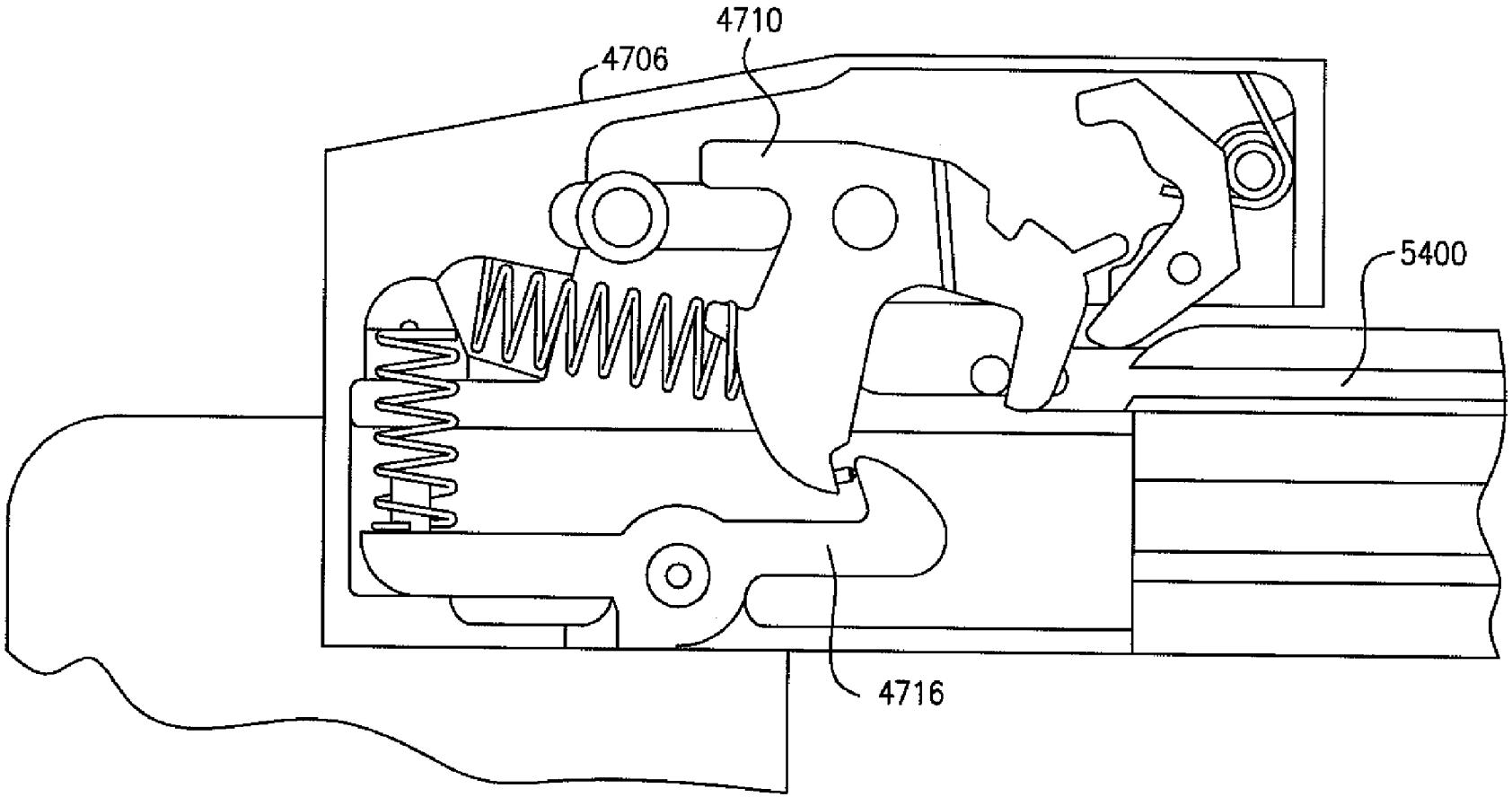

Upon an arrow 5400 being loaded in the trigger mechanism 4706 as shown in FIG. 44, the arrow 5400 may lift the dry fire stop 4714. FIG. 45 shows the arrow 5400 loaded within the trigger mechanism 4706, which trigger mechanism 4706 may remain charged. In this configuration, the trigger 4716 may hold the string catch 4710 in place in its current position.

Figure 46:
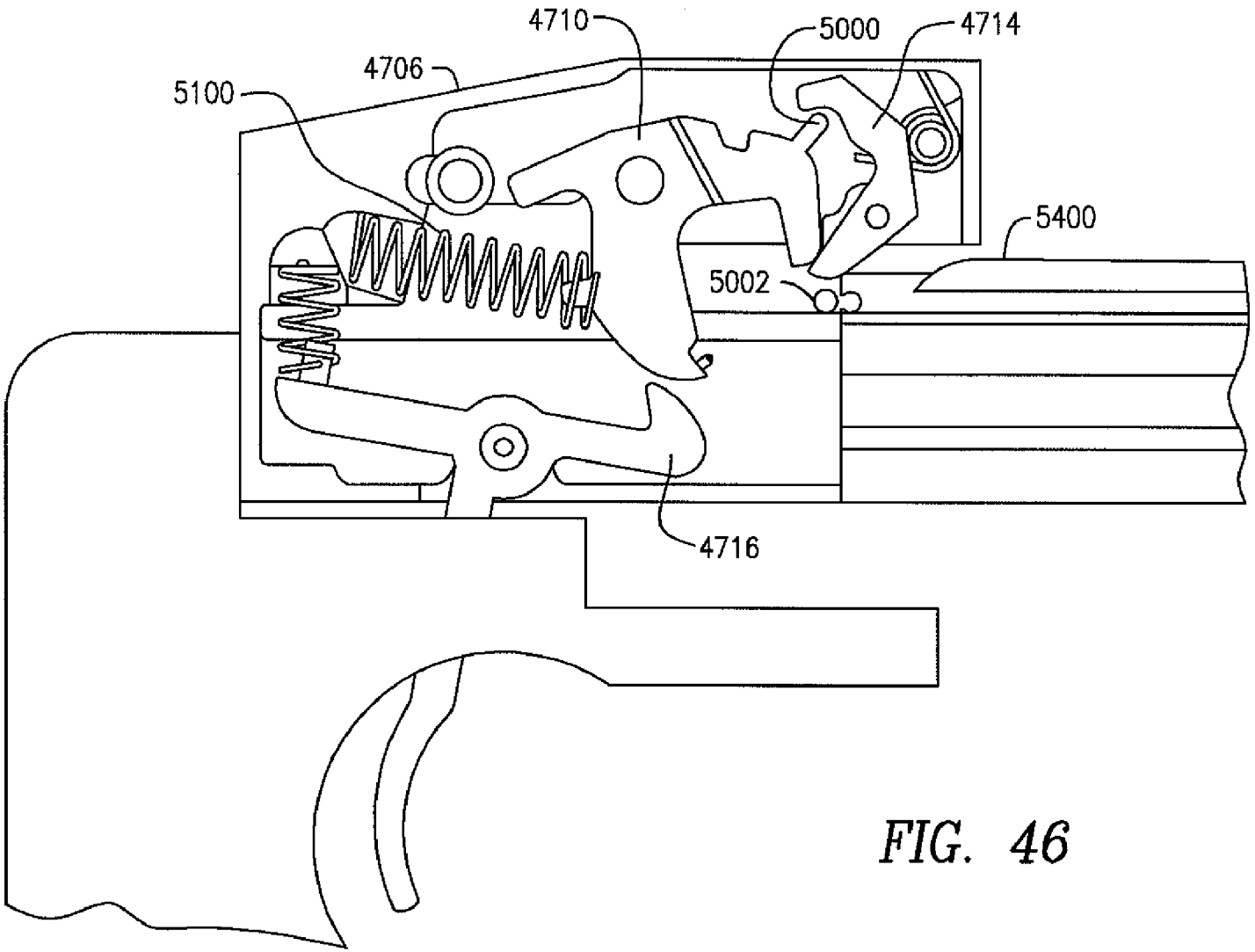

Turning now to FIG. 46, upon a user applying a load to a bottom portion of the trigger 4716, the front end of the trigger 4716 may move downward, releasing the string catch 4710. The string catch 4710 may now move in the counter clockwise direction, e.g., due to a pulling force from the bowstring 5002 and/or a pushing force from the spring 5100. Such counter clockwise movement of the string catch 4710 may cause the string catch 4710 to release the bowstring 5002, shooting the arrow 5400. The dry fire stop 4714 will tend to move downward as soon as the arrow 5400 loses contact with the dry fire stop 4714. The dry fire stop 4714 may, however, be prevented from contacting the bowstring 5002 by the string catch 4710, wherein the tip 5000 of the string catch 4710 may lift the dry fire stop 4714 upward and out of the way of the exiting bowstring 5002. After the arrow 5400 is shot and the trigger mechanism 4706 discharged, the various components of the trigger mechanism may assume the configuration shown in FIG. 40.

While embodiments in accordance with the present disclosure have been shown and described herein, it will be understood that such embodiments are provided by way of example only. Numerous variations, changes and substitutions will occur to those skilled in the art without departing from the spirit of the present invention. Accordingly, it is intended that the appended claims cover all such variations as fall within the spirit and scope of the invention.

What is claimed is:

1. A crossbow trigger mechanism, comprising:

a trigger housing for receiving a bowstring of a crossbow;

a bowstring catch mounted with respect to the housing and adapted to releasably engage a crossbow bowstring brought within the trigger housing;

a trigger adapted to releasably engage the bowstring catch, the trigger being further adapted to be selectively actuated by a user so as to cause the trigger to release the bowstring catch, thereby causing the bowstring catch to release a crossbow bowstring; and a ball disposed between the bowstring catch and the trigger, the ball being adapted to bear and react to forces arising between the bowstring catch and the trigger during at least one of the trigger engaging the bowstring catch and the trigger releasing the bowstring catch;

wherein the ball is at least partially contained within a socket or sleeve; and wherein the socket or sleeve extends from an end portion of the bowstring catch.

2. A crossbow trigger mechanism in accordance with claim 1, wherein the ball is rollably disposed between the bowstring catch and the trigger so as to facilitate a relative motion of the trigger relative to the bowstring catch during at least one of the trigger engaging the bowstring catch and the trigger releasing the bowstring catch by reducing a frictional force associated therewith.

3. A crossbow trigger mechanism in accordance with claim 2, wherein the ball is mounted with respect to the bowstring catch for rollably contacting a corresponding reaction surface of the trigger.

4. A crossbow trigger mechanism in accordance with claim 1, wherein the ball is mounted with respect to the bowstring catch for contacting a corresponding reaction surface of the trigger.

5. A crossbow trigger mechanism, comprising:

a trigger housing for receiving a bowstring of a crossbow;

a bowstring catch moveably mounted with respect to the housing and adapted to releasably engage a crossbow bowstring brought within the trigger housing; and a trigger, the trigger including a first trigger element adapted to releasably engage the bowstring catch, and a second trigger element adapted to rotate relative to the first trigger element and to be selectively actuated by a user to engage and impart an urging force to the first trigger element for rotating the first trigger element relative to the bowstring catch, and thereby causing the first trigger element to release the bowstring catch;

wherein the first trigger element includes a reaction surface, the second trigger element includes a camming surface, and the second trigger element is adapted, while rotating relative to the first trigger element, to engage the first trigger element, and to rotate the first trigger element relative to the bowstring catch, via the camming surface imparting an urging force to the reaction surface;

wherein the first trigger element includes a first body and a roller rollably mounted to the first body, wherein the reaction surface of the first trigger element is a curved reaction surface of the roller;

wherein in rotating the first trigger element relative to the bowstring, the roller is caused to roll across the camming surface, and to roll relative to the first body of the trigger;

wherein each of the camming surface and the reaction surface exhibits a geometry; and wherein the respective geometries of the camming surface and the reaction surface are respectively sized and shaped to match one another and functionally cooperate in allowing a user of the crossbow trigger mechanism to exert a pulling force of a substantially constant magnitude on the second trigger element, from an initial application by the user of a pulling force to the second trigger element, to an ultimate release of the bowstring catch by the first trigger element.

6. A crossbow trigger mechanism in accordance with claim 5, wherein the pulling force of a substantially constant magnitude is a pulling force of a magnitude of no greater than about five pounds.

7. A crossbow trigger mechanism in accordance with claim 5, wherein the camming surface defines a camming profile for camming interaction with the reaction surface exhibiting a variable inclination, and wherein the inclination varies depending on an extent to which the first trigger element is rotated toward a release position with respect to the bowstring catch.

8. A crossbow trigger mechanism in accordance with claim 5, wherein the camming surface defines a camming profile for camming interaction with the reaction surface exhibiting a progressively steeper inclination depending on an extent to which the first trigger element is rotated toward a release position with respect to the bowstring catch.

9. A crossbow trigger mechanism in accordance with claim 5, further including a frame, and wherein the second trigger element includes a second body rotatably mounted with respect to the frame and a third body rotatably mounted with respect to the frame and disposed in spaced relation with the second body, the third body being operably coupled to the second body, and being selectively actuatable by a user so as to urge the second body to rotate relative to the first trigger element, and thereby to rotate the first trigger element relative to the bowstring catch for causing the first trigger element to release the bowstring catch.

10. A crossbow trigger mechanism in accordance with claim 9, wherein the second body is rotatably mounted with respect to the frame at a first location along the frame, and the third body is rotatably mounted with respect to the frame at a second location along the frame, the second location being axially forward of the first location along a corresponding direction of fire associated with the crossbow trigger mechanism.

11. A crossbow trigger mechanism in accordance with claim 9, wherein the second body is rotatably mounted with respect to the frame at a first location along the frame, and the third body is rotatably mounted with respect to the frame at a second location along the frame in spaced relation with the first location therealong, and further comprising a crosspiece, wherein the second body is rotatably mounted with respect to the crosspiece at a third location along the crosspiece, and the third body is rotatably mounted with respect to the crosspiece at a fourth location along the crosspiece in spaced relation with the third location therealong, such that the frame, the second body, the third body, and the crosspiece collectively form a four bar linkage for allowing a user to actuate the first trigger element.

12. A crossbow trigger mechanism in accordance with claim 11, wherein the four bar linkage includes a base link associated with the frame, a driving link associated with the third body, a driven link associated with the second body, and a coupler link associated with the crosspiece, and wherein a length of at least one of a group including the base link, the driving link, the driven link, the coupler link, and any combination thereof, is selectively variable by the user to adjust a mechanical advantage associated with actuating the third body to rotate the second body.

13. A crossbow trigger mechanism in accordance with claim 11, wherein the four bar linkage includes a base link associated with the frame, a driving link associated with the third body, a driven link associated with the second body, and a coupler link associated with the crosspiece, and wherein an angle between at least two of a group including the base link, the driving link, the driven link, the coupler link, and any combination thereof, is selectively variable by the user to adjust a mechanical advantage associated with actuating the third body to rotate the second body.

14. A crossbow trigger mechanism, comprising:

a trigger housing for receiving a bowstring of a crossbow;

a bowstring catch mounted with respect to the housing and adapted to releasably engage a crossbow bowstring brought within the trigger housing; and a dry fire stop including a first projection adapted to engage the bowstring catch for limiting a rotation of the bowstring catch away from a crossbow bowstring with which the bowstring catch is releasably engaged, and a second projection adapted to extend into a path of a crossbow bolt being loaded into the trigger housing such that as such crossbow bolt is loaded into the trigger housing, the crossbow bolt rotates the dry fire stop relative to the bowstring catch by impinging on and displacing the second projection away from the bolt loading path, thereby disengaging the first projection of from the bowstring catch and allowing rotation of the bowstring catch away from a crossbow bowstring with which the bowstring catch is releasably engaged;

wherein the bowstring catch includes a recessed pocket positioned on an upper portion of the bowstring catch for receiving the first projection of the dry fire stop to facilitate the first projection engaging the bowstring catch.

15. A crossbow trigger mechanism in accordance with claim 14, wherein the bowstring catch further includes a third projection adapted to displace the second projection of the dry fire stop away from a path of a crossbow bowstring being brought within the trigger housing for engagement by the bowstring catch.

* * * * *